US011207886B2

(12) United States Patent
Takagi et al.

(10) Patent No.: US 11,207,886 B2
(45) Date of Patent: Dec. 28, 2021

(54) PRINT HEAD AND LIQUID EJECTING APPARATUS

(71) Applicant: Seiko Epson Corporation, Tokyo (JP)

(72) Inventors: Eiji Takagi, Shiojiri (JP); Masanori Koizumi, Suwa (JP); Shunya Komatsu, Matsumoto (JP); Shuichi Nakano, Shiojiri (JP); Masashi Kamiyanagi, Matsumoto (JP); Toru Matsuyama, Matsumoto (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 17/032,165

(22) Filed: Sep. 25, 2020

(65) Prior Publication Data

US 2021/0094276 A1 Apr. 1, 2021

(30) Foreign Application Priority Data

Sep. 27, 2019 (JP) ..... JP2019-178014
Feb. 10, 2020 (JP) ..... JP2020-020819

(51) Int. Cl.
*B41J 2/045* (2006.01)

(52) U.S. Cl.
CPC ..... *B41J 2/0455* (2013.01); *B41J 2/04546* (2013.01); *B41J 2/04548* (2013.01); *B41J 2/04543* (2013.01); *B41J 2/04545* (2013.01)

(58) Field of Classification Search
CPC .. B41J 2/0455; B41J 2/04546; B41J 2/04548; B41J 2/04545; B41J 2/04543; B41J 2/04588; B41J 2/04551; B41J 2/04596; B41J 2/04571; B41J 2/04593; B41J 2/0451; B41J 2/04541; B41J 2/04581; B41J 2002/14354; B41J 2002/14491; B41J 2002/14419; B41J 2002/14241; B41J 2/14233; B41J 2202/19; B41J 2002/14362;

(Continued)

(56) References Cited

U.S. PATENT DOCUMENTS 6,478,399 B1 11/2002 Mitsuzawa et al.
7,123,367 B1 10/2006 Kanaya et al.

(Continued)

FOREIGN PATENT DOCUMENTS

JP 2000-071440 A 3/2000
JP 2004-314351 A 11/2004

*Primary Examiner* — Kristal Feggins
(74) *Attorney, Agent, or Firm* — Harness, Dickey & Pierce, P.L.C.

(57) ABSTRACT

A print head includes ejecting portions ejecting liquid by being supplied with a high voltage signal, a switch group switching between whether or not to supply the high voltage signal to the first ejecting portion group in accordance with a low voltage logic signal, a memory, a high voltage signal input terminal, and a low voltage logic signal input terminal, the print head having a first mode in which the print head executes reading processing of reading information stored in the memory and does not execute ejection control processing of controlling whether or not to supply the high voltage signal to the first ejecting portion group by switching the switch group in accordance with an input signal input from the low voltage logic signal input terminal and a second mode in which the print head does not execute the reading processing and executes the ejection control processing.

20 Claims, 26 Drawing Sheets

(58) Field of Classification Search
CPC ..... B41J 2202/20; B41J 2/01; B41J 2/04501; B41J 2/14201
See application file for complete search history.

(56) References Cited

U.S. PATENT DOCUMENTS

| | | | | |
|---|---|---|---|---|
| 2014/0267478 | A1* | 9/2014 | Yokoyama | B41J 2/14201 347/9 |
| 2019/0275791 | A1* | 9/2019 | Hirabayashi | B41J 2/04595 |
| 2019/0344582 | A1* | 11/2019 | Tanaka | B41J 2/04588 |

* cited by examiner

FIG. 13

| SI[b1, b2, b3] | Ts1 | | | Ts2 | | |
|---|---|---|---|---|---|---|
| | Sa | Sb | Sc | Sa | Sb | Sc |
| [1, 1, 0] | H | L | L | H | L | L |
| [1, 0, 0] | H | L | L | L | H | L |
| [0, 1, 0] | L | H | L | H | L | L |
| [0, 0, 0] | L | H | L | L | H | L |
| [0, 0, 1] | L | L | H | L | L | H |

FIG. 19

| STORAGE REGION | STORAGE INFORMATION | STORAGE REGION | STORAGE INFORMATION | STORAGE REGION | STORAGE INFORMATION |
|---|---|---|---|---|---|
| M1 | TPth1 | M15 | ECth3 | M29 | CPf2 |
| M2 | TPth2 | M16 | ECf1 | M30 | CPf3 |
| M3 | TPth3 | M17 | ECf2 | M31 | CLth1 |
| M4 | TPf1 | M18 | ECf3 | M32 | CLth2 |
| M5 | TPf2 | M19 | CECth1 | M33 | CLth3 |
| M6 | TPf3 | M20 | CECth2 | M34 | CLf1 |
| M7 | LDth1 | M21 | CECth3 | M35 | CLf2 |
| M8 | LDth2 | M22 | CECf1 | M36 | CLf3 |
| M9 | LDth3 | M23 | CECf2 | M37 | WPth1 |
| M10 | LDf1 | M24 | CECf3 | M38 | WPth2 |
| M11 | LDf2 | M25 | CPth1 | M39 | WPth3 |
| M12 | LDf3 | M26 | CPth2 | M40 | WPf1 |
| M13 | ECth1 | M27 | CPth3 | M41 | WPf2 |
| M14 | ECth2 | M28 | CPf1 | M42 | CLf3 |

PRINT HEAD AND LIQUID EJECTING APPARATUS

The present application is based on, and claims priority from JP Application Serial Number 2019-178014, filed Sep. 27, 2019 and JP Application Serial Number 2020-020819, filed Feb. 10, 2020, the disclosures of which are hereby incorporated by reference here in their entirety.

BACKGROUND

1. Technical Field

The present disclosure relates to a print head and a liquid ejecting apparatus.

2. Related Art

From the viewpoint of environmental load reduction in recent years, attention has been focused on so-called refurbished products in which a product having an initial defective product, a used product, or the like is refurbished, finished so as to become comparable to an unused product, and then re-distributed in a market. The amount of waste can be reduced by such refurbished products, and a reduction in environmental load can be achieved as a result. Regarding such efforts and liquid ejecting apparatuses such as ink jet printers, efforts for re-market distribution as recycled machines have been made by, for example, refurbishing and finishing of used ink cartridges, print heads, and so on into a state comparable to a state of non-use.

For example, JP-A-2004-314351 discloses a method for distinguishing whether an ink cartridge is a new product or a used product in a case where the ink cartridge is reused by reading attribute data stored in the ink cartridge used in an ink jet printer that is an example of a liquid ejecting apparatus.

In addition, JP-A-2000-071440 discloses a technique in which a print head of a printer as an example of a liquid ejecting apparatus includes a non-volatile memory storing information in accordance with the manufacturing history of the print head and it is possible to perform printing in accordance with the characteristics of the print head used in the printer by setting a printing processing parameter affecting a printing result based on the information stored in the non-volatile memory.

In a case where a print head constituting a liquid ejecting apparatus is reused, a print head ejecting ink may be reused in addition to the ink cartridge described in JP-A-2004-314351. However, information affecting a printing result in the print head may vary with the environment and record of use of the print head. Accordingly, in a case where a print head that is reused is driven by means of the technique of JP-A-2000-071440 for driving a print head based on information in accordance with the manufacturing history of the print head stored in a non-volatile memory, a change in the ejection characteristics of the print head in accordance with the use history of the print head that is reused is not taken into consideration, and thus the precision of ejection of the ink that is ejected from the print head may decline and this decline may result in a decline in the precision of printing in a liquid ejecting apparatus.

In addition, it is difficult to visually confirm the state of an ejecting portion ejecting ink from the print head and the degree of deterioration of the ejecting portion of the print head that is reused depends on the situation in which the print head is used. Accordingly, there is room for improvement from the viewpoint of performing driving with the state of a print head that is reused appropriately recognized.

SUMMARY

One aspect of a print head according to the present disclosure is a print head assembled to a liquid ejecting apparatus ejecting liquid with respect to a medium, the print head including: a first ejecting portion ejecting the liquid by being supplied with a high voltage signal changing in voltage value; a second ejecting portion ejecting the liquid by being supplied with the high voltage signal; a first ejecting portion group having a plurality of ejecting portions including the first ejecting portion and the second ejecting portion; a first switch switching between whether or not to supply the high voltage signal to the first ejecting portion in accordance with a low voltage logic signal having a maximum voltage value lower than a maximum voltage value of the high voltage signal and changing in voltage value; a second switch switching between whether or not to supply the high voltage signal to the second ejecting portion in accordance with the low voltage logic signal; a switch group having a plurality of switches including the first switch and the second switch; a memory; a high voltage signal input terminal to which the high voltage signal is input; and a low voltage logic signal input terminal to which the low voltage logic signal is input, in which the print head has: a first mode in which the print head executes reading processing of reading information stored in the memory and does not execute ejection control processing of controlling whether or not to supply the high voltage signal to the first ejecting portion group by switching the switch group in accordance with an input signal input from the low voltage logic signal input terminal; and a second mode in which the print head does not execute the reading processing and executes the ejection control processing in accordance with the input signal.

One aspect of the liquid ejecting apparatus according to the present disclosure includes: a drive signal output circuit outputting a drive signal; and a print head assembled to the liquid ejecting apparatus ejecting liquid with respect to a medium, in which the print head assembled to the liquid ejecting apparatus ejecting the liquid with respect to the medium includes: a first ejecting portion ejecting the liquid by being supplied with a high voltage signal changing in voltage value; a second ejecting portion ejecting the liquid by being supplied with the high voltage signal; a first ejecting portion group having a plurality of ejecting portions including the first ejecting portion and the second ejecting portion; a first switch switching between whether or not to supply the high voltage signal to the first ejecting portion in accordance with a low voltage logic signal having a maximum voltage value lower than a maximum voltage value of the high voltage signal and changing in voltage value; a second switch switching between whether or not to supply the high voltage signal to the second ejecting portion in accordance with the low voltage logic signal; a switch group having a plurality of switches including the first switch and the second switch; a memory; a high voltage signal input terminal to which the high voltage signal is input; and a low voltage logic signal input terminal to which the low voltage logic signal is input, and the print head has: a first mode in which the print head executes reading processing of reading information stored in the memory and does not execute ejection control processing of controlling whether or not to supply the high voltage signal to the first ejecting portion group by switching the switch group in accordance with an input signal input from the low voltage logic signal input terminal; and a second mode in which the print head does not execute the reading processing and executes the ejection control processing in accordance with the input signal.

BRIEF DESCRIPTION OF THE DRAWINGS

FIG. 13 is a diagram illustrating the content of decoding performed by a decoder.

FIG. 19 is a diagram illustrating an example of ejecting portion-related information stored in a storage circuit.

DESCRIPTION OF EXEMPLARY EMBODIMENTS

Preferred embodiments of the present disclosure will be described below with reference to the drawings. The drawings that are used are for convenience of description. It should be noted that the embodiments described below do not unduly limit the content of the present disclosure described in the claims. In addition, not all of the configurations described below are essential configuration requirements of the present disclosure. It should be noted that an ink jet printer that ejects ink as an example of a liquid from a print head and performs printing by the ejected ink landing on a medium will be described as an example of a liquid ejecting apparatus in the following description.

1. First Embodiment

1.1 Overview of Liquid Ejecting Apparatus

Figure 1:
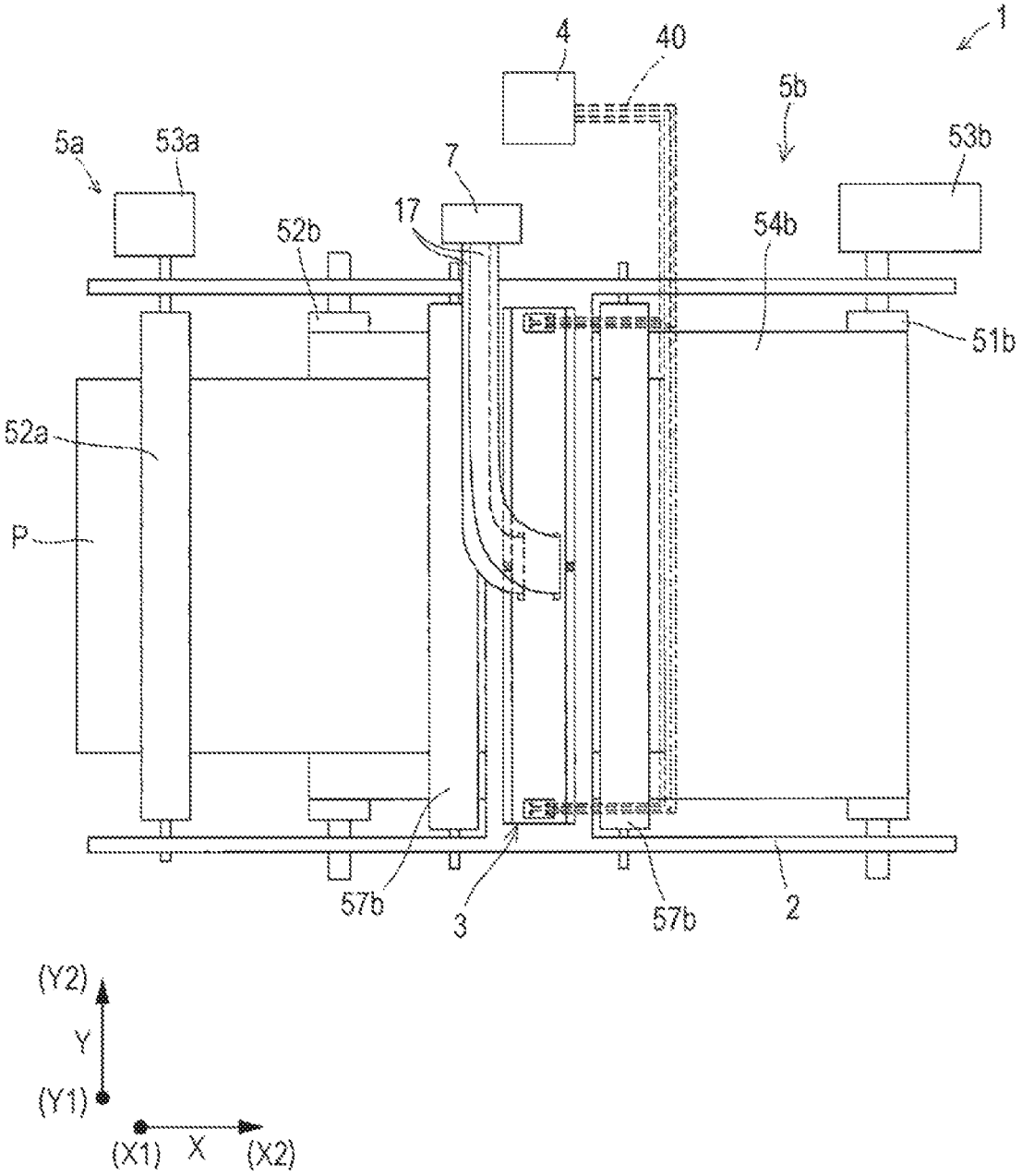
FIG. 1 is a top view illustrating a schematic configuration of a liquid ejecting apparatus.
Figure 2:
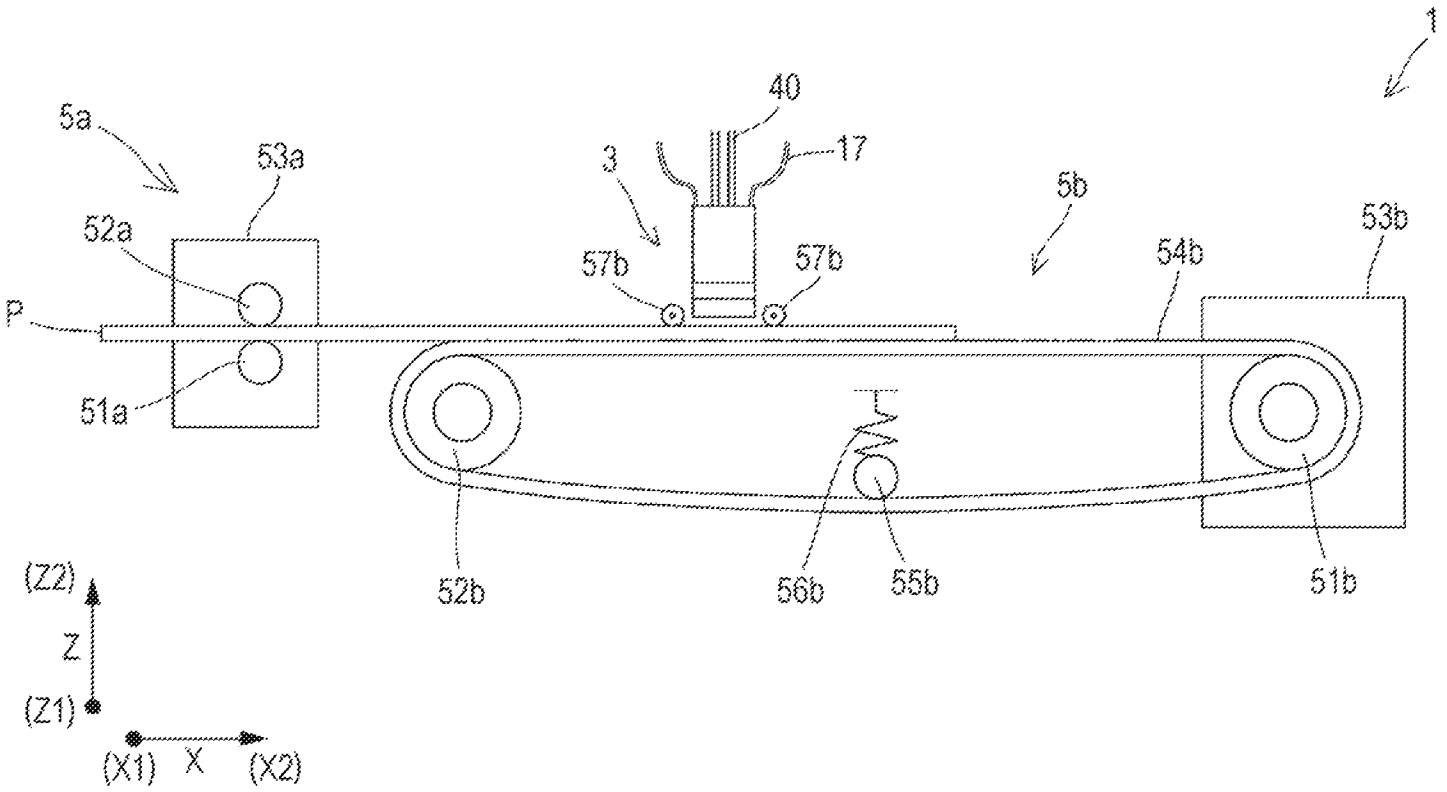
FIG. 2 is a side view illustrating a schematic configuration of the liquid ejecting apparatus.

FIG. 1 is a top view illustrating a schematic configuration of a liquid ejecting apparatus 1. FIG. 2 is a side view illustrating a schematic configuration of the liquid ejecting apparatus 1. As illustrated in FIGS. 1 and 2, in the present embodiment, the liquid ejecting apparatus 1 will be described by a so-called line-type ink jet printer that performs printing simply by transporting a medium P to which ink is ejected being exemplified. It should be noted that the liquid ejecting apparatus 1 is not limited to the line-type ink jet printer and may be a so-called serial-type ink jet printer in which a print head moves in synchronization with the transport of the medium P.

Here, the transport direction in which the medium P is transported in the following description will be referred to as a direction X, the upstream of the transport of the medium P will be described as an X1 side, and the downstream of the transport of the medium P will be described as an X2 side. In addition, in the in-plane direction of a landing surface where the ink lands on the medium P, a direction orthogonal to the direction X will be referred to as a direction Y, one end of the liquid ejecting apparatus 1 in the direction Y will be described as a Y1 side, and the other end of the liquid ejecting apparatus 1 in the direction Y will be described as a Y2 side. Further, a direction that is orthogonal to both the direction X and the direction Y and in which the ink ejected from a print head 3 to the medium P is ejected will be referred to as a direction Z and the ink ejected from the print head 3 is ejected from a Z2 side toward a Z1 side of the direction Z in the following description. It should be noted that configurations of the liquid ejecting apparatus 1 are not limited to being disposed so as to be mutually orthogonal although the directions X, Y, and Z in the present embodiment are described as mutually orthogonal axes.

As illustrated in FIGS. 1 and 2, the liquid ejecting apparatus 1 has an apparatus main body 2, the print head 3, storage means 4, first transport means 5*a*, and second transport means 5*b*.

The storage means 4 is fixed to the apparatus main body 2. Further, the ink supplied to the print head 3 is stored in the storage means 4. An ink cartridge, a bag-shaped ink pack formed of a flexible film, an ink tank that can be replenished with ink, or the like is used as the storage means 4 in which such ink is stored. The ink stored in the storage means 4 is supplied to the print head 3 via a supply pipe 40 such as a tube. Here, the storage means 4 may store ink of a plurality of colors such as black, cyan, magenta, yellow, red, and gray. Accordingly, the storage means 4 may include a plurality of ink cartridges, a plurality of ink packs, and a plurality of ink tanks corresponding to the colors of the stored ink and the supply pipe 40 may include a plurality of tubes corresponding to the colors of the ink stored in the storage means 4. In addition, the storage means 4 may be mounted on the print head 3.

A signal for controlling ink ejection is supplied from a print head drive circuit substrate 7 to the print head 3 via a cable 17. Then, the print head 3 ejects the ink supplied from the storage means 4 by an amount corresponding to the signal supplied from the print head drive circuit substrate 7 and at a timing corresponding to the signal supplied from the print head drive circuit substrate 7. It should be noted that details of the print head 3 will be described later.

The first transport means 5*a* is positioned on the X1 side of the print head 3. In addition, at least a part of the second transport means 5*b* is positioned on the X2 side of the print head 3. The first transport means 5*a* and the second transport means 5*b* transport the medium P from the X1 side toward the X2 side in a direction along the direction X.

The first transport means 5*a* includes a transport roller 51*a*, a driven roller 52*a*, and a drive motor 53*a*. The transport roller 51*a* is provided on the side of the surface that is opposite to the ink landing surface of the medium P, that is, the Z1 side of the medium P. A drive force is supplied from the drive motor 53*a* to the transport roller 51*a*. The transport roller 51*a* is driven in accordance with the drive force supplied from the drive motor 53*a*. In addition, the driven roller 52*a* is provided on the side of the ink landing surface of the medium P, that is, the Z2 side of the medium P. The driven roller 52*a* pinches the medium P with the transport roller 51*a*. Then, the driven roller 52*a* is driven by the driving of the transport roller 51*a*. Here, the driven roller 52*a* may include, for example, a spring (not illustrated) that presses the medium P toward the transport roller 51*a* by stress generated by a biasing member.

The second transport means 5*b* includes a transport roller 51*b*, a driven roller 52*b*, a drive motor 53*b*, a transport belt 54*b*, a tension roller 55*b*, a biasing member 56*b*, and a pressing roller 57*b*.

The transport roller 51*b* is positioned on the X2 side of the print head 3 in the direction X. A drive force is supplied from the drive motor 53*b* to the transport roller 51*b*. Then, the transport roller 51*b* is driven in accordance with the drive force supplied from the drive motor 53*b*. The driven roller 52*b* is positioned on the X1 side of the print head 3 in the direction X. The transport belt 54*b* is an endless belt and hung on the outer periphery of the transport roller 51*b* and the driven roller 52*b*.

The transport belt 54*b* is positioned on the Z1 side of the medium P. Further, the transport belt 54*b* is driven by the transport roller 51*b* being driven in accordance with the drive force supplied from the drive motor 53*b* and the driven roller 52*b* is driven as a result. The tension roller 55*b* is positioned between the transport roller 51*b* and the driven roller 52*b* so as to abut against the inner peripheral surface of the transport belt 54*b*. The tension roller 55*b* applies tension to the transport belt 54*b* by the biasing force that is generated by the biasing member 56*b* such as a spring. As a result, the surface of the transport belt 54*b* that is between the transport roller 51*b* and the driven roller 52*b* and faces the print head 3 becomes flat.

The pressing roller 57*b* is provided on each of the X1 side and the X2 side of the print head 3 on the Z2 side of the medium P. Further, the posture of the medium P is kept flat by the medium P being pinched between the pressing roller 57*b* and the transport belt 54*b*.

In the liquid ejecting apparatus 1 configured as described above, the medium P is transported from the X1 side toward the X2 side in a direction along the direction X and the print head 3 ejects ink to the medium P at a predetermined timing by the first transport means 5*a* and the second transport means 5*b* being driven. As a result, the ink ejected from the print head 3 lands at a desired position of the medium P and a desired image is formed on the medium P.

1.2 Structure of Print Head

Figure 3:
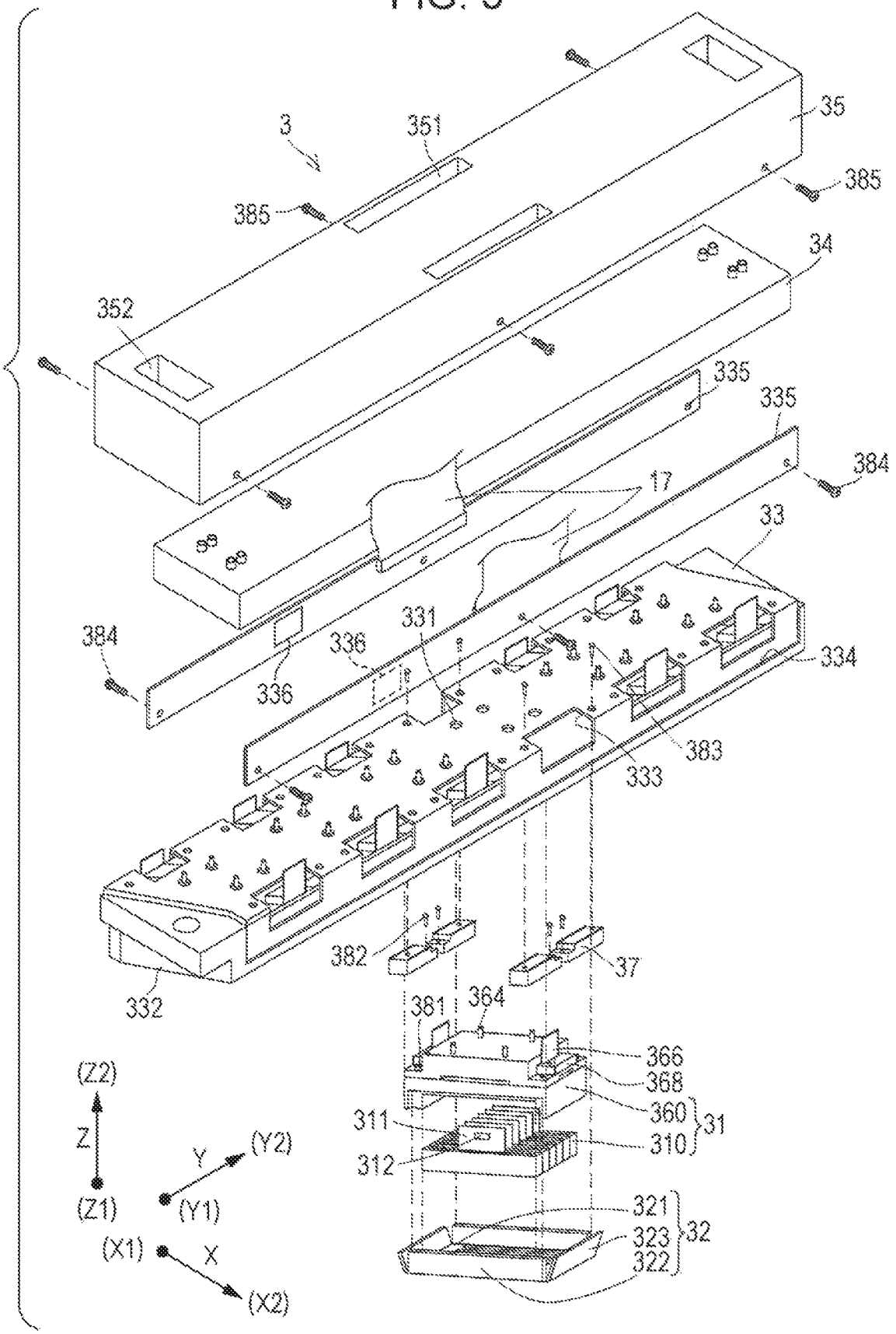
FIG. 3 is an exploded perspective view illustrating the structure of a print head.

Next, the structure of the print head 3 will be described. FIG. 3 is an exploded perspective view illustrating the structure of the print head 3. As illustrated in FIG. 3, the print head 3 has a plurality of head main bodies 31, a plurality of covers 32, a base member 33, a flow path member 34, and a cover member 35. Here, as illustrated in FIG. 3, the plurality of covers 32 are provided so as to respectively correspond to the plurality of head main bodies 31. In other words, the print head 3 has a plurality of sets of the head main body 31 and the cover 32. It should be noted that a case where the print head 3 has six head main bodies 31 and six covers 32 is exemplified in FIG. 3 and yet the numbers of the head main bodies 31 and the covers 32 of the print head 3 are not limited thereto.

Figure 4:
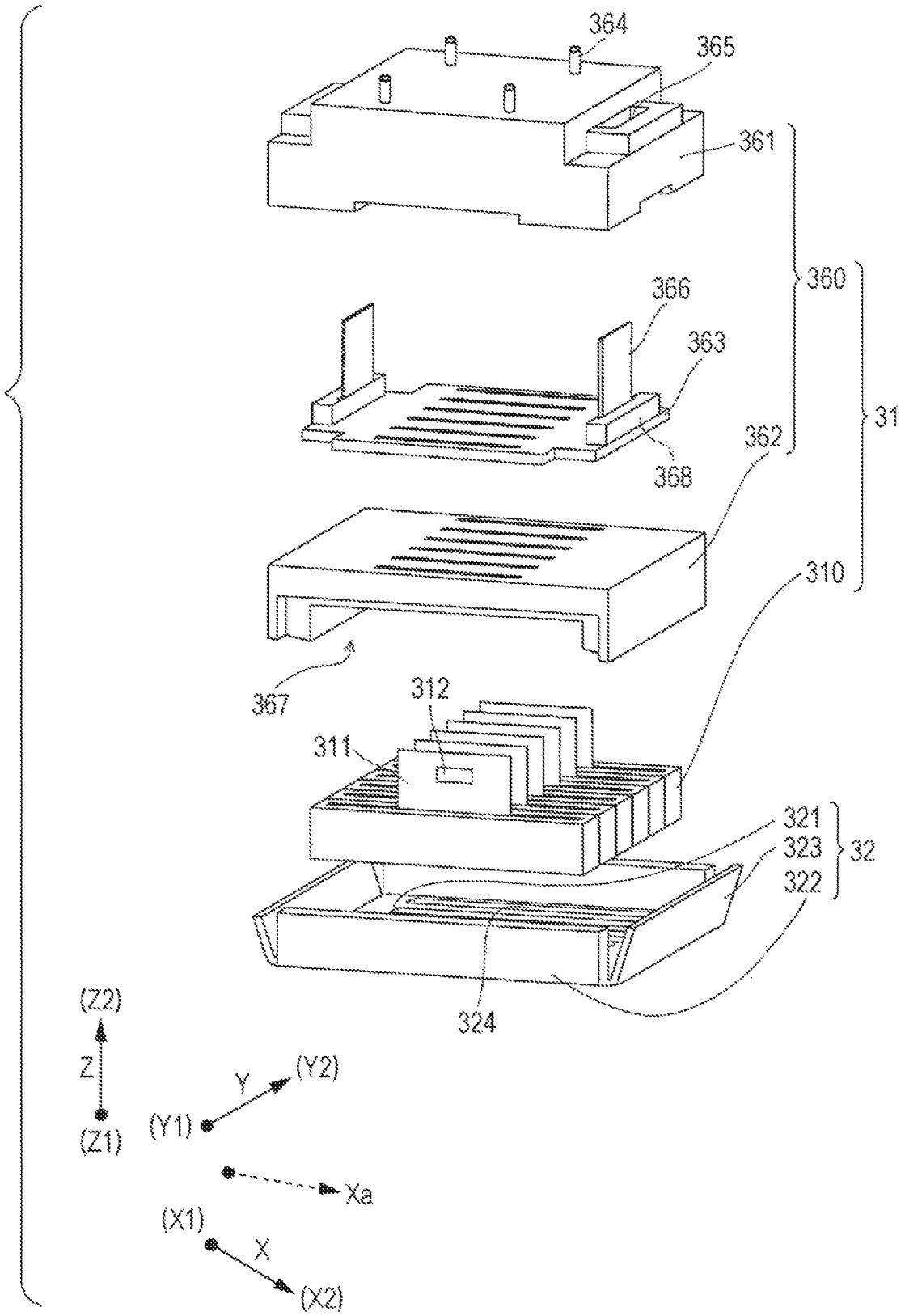
FIG. 4 is an exploded perspective view of a head main body.
Figure 5:
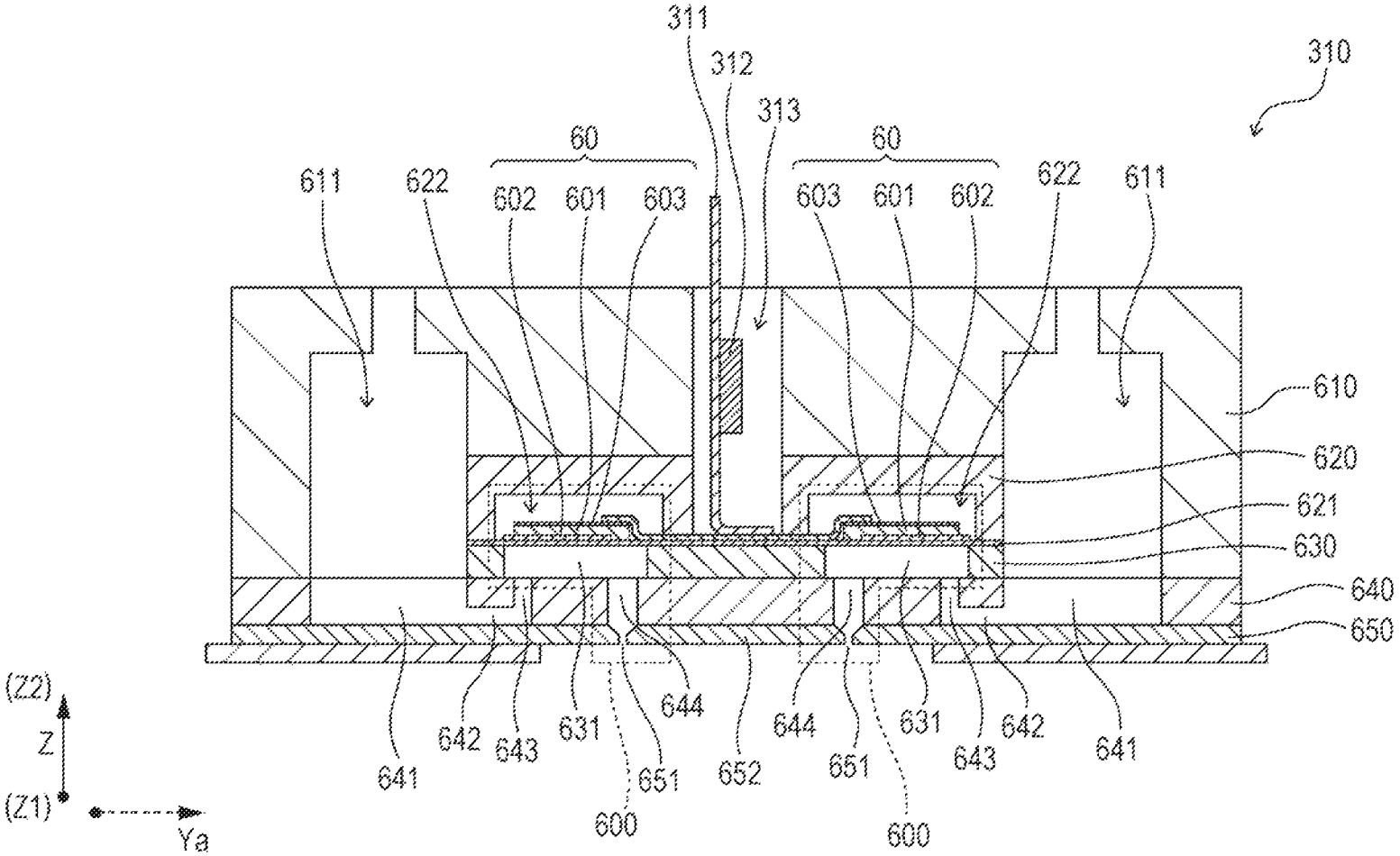
FIG. 5 is a cross-sectional view of a head chip included in the head main body.

First, the structure of the head main body 31 will be described with reference to FIGS. 4 and 5. FIG. 4 is an exploded perspective view of the head main body 31. FIG. 5 is a cross-sectional view of a head chip 310 included in the head main body 31. As illustrated in FIG. 4, the head main body 31 has a plurality of the head chips 310 and a holding member 360. It should be noted that the head main body 31 that has six head chips 310 is exemplified in FIG. 4 and yet the present disclosure is not limited thereto.

As illustrated in FIG. 5, each head chip 310 has a case 610, a protective substrate 620, a pressure chamber substrate 630, a flow path substrate 640, and a nozzle plate 650. Further, in the head chip 310, the case 610, the protective substrate 620, the pressure chamber substrate 630, the flow path substrate 640, and the nozzle plate 650 are bonded by an adhesive or the like.

The nozzle plate 650 has a plurality of ink ejecting nozzles 651. Specifically, the nozzle plate 650 is provided with two nozzle rows in a direction along a direction Ya and the plurality of nozzles 651 are arranged in parallel in a direction along a direction Xa in the two nozzle rows. Here, the direction Xa is a direction inclined with respect to the direction X, which is the transport direction of the medium P, and the direction Ya is a direction intersecting with the direction Xa on the X-Y plane defined by the direction X and the direction Y. In other words, the head main body 31 is mounted on the print head 3 such that the direction in which the nozzles 651 of the head chip 310 are arranged in parallel is inclined with respect to the direction X, which is the transport direction of the medium P. It should be noted that the nozzle rows formed by the nozzles 651 are not limited to two rows and may be one row or three or more rows. Here, the Z1-side surface where the nozzle 651 opens in the nozzle plate 650 is referred to as a nozzle surface 652.

The pressure chamber substrate 630 is positioned on the Z2 side of the nozzle plate 650. The pressure chamber substrate 630 has a plurality of pressure generation chambers 631 partitioned by a partition wall or the like. Each pressure generation chamber 631 is positioned so as to correspond to the nozzle 651 included in the nozzle plate 650. In other words, the pressure chamber substrate 630 has the same number of pressure generation chambers 631 as the nozzles 651 provided in the nozzle plate 650. Further, the plurality of pressure generation chambers 631 included in the pressure chamber substrate 630 are arranged in parallel in a direction along the direction Xa. Further, two rows of the pressure generation chambers 631 arranged in parallel are positioned in a direction along the direction Ya.

The flow path substrate 640 is positioned on the Z2 side of the nozzle plate 650 and the Z1 side of the pressure chamber substrate 630. In other words, the flow path substrate 640 is positioned between the nozzle plate 650 and the pressure chamber substrate 630 in a direction along the direction Z. The flow path substrate 640 has a branch flow path 642, a communication flow path 643, an individual flow path 644, and a common flow path 641 for supplying the ink supplied from the storage means 4 to each of the plurality of nozzles 651.

The individual flow path 644 communicates with the corresponding nozzle 651 and pressure generation chamber 631. The common flow path 641 is provided in common with respect to the plurality of pressure generation chambers 631 included in the pressure chamber substrate 630 and the plurality of nozzles 651 included in the nozzle plate 650. Ink is supplied from the storage means 4 to the common flow path 641. The ink supplied to the common flow path 641 is supplied to the pressure generation chamber 631 via the branch flow path 642 and the communication flow path 643 provided so as to correspond to the pressure generation chamber 631. In other words, the branch flow path 642 and the communication flow path 643 allow the common flow path 641 and the corresponding pressure generation chamber 631 to communicate with each other. The flow path substrate 640 configured as described above supplies the ink supplied to the common flow path 641 to the pressure generation chamber 631 via the communication flow path 643 after causing the ink to branch so as to correspond to each of the plurality of pressure generation chambers 631 in the branch flow path 642.

A diaphragm 621 is bonded to the Z2-side surface of the pressure chamber substrate 630. In addition, a plurality of piezoelectric elements 60 corresponding to the plurality of pressure generation chambers 631 are provided on the Z2-side surface of the diaphragm 621. Specifically, each piezoelectric element 60 includes electrodes 602 and 603 and a piezoelectric layer 601, which are stacked in the order of the electrode 602, the piezoelectric layer 601, and the electrode 603 from the Z1 side toward the Z2 side in a direction along the direction Z on the Z2-side surface of the diaphragm 621. Further, one of the electrodes 602 and 603 of each piezoelectric element 60 is configured as a common electrode that supplies a signal of a common voltage value to the piezoelectric element 60 and the other of the electrodes 602 and 603 is configured as an individual electrode that supplies a signal of an individual voltage value to each piezoelectric element 60. It should be noted that the electrode 602 is described as an individual electrode and the electrode 603 is described as a common electrode in the present embodiment and yet the present disclosure is not limited thereto.

In the piezoelectric element 60 configured as described above, the piezoelectric layer 601 is deformed in accordance with the potential difference generated between the electrode 602 and the electrode 603. In other words, the piezoelectric element 60 is driven in accordance with the potential difference between the voltage value of the signal supplied to the electrode 602 and the voltage value of the signal supplied to the electrode 603. Then, the diaphragm 621 is displaced by the piezoelectric element 60 being driven. The internal pressure of the pressure generation chamber 631 decreases in a case where the diaphragm 621 is displaced to the Z2 side. As a result, ink is supplied from the common flow path 641 to the pressure generation chamber 631 via the branch flow path 642 and the communication flow path 643. On the other hand, the internal pressure of the pressure generation chamber 631 rises in a case where the diaphragm 621 is displaced to the Z1 side. As a result, the ink stored in the pressure generation chamber 631 is ejected from the nozzle 651 via the individual flow path 644. Here, the configuration that includes the piezoelectric element 60, the pressure generation chamber 631, the individual flow path 644, and the nozzle 651 is referred to as an ejecting portion 600 ejecting ink from the print head 3.

The protective substrate 620 is positioned on the Z2 side of the diaphragm 621. The protective substrate 620 has a holding portion 622 that forms a space for protecting the piezoelectric element 60. The space formed by the holding portion 622 has a sufficient size with respect to displacement entailed by the driving of the piezoelectric element 60.

The case 610 is positioned on the Z2 side of the flow path substrate 640 and the protective substrate 620. The case 610 has a manifold 611, which is a common liquid chamber communicating with the common flow path 641 of the flow path substrate 640. The manifold 611 is a space where the ink supplied to the plurality of nozzles 651 is stored and is continuously provided over the plurality of nozzles 651 and the plurality of pressure generation chambers 631. The ink supplied to the manifold 611 is supplied to the common flow path 641.

In addition, in the head main body 31, the protective substrate 620 and the case 610 are provided with a through hole 313 that penetrates the protective substrate 620 and the case 610 in a direction along the direction Z. A flexible wiring substrate 311 is inserted through the through hole 313. Then, one end of the flexible wiring substrate 311 is electrically coupled to a lead electrode pulled out from the electrodes 602 and 603 of the piezoelectric element 60. In other words, a signal for driving the piezoelectric element 60 propagates to the flexible wiring substrate 311. In addition, an integrated circuit 312 is mounted on the flexible wiring substrate 311. A signal for driving the piezoelectric element 60 propagating on the flexible wiring substrate 311 is input to the integrated circuit 312. Then, the integrated circuit 312 controls the timing at which a signal for driving the piezoelectric element 60 is supplied to the electrode 602 based on the input signal. As a result, the drive timing of the piezoelectric element 60 and the drive amount of the piezoelectric element 60 are controlled. Accordingly, a predetermined amount of ink is ejected at a predetermined timing from the ejecting portion 600 including the piezoelectric element 60.

The head chip 310 configured as described above is held by the holding member 360 in the head main body 31. As illustrated in FIG. 4, the holding member 360 includes a flow path member 361, a holder 362, and a relay substrate 363.

An ink flow path is provided in the flow path member 361 so that the ink supplied from the storage means 4 is supplied to each head chip 310. The ink flow path communicates with an ink supply portion 364 provided on the Z2-side surface of the flow path member 361. In other words, the ink supplied from the storage means 4 is supplied to the flow path member 361 via the ink supply portion 364. It should be noted that the ink flow path provided in the flow path member 361 is provided so as to correspond to each ink supply portion 364. Here, the flow path member 361 that has four ink supply portions 364 is illustrated in FIG. 4 and yet the present disclosure is not limited thereto. In addition, a filter for removing foreign matter such as dust and air bubbles contained in the supplied ink may be provided in the flow path member 361.

Cable insertion holes 365 penetrating the flow path member 361 in the direction Z are provided in both end portions of the flow path member 361 along the direction X. A cable 366 electrically coupled to the relay substrate 363 (described later) via a terminal group 368 is inserted through the cable insertion hole 365. Here, the terminal group 368 may be any configuration that includes a plurality of terminals respectively corresponding to a plurality of wires included in the cable 366, is not limited to the connector-shaped configuration illustrated in FIG. 4, and may be, for example, a plurality of electrodes provided on the relay substrate 363.

The holder 362 is positioned on the Z1 side of the flow path member 361 and fixed to the flow path member 361 by a screw 381 illustrated in FIG. 3. In addition, the holder 362 has a holding portion 367. The holding portion 367 is a groove-shaped space that is continuous over the direction Y and opens on both side surfaces in the direction Y on the Z1-side surface of the holder 362. Further, the plurality of head chips 310 are bonded to the holding portion 367 by an adhesive (not illustrated) or the like. As a result, the plurality of head chips 310 are held by the holding member 360.

In addition, an ink flow path (not illustrated) that communicates with the ink flow path provided in the flow path member 361 is provided in the holder 362. The ink supplied from the ink supply portion 364 is supplied to each head chip 310 via the ink flow path provided in the flow path member 361 and the ink flow path provided in the holder 362.

The relay substrate 363 is positioned between the flow path member 361 and the holder 362. The flexible wiring substrate 311 included in each head chip 310 is electrically coupled to the relay substrate 363. In addition, the terminal group 368 is provided on the relay substrate 363. The relay substrate 363 configured as described above propagates a signal input via the cable 366 electrically coupled to the terminal group 368 to the corresponding head chip 310 and outputs a signal output from each head chip 310 via the flexible wiring substrate 311 to the outside of the head main body 31 via the terminal group 368 and the cable 366.

At least a part of the head main body 31 described above is covered with the cover 32. As a result, the risk of ink droplets that float in the liquid ejecting apparatus 1 adhering to each head chip 310 is reduced. In other words, the cover 32 protects the head chip 310 included in the head main body 31 from ink droplets.

The cover 32 is provided on the Z1 side, which is the nozzle surface 652 side of the plurality of head chips 310 provided in the head main body 31. Further, the cover 32 and the head main body 31 are bonded by an adhesive (not illustrated) or the like.

As illustrated in FIG. 4, the cover 32 includes a base portion 321 and extending portions 322 and 323. The base portion 321 is a plate-shaped member provided on the nozzle surface 652 side of the head chip 310 of the head main body 31 covered with the cover 32 and is bonded to the Z1-side surface of the head main body 31 by an adhesive (not illustrated) or the like. The extending portion 322 is a plate-shaped member extending toward the Z2 side from both end portions of the base portion 321 in the direction Y and has a size that covers the direction Y of the head main body 31. In addition, the extending portion 323 is a plate-shaped member extending toward the Z2 side from both end portions of the base portion 321 in the direction X and has a size that covers the direction Y of the head main body 31. In other words, the cover 32 protects the head chip 310 from ink droplets floating in the liquid ejecting apparatus 1 by a space being formed by the base portion 321 and the extending portions 322 and 323 and the head main body 31 being inserted into the formed space.

In addition, the base portion 321 has a plurality of opening portions 324. The opening portions 324 respectively correspond to the head chips 310 and are positioned so as to correspond to the nozzle rows formed by the nozzles 651 of the head chips 310. As a result, the ink ejected from each head chip 310 lands on the medium P without being hindered by the cover 32.

Returning to FIG. 3, an accommodation portion 332 having an accommodation space that is a space opening to the Z1 side is provided in the base member 33. Further, the plurality of head main bodies 31 are accommodated and held in the accommodation space. Specifically, the head main body 31 is accommodated in the accommodation portion 332 of the base member 33 such that the nozzle surface 652 side of the head main body 31 protrudes to the Z1 side beyond the accommodation portion 332. In this case, each of the plurality of head main bodies 31 is accommodated in the accommodation portion 332 such that the nozzle row positioned on the nozzle surface 652 is along the direction Xa, which is inclined with respect to the direction X.

In addition, the head main body 31 is fixed to the base member 33 via a spacer 37 in a case where the head main body 31 is accommodated in the base member 33. The spacer 37 is fixed to the Z2-side surface of the head main body 31 by a screw 382 and fixed to the Z1-side surface of the base member 33 by a screw 383. In other words, the head main body 31 is fixed to the base member 33 via the spacer 37. The head main body 31 can be easily attached to and detached from the base member 33 by the spacer 37 fixed to the head main body 31 by the screw 382 being fixed to the base member 33 by the screw 383 as described above. It should be noted that the spacer 37 and the head main body 31 are not limited to being fixed by means of the screw 382 and may be bonded by, for example, an adhesive. Further, the head main body 31 may be configured integrally with the spacer 37.

In addition, the base member 33 has a supply hole 331 penetrating the base member 33 in the direction Z. The ink supply portion 364 of the head main body 31 fixed to the base member 33 is inserted through the supply hole 331. In addition, the base member 33 has an opening portion 333 penetrating the base member 33 in the direction Z. The cable 366 included in the head main body 31 fixed to the base member 33 is inserted through the opening portion 333.

In addition, steps 334 opening to the Z2 side are provided on the outer peripheries of both sides of the accommodation portion 332 that face each other in a direction along the direction X. A branch wiring substrate 335 is accommodated in each of the steps 334. The cable 366 corresponding to each of the plurality of head main bodies 31 led out from a plurality of the opening portions 333 is electrically coupled to the branch wiring substrate 335. As a result, a signal input to each of the plurality of head main bodies 31 and a signal output from the plurality of head main bodies 31 propagate to the branch wiring substrate 335.

In addition, an integrated circuit 336 is mounted on the branch wiring substrate 335. It should be noted that FIG. 3 illustrates a case where the print head 3 includes two branch wiring substrates 335 and each of the branch wiring substrates 335 includes the integrated circuit 336 and yet only one of the branch wiring substrates 335 may be configured to include the integrated circuit 336 and the print head 3 may include one branch wiring substrate 335.

Further, the cable 17 electrically coupled to the print head drive circuit substrate 7 fixed to the apparatus main body 2 is coupled to the branch wiring substrate 335. As a result, various signals generated by the print head drive circuit substrate 7 are input to the print head 3.

The flow path member 34 is provided on the Z2 side of the base member 33. The flow path member 34 distributes and supplies the ink supplied from the storage means 4 to each of the plurality of head main bodies 31. An ink flow path (not illustrated) for supplying the ink supplied from the storage means 4 to the plurality of head main bodies 31 is provided in the flow path member 34. The ink flow path provided in the flow path member 34 communicates with the supply pipe 40 coupled to the storage means 4 and communicates with the ink supply portion 364 of the head main body 31. As a result, the ink supplied from the storage means 4 is supplied to the corresponding head main body 31.

The cover member 35 is provided on the Z2 side of the flow path member 34. The cover member 35 is a box-shaped member that covers the flow path member 34 and the branch wiring substrate 335. The cover member 35 is provided with an opening portion 351 for inserting the cable 17 and an opening portion 352 for inserting the supply pipe 40. The cover member 35 as described above is fixed to the accommodation portion 332 of the base member 33 by a screw 385.

As described above, the print head 3 is the print head 3 that is assembled to the liquid ejecting apparatus 1 ejecting ink with respect to the medium P and includes the ejecting portion 600 ejecting ink in response to a signal supplied to the electrode 602 that is an individual electrode. In addition, the print head 3 includes the plurality of head main bodies 31 and the branch wiring substrate 335 coupled in common to the plurality of head main bodies 31. The branch wiring substrate 335 is an example of the circuit substrate according to the first embodiment.

1.3 Functional Configuration of Liquid Ejecting Apparatus

Figure 6:
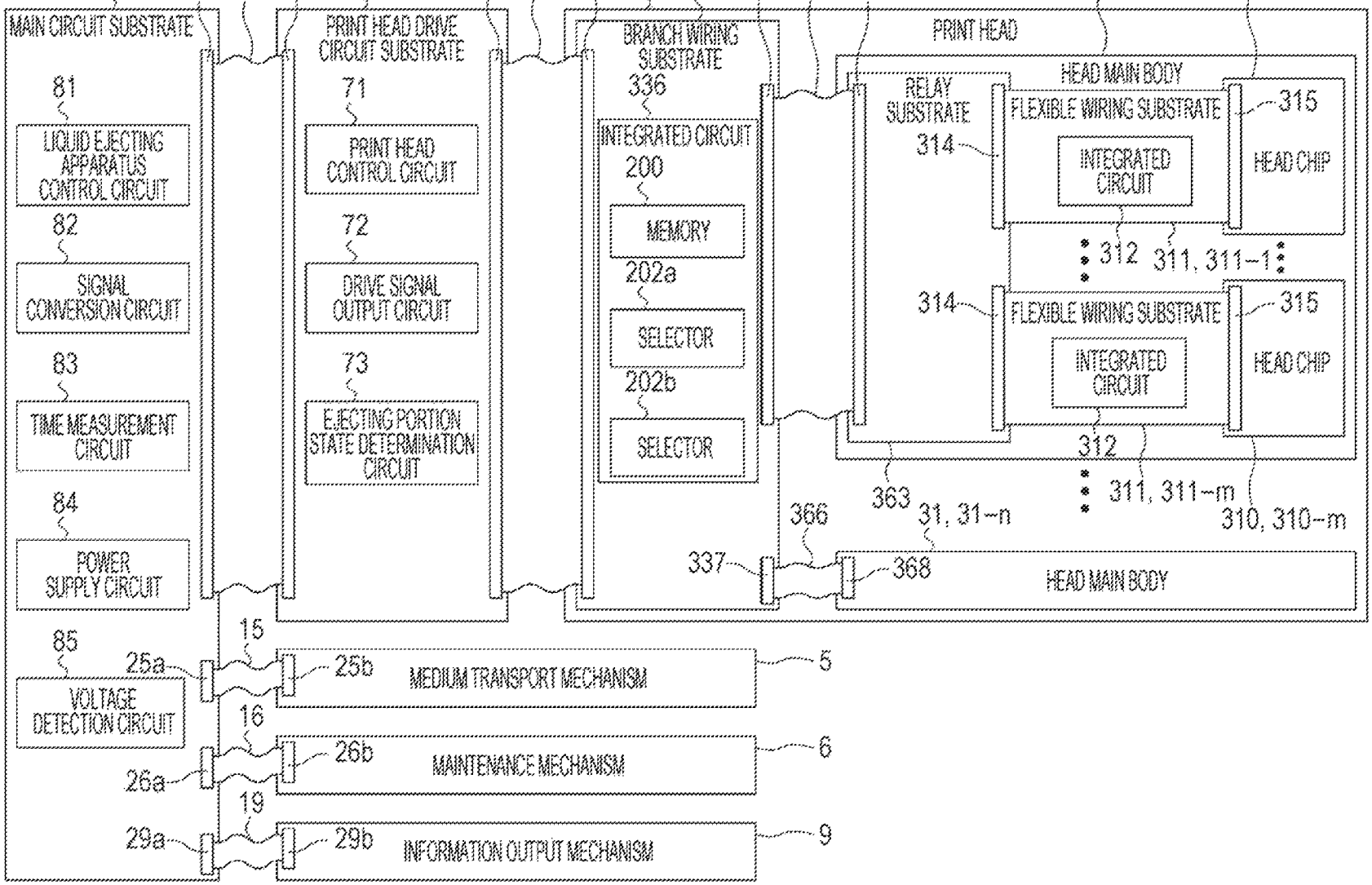
FIG. 6 is a diagram illustrating the functional configuration of the liquid ejecting apparatus.

Next, the functional configuration of the liquid ejecting apparatus 1 will be described. FIG. 6 is a diagram illustrating the functional configuration of the liquid ejecting apparatus 1. As illustrated in FIG. 6, the liquid ejecting apparatus 1 has the print head 3, a medium transport mechanism 5, a maintenance mechanism 6, the print head drive circuit substrate 7, a main circuit substrate 8, and an information output mechanism 9. In addition, the liquid ejecting apparatus 1 has the cable 17 and cables 15, 16, 18, and 19 electrically coupling the print head 3, the medium transport mechanism 5, the maintenance mechanism 6, the print head drive circuit substrate 7, the main circuit substrate 8, and the information output mechanism 9.

The cable 15 electrically couples the main circuit substrate 8 and the medium transport mechanism 5 by electrically coupling a terminal group 25*a* provided on the main circuit substrate 8 and a terminal group 25*b* provided on the medium transport mechanism 5. The cable 16 electrically couples the main circuit substrate 8 and the maintenance mechanism 6 by electrically coupling a terminal group 26*a* provided on the main circuit substrate 8 and a terminal group 26*b* provided on the maintenance mechanism 6. The cable 17 electrically couples the print head drive circuit substrate 7 and the print head 3 by electrically coupling a terminal group 27*a* provided on the print head drive circuit substrate 7 and a terminal group 27*b* provided on the branch wiring substrate 335 included in the print head 3. The cable 18 electrically couples the main circuit substrate 8 and the print head drive circuit substrate 7 by electrically coupling a terminal group 28*a* provided on the main circuit substrate 8 and a terminal group 28*b* provided on the print head drive circuit substrate 7. The cable 19 electrically couples the main circuit substrate 8 and the information output mechanism 9 by electrically coupling a terminal group 29*a* provided on the main circuit substrate 8 and a terminal group 29*b* provided on the information output mechanism 9.

Here, various cables such as a flexible flat cable (FFC) and a coaxial cable are used as the cables 15 to 19 in accordance with the form of a signal to be propagated. In addition, each of the terminal groups 25*a*, 25*b*, 26*a*, 26*b*, 27*a*, 27*b*, 28*a*, 28*b*, 29*a*, and 29*b* may be any configuration capable of electrically coupling the corresponding cables 15 to 19 and each circuit substrate, may be, for example, a connector to which the cables 15 to 19 are detachably attached, and may be a plurality of electrode groups formed on the substrate of each circuit.

In addition, any of the signals that propagate through the cables 15 to 19 may be an optical signal. In this case, any of the corresponding cables 15 to 19 may be an optical communication cable and the corresponding terminal groups 25*a*, 25*b*, 26*a*, 26*b*, 27*a*, 27*b*, 28*a*, 28*b*, 29*a*, and 29*b* may be optical connectors.

In other words, the cable 15 and the terminal groups 25*a* and 25*b* electrically coupling the main circuit substrate 8 and the medium transport mechanism 5 means that the main circuit substrate 8 and the medium transport mechanism 5 are communicably coupled. Likewise, the cable 16 and the terminal groups 26*a* and 26*b* electrically coupling the main circuit substrate 8 and the maintenance mechanism 6 means that the main circuit substrate 8 and the maintenance mechanism 6 are communicably coupled. Likewise, the cable 17 and the terminal groups 27*a* and 27*b* electrically coupling the print head drive circuit substrate 7 and the print head 3 means that the print head drive circuit substrate 7 and the print head 3 are communicably coupled. Likewise, the cable 18 and the terminal groups 28*a* and 28*b* electrically coupling the main circuit substrate 8 and the print head drive circuit substrate 7 means that the main circuit substrate 8 and the print head drive circuit substrate 7 are communicably coupled. Likewise, the cable 19 and the terminal groups 29*a* and 29*b* electrically coupling the main circuit substrate 8 and the information output mechanism 9 means that the main circuit substrate 8 and the information output mechanism 9 are communicably coupled.

It should be noted that the print head 3 has n head main bodies 31 and each head main body 31 has m head chips 310, as illustrated in FIG. 6, in the following description of the functional configuration of the liquid ejecting apparatus 1. In other words, the print head 3 has a total of n×m head chips 310 in the following description. Further, in the following description, the n head main bodies 31 may be referred to as head main bodies 31-1 to 31-*n* in a case where the n head main bodies 31 are distinguished and, similarly, the m head chips 310 may be referred to as head chips 310-1 to 310-*m* in a case where the m head chips 310 are distinguished. In addition, a case where the print head 3 includes one branch wiring substrate 335 will be described as an example in the following description.

1.3.1 Functional Configuration of Main Circuit Substrate

The main circuit substrate 8 generates a signal for controlling each configuration of the liquid ejecting apparatus 1 based on image data input from a host computer or the like provided outside the liquid ejecting apparatus 1 and outputs the signal to the corresponding configuration.

Figure 7:
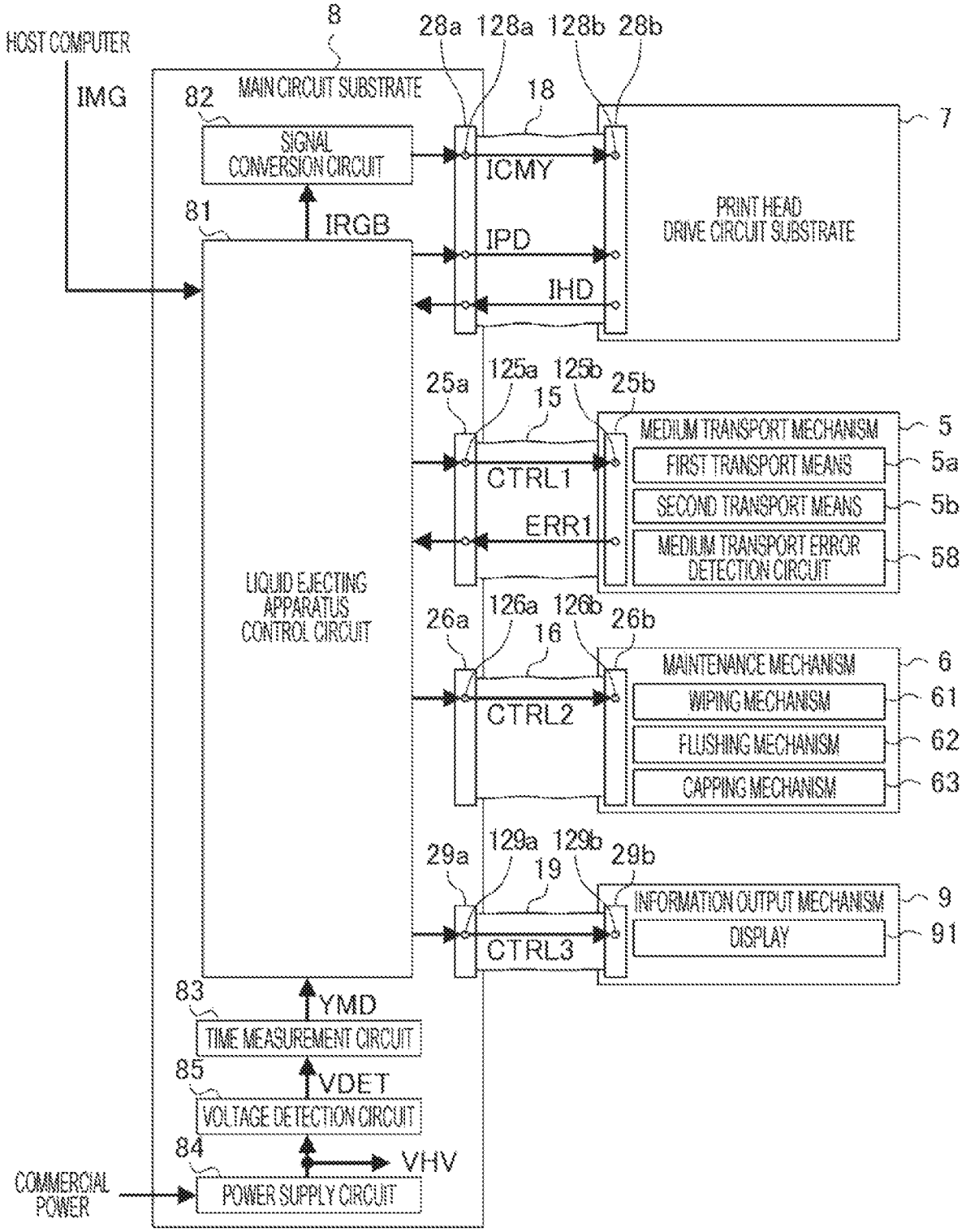
FIG. 7 is a diagram for describing details of a main circuit substrate.

FIG. 7 is a diagram for describing details of the main circuit substrate 8. As illustrated in FIG. 7, the main circuit substrate 8 has a liquid ejecting apparatus control circuit 81, a signal conversion circuit 82, a time measurement circuit 83, a power supply circuit 84, and a voltage detection circuit 85. In addition, the main circuit substrate 8 is provided with the terminal group 25*a* including a plurality of terminals 125*a*, the terminal group 26*a* including a plurality of terminals 126*a*, the terminal group 28*a* including a plurality of terminals 128*a*, and the terminal group 29*a* including a plurality of terminals 129*a*.

Further, FIG. 7 illustrates the medium transport mechanism 5, the maintenance mechanism 6, the print head drive circuit substrate 7, the information output mechanism 9, the terminal group 25*b* provided in the medium transport mechanism 5, a plurality of terminals 125*b* included in the terminal group 25*b*, the terminal group 26*b* provided in the maintenance mechanism 6, a plurality of terminals 126*b* included in the terminal group 26*b*, the terminal group 28*b* provided on the print head drive circuit substrate 7, a plurality of terminals 128*b* included in the terminal group 28*b*, the terminal group 29*b* provided in the information output mechanism 9, and a plurality of terminals 129*b* included in the terminal group 29*b*.

Here, in a case where it is necessary in the following description to distinguish the plurality of terminals 125*a*, 125*b*, 126*a*, 126*b*, 128*a*, 128*b*, 129*a*, and 129*b* respectively included in the terminal groups 25*a*, 25*b*, 26*a*, 26*b*, 28*a*, 28*b*, 29*a*, and 29*b*, those will be distinguished by the sign of the signal that propagates at the terminal to be distinguished being added with "-" to the end of the terminal. Specifically, in the following description, a terminal β, which is one of a plurality of the terminals β included in a terminal group α and at which a signal γ is propagated, will be referred to as a terminal β-γ.

Commercial power is input to the power supply circuit 84. Then, the power supply circuit 84 converts the input commercial power into a voltage VHV, which is a direct current voltage of 42 V or the like, and outputs the voltage VHV. The voltage VHV output from the power supply circuit 84 is input to the voltage detection circuit 85 and is also used as the power supply voltage of each configuration of the liquid ejecting apparatus 1. Here, in each configuration of the liquid ejecting apparatus 1, the voltage VHV may be used as it is as the power supply voltage and a drive voltage and a voltage signal converted into various voltage values such as 3.3 V, 5 V, and 7.5 V by a voltage conversion circuit (not illustrated) may be used as the power supply voltage and the drive voltage.

The voltage detection circuit 85 detects, based on the voltage value of the voltage VHV, whether or not the power supply voltage of commercial power or the like is supplied in the liquid ejecting apparatus 1. Then, the voltage detection circuit 85 generates a voltage detection signal VDET having a logic level corresponding to the result of the detection and outputs the voltage detection signal VDET to the time measurement circuit 83. For example, the voltage detection circuit 85 outputs the H-level voltage detection signal VDET to the time measurement circuit 83 in a case where the voltage value of the voltage VHV exceeds a predetermined value and outputs the L-level voltage detection signal VDET to the time measurement circuit 83 in a case where the voltage value of the voltage VHV is equal to or lower than the predetermined value. It should be noted that the voltage detection circuit 85 may be configured to output the H-level voltage detection signal VDET in a case where the power supply voltage is supplied in the liquid ejecting apparatus 1. Accordingly, the voltage detection circuit 85 may change the logic level of the voltage detection signal VDET based on a voltage value different from the voltage VHV and may change the logic level of the voltage detection signal VDET based on whether or not commercial power is supplied in the liquid ejecting apparatus 1.

The time measurement circuit 83 determines, based on the voltage detection signal VDET, whether or not the power supply voltage is supplied in the liquid ejecting apparatus 1. Then, in a case where the time measurement circuit 83 determines based on the voltage detection signal VDET that the power supply voltage is supplied in the liquid ejecting apparatus 1, the time measurement circuit 83 generates elapsed time information YMD and outputs the elapsed time information YMD to the liquid ejecting apparatus control circuit 81.

The liquid ejecting apparatus control circuit 81 generates various signals for controlling the operation of the liquid ejecting apparatus 1 and outputs the signals to the corresponding configurations included in the liquid ejecting apparatus 1.

A specific example of the signal that is generated and output by the liquid ejecting apparatus control circuit 81 will be described. The liquid ejecting apparatus control circuit 81 generates a control signal CTRL1 for controlling the operation of the medium transport mechanism 5 and outputs the control signal CTRL1 from the terminal 125*a*-CTRL1 included in the terminal group 25*a*. Then, the control signal CTRL1 propagates through the cable 15 and is input to the medium transport mechanism 5 via the terminal 125*b*-CTRL1 included in the terminal group 25*b*.

The medium transport mechanism 5 includes the first transport means 5*a* and the second transport means 5*b* described above. The drive motor 53*a* included in the first transport means 5*a* and the drive motor 53*b* included in the second transport means 5*b* are controlled by the control signal CTRL1. In other words, the control signal CTRL1 is a signal for controlling the driving of the drive motor 53*a* included in the first transport means 5*a* and the drive motor 53*b* included in the second transport means 5*b*. It should be noted that the medium transport mechanism 5 may include a driver circuit (not illustrated) for converting the control signal CTRL1 into a signal for driving the drive motors 53*a* and 53*b*.

Here, each of the number of the terminals 125*a* included in the terminal 125*a*-CTRL1 and the number of the terminals 125*b* included in the terminal 125*b*-CTRL1 is not limited to one. For example, the terminal 125*a*-CTRL1 includes at least one terminal 125*a* and the terminal 125*b*-CTRL1 includes at least one terminal 125*b* in a case where the control signal CTRL1 is a single-ended signal and the terminal 125*a*-CTRL1 includes at least two terminals 125*a* and the terminal 125*b*-CTRL1 includes at least two terminals 125*b* in a case where the control signal CTRL1 is a differential signal.

In addition, the medium transport mechanism 5 includes a medium transport error detection circuit 58 that detects a transport error of the medium P. The medium transport error detection circuit 58 detects whether or not a transport error has occurred in the medium P transported to the print head 3. Examples of the transport error include a so-called jam in which the medium P cannot be normally supplied or discharged as the medium P is caught in the liquid ejecting apparatus 1 in a case where the medium P transported in the liquid ejecting apparatus 1 is broken or wrinkled. Further, in a case where a transport error such as the jam has occurred in the medium transport mechanism 5, the medium transport error detection circuit 58 generates a medium transport error signal ERR1 indicating that the transport error has occurred and outputs the medium transport error signal ERR1 from the terminal 125*b*-ERR1 included in the terminal group 25*b*. Then, the medium transport error signal ERR1 propagates through the cable 15 and is input to the liquid ejecting apparatus control circuit 81 via the terminal 125*a*-ERR1 included in the terminal group 25*a*. Here, the number of the terminals 125*a* included in the terminal 125*a*-EER1 and the number of the terminals 125*b* included in the terminal

125*b*-ERR1 are not limited to one for the same reason as the terminal 125*a*-CTRL1 and the terminal 125*b*-CTRL1.

In addition, the liquid ejecting apparatus control circuit 81 generates a control signal CTRL2 for controlling the operation of the maintenance mechanism 6 and outputs the control signal CTRL2 from the terminal 126*a*-CTRL2 included in the terminal group 26*a*. Then, the control signal CTRL2 propagates through the cable 16 and is input to the maintenance mechanism 6 via the terminal 126*b*-CTRL2 included in the terminal group 26*b*.

The maintenance mechanism 6 includes a wiping mechanism 61, a flushing mechanism 62, and a capping mechanism 63. The wiping mechanism 61 executes wiping processing of wiping the nozzle surface 652 in order to remove a paper piece or the like attached to the nozzle surface 652 of the print head 3. The flushing mechanism 62 executes flushing processing of ejecting the ink stored in the print head 3 from the nozzle 651 in order to maintain the viscosity of the ink stored in the print head 3 in an appropriate range or in order to recover an appropriate ink viscosity in a case where the viscosity of the ink stored in the print head 3 is abnormal. The capping mechanism 63 executes capping processing of attaching a cap to the nozzle 651 and the nozzle surface 652 where the nozzle 651 is formed in order to reduce the possibility of a change in the characteristics of the ink stored in the print head 3 in a case where no ink is ejected from the print head 3 for a long period, examples of which include a case where the liquid ejecting apparatus 1 is not used for a long period. Here, the number of the terminals 126*a* included in the terminal 126*a*-CTRL2 and the number of the terminals 126*b* included in the terminal 126*b*-CTRL2 are not limited to one for the same reason as the terminal 125*a*-CTRL1 and the terminal 125*b*-CTRL1.

It should be noted that the maintenance mechanism 6 may include a configuration for executing various types of processing so that the ejecting portion 600 of the print head 3 is kept in a normal state or the ejecting portion 600 is recovered to the normal state in addition to the wiping mechanism 61, the flushing mechanism 62, and the capping mechanism 63 described above.

In addition, the liquid ejecting apparatus control circuit 81 generates a control signal CTRL3 for controlling the operation of the information output mechanism 9 and outputs the control signal CTRL3 from the terminal 129*a*-CTRL3 included in the terminal group 29*a*. Then, the control signal CTRL3 propagates through the cable 19 and is input to the information output mechanism 9 via the terminal 129*b*-CTRL3 included in the terminal group 29*b*. The information output mechanism 9 has a display 91. The display 91 displays various types of information, such as information indicating the operation state of the liquid ejecting apparatus 1, information indicating the operation state of the maintenance mechanism 6, information regarding the use history of the print head 3, and warning information, in accordance with the control signal CTRL3. It should be noted that the information output mechanism 9 may be a configuration capable of notifying a user of various types of information and may be a configuration notifying a user of information by voice, light, or the like. Here, the number of the terminals 129*a* included in the terminal 129*a*-CTRL3 and the number of the terminals 129*b* included in the terminal 129*b*-CTRL3 are not limited to one for the same reason as the terminal 125*a*-CTRL1 and the terminal 125*b*-CTRL1.

In addition, the liquid ejecting apparatus control circuit 81 generates an RGB signal IRGB based on an image data signal IMG input from an external device such as the host computer provided outside the liquid ejecting apparatus 1 and outputs the RGB signal IRGB to the signal conversion circuit 82. The RGB signal IRGB includes information on the red, green, and blue included in image data corresponding to the input image data signal IMG. Further, the signal conversion circuit 82 converts the input RGB signal IRGB into an image signal ICMY corresponding to the ink color used in the liquid ejecting apparatus 1 and outputs the image signal ICMY from the terminal 128*a*-ICMY included in the terminal group 28*a*. Then, the image signal ICMY propagates through the cable 18 and is input to the print head drive circuit substrate 7 via the terminal 128*b*-ICMY included in the terminal group 28*b*.

It should be noted that the signal conversion circuit 82 may output a signal subjected to signal processing such as halftone processing from the terminal 128*a*-ICMY as the image signal ICMY after converting the signal generated based on the RGB signal IRGB input from the liquid ejecting apparatus control circuit 81 into a signal corresponding to the ink color used in the liquid ejecting apparatus 1 and may perform halftone processing and then output a signal converted into a signal corresponding to a plurality of the ejecting portions 600 of the print head 3 from the terminal 128*a*-ICMY as the image signal ICMY.

In addition, the signal conversion circuit 82 may convert the image signal ICMY into a pair of differential signals and then output the differential signals from the terminal 128*a*-ICMY to the print head drive circuit substrate and may convert the image signal ICMY into an optical signal or the like and then output the optical signal or the like from the terminal 128*a*-ICMY to the print head drive circuit substrate 7. In this case, the number of the terminals 128*a* included in the terminal 128*a*-ICMY and the number of the terminals 128*b* included in the terminal 128*b*-ICMY are not limited to two for the same reason as the terminal 125*a*-CTRL1 and the terminal 125*b*-CTRL1. It should be noted that the main circuit substrate 8 in a case where the signal conversion circuit 82 converts the image signal ICMY into the differential signal, the optical signal, and the like and outputs the signals to the print head drive circuit substrate 7 has a conversion circuit for converting the signals and the print head drive circuit substrate 7 to which the image signal ICMY is input has a restoration circuit for restoring the signal converted into the differential signal, the optical signal, and the like in that case.

In addition, the liquid ejecting apparatus control circuit 81 outputs various types of information on the liquid ejecting apparatus 1, which include transport information on the medium P transported by the medium transport mechanism 5, transport error information based on the medium transport error signal ERR1 input from the medium transport mechanism 5, execution information on the maintenance executed by the maintenance mechanism 6, and operation time information based on the elapsed time information YMD indicating the operation time of the liquid ejecting apparatus 1, from the terminal 128*a*-IPD included in the terminal group 28*a* as a liquid ejecting apparatus operation information signal IPD. The liquid ejecting apparatus operation information signal IPD propagates through the cable 18 and is input to the print head drive circuit substrate 7 via the terminal 128*b*-ICMY included in the terminal group 28*b*. In this case, the number of the terminals 128*a* included in the terminal 128*a*-ICMY and the number of the terminals 128*b* included in the terminal 128*b*-ICMY are not limited to one for the same reason as terminal 125*a*-CTRL1 and the terminal 125*b*-CTRL1.

In addition, a print head operation information signal IHD including the drive situation of the print head 3 is input from the print head drive circuit substrate 7 to the liquid ejecting apparatus control circuit 81 via the terminal 128*b*-IHD included in the terminal group 28*b*, the cable 18, and the terminal 128*a*-IHD included in the terminal group 28*a*. The liquid ejecting apparatus control circuit 81 generates the control signals CTRL1, CTRL2, and CTRL3 for respectively controlling the medium transport mechanism 5, the maintenance mechanism 6, and the information output mechanism 9 based on the input print head operation information signal IHD and outputs the control signals CTRL1, CTRL2, and CTRL3.

It should be noted that the main circuit substrate 8 is not limited to being constituted by one substrate and may be constituted by a plurality of substrates. Specifically, at least some of the plurality of circuits mounted on the main circuit substrate 8 including the liquid ejecting apparatus control circuit 81, the signal conversion circuit 82, the time measurement circuit 83, the power supply circuit 84, and the voltage detection circuit 85 included in the main circuit substrate 8 may be mounted on different substrates and electrically coupled by a connector (not illustrated), a cable (not illustrated), or the like in an alternative configuration.

1.3.2 Functional Configuration of Print Head Drive Circuit Substrate

Figure 8:
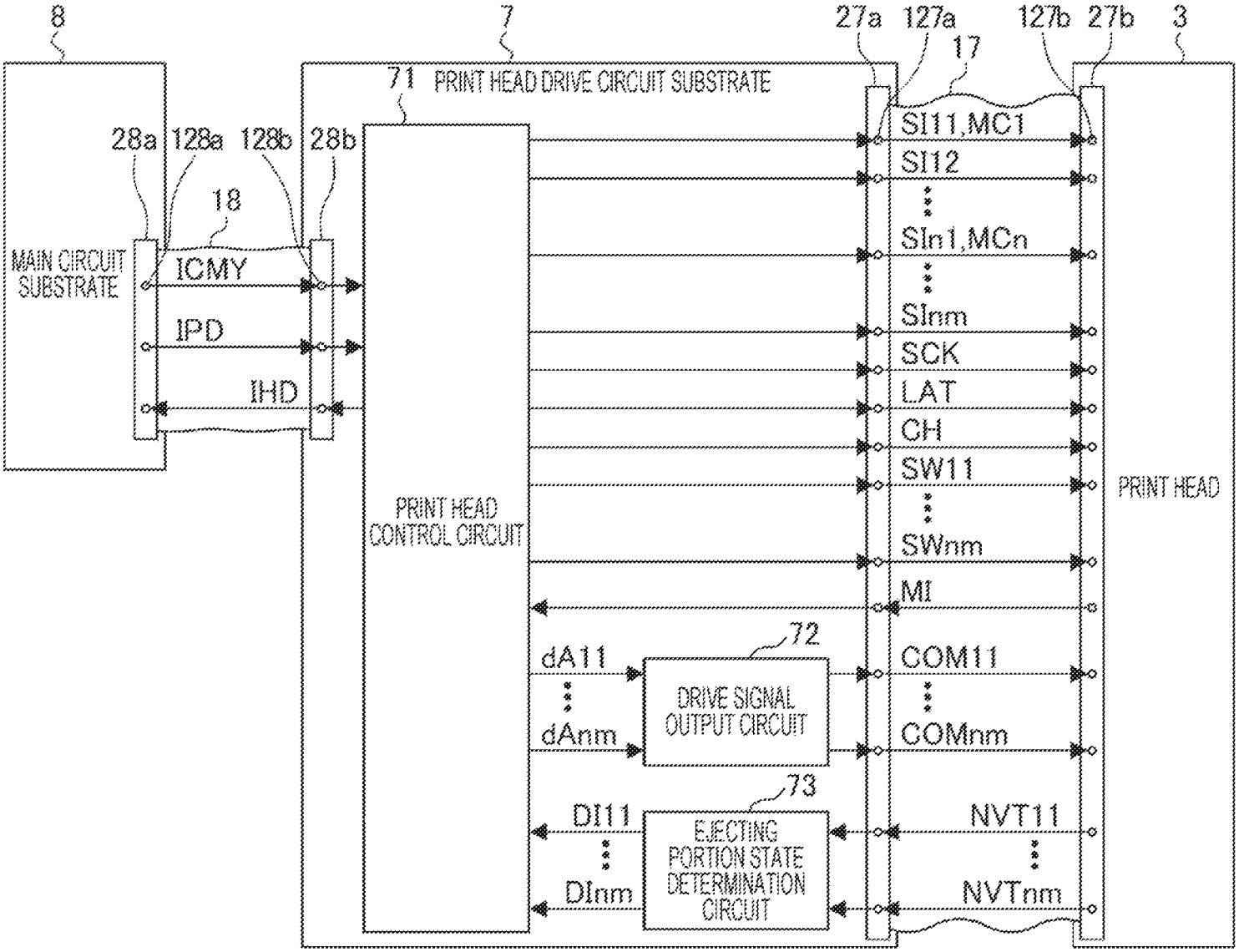
FIG. 8 is a diagram for describing details of a print head drive circuit substrate.

FIG. 8 is a diagram for describing details of the print head drive circuit substrate 7. As illustrated in FIG. 8, the print head drive circuit substrate 7 has a print head control circuit 71, a drive signal output circuit 72, and an ejecting portion state determination circuit 73. In addition, the print head drive circuit substrate 7 is provided with the terminal group 27*a* including a plurality of terminals 127*a*. Further, the print head drive circuit substrate 7 generates, based on the image signal ICMY input via the terminal 128*b*-ICMY, drive signals COM11 to COMnm for driving the plurality of piezoelectric elements 60 of the print head 3 and a clock signal SCK, a latch signal LAT, a change signal CH, switching signals SW11 to SWnm, and printing data signals SI11 to SInm for controlling timings at which the drive signals COM11 to COMnm are supplied to the piezoelectric element 60.

In addition, FIG. 8 illustrates the print head 3, the terminal group 27*b* provided in the print head 3, and a plurality of terminals 127*b* included in the terminal group 27*b*. Here, in a case where it is necessary in the following description to distinguish the plurality of terminals 127*b* included in the terminal group 27*b*, those will be distinguished by the sign of the signal that propagates at the terminal to be distinguished being added with "-" to the end of the terminal. Specifically, in the following description, a terminal β, which is one of a plurality of the terminals β included in a terminal group α and at which a signal γ is propagated, will be referred to as a terminal β-γ.

In addition, in the following description, the printing data signals SI11 to SInm may be simply referred to as a printing data signal SI in a case where it is not necessary to particularly distinguish the printing data signals SI11 to SInm, the switching signals SW11 to SWnm may be simply referred to as a switching signal SW in a case where it is not necessary to particularly distinguish the switching signals SW11 to SWnm, the drive signals COM11 to COMnm may be simply referred to as a drive signal COM in a case where it is not necessary to particularly distinguish the drive signals COM11 to COMnm, and drive data signals dA11 to dAnm may be simply referred to as a drive data signal dA in a case where it is not necessary to particularly distinguish the drive data signals dA11 to dAnm respectively corresponding to the drive signals COM11 to COMnm.

The image signal ICMY is input to the print head control circuit 71 via the terminal 128*b*-ICMY. Then, the print head control circuit 71 generates, based on the image signal ICMY, the clock signal SCK, the latch signal LAT, the change signal CH, the switching signals SW11 to SWnm, and the printing data signals SI11 to SInm corresponding to the ejecting portion 600 and the plurality of head chips 310 of the print head 3.

Then, the printing data signals SI11 to SInm generated by the print head control circuit 71 are output from the terminals 127*a*-SI11 to 127*a*-SInm included in the terminal group 27*a*, propagated through the cable 17, and input to the print head 3 via the terminals 127*b*-SI11 to 127*b*-SInm, the clock signal SCK is output from the terminal 127*a*-SCK included in the terminal group 27*a*, propagated through the cable 17, and input to the print head 3 via the terminal 127*b*-SCK, the latch signal LAT is output from the terminal 127*a*-LAT included in the terminal group 27*a*, propagated through the cable 17, and input to the print head 3 via the terminal 127*b*-LAT, the change signal CH is output from the terminal 127*a*-CH included in the terminal group 27*a*, propagated through the cable 17, and input to the print head 3 via the terminal 127*b*-CH, and the switching signals SW11 to SWnm are output from the terminals 127*a*-SW11 to 127*a*-SWnm included in the terminal group 27*a*, propagated through the cable 17, and input to the print head 3 via the terminals 127*b*-SW11 to 127*b*-SWnm.

Here, the printing data signal SI11 corresponds to the printing data signal SI input to the head chip 310-1 included in the head main body 31-1 and the printing data signal SInm corresponds to the printing data signal SI input to the head chip 310-*m* included in the head main body 31-*n*. Likewise, the switching signal SW11 corresponds to the switching signal SW input to the head chip 310-1 included in the head main body 31-1 and the switching signal SWnm corresponds to the switching signal SW input to the head chip 310-*m* included in the head main body 31-*n*.

In other words, the print head control circuit 71 generates and outputs the printing data signal SI and the switching signal SW corresponding to each of a total of n×m head chips 310 included in the print head 3.

In addition, the print head control circuit 71 generates the drive data signals dA11 to dAnm that define the waveforms of the drive signals COM11 to COMnm for driving the piezoelectric element 60 and outputs the drive data signals dA11 to dAnm to the drive signal output circuit 72.

The drive signal output circuit 72 performs digital-analog signal conversion on each of the input drive data signals dA11 to dAnm and then generates the drive signals COM11 to COMnm by performing class-D amplification on the converted analog signals based on the voltage VHV. In other words, the drive data signals dA11 to dAnm are digital signals respectively defining the waveforms of the drive signals COM11 to COMnm and the drive signal output circuit 72 generates the drive signals COM11 to COMnm, which have maximum voltage values sufficient to drive the corresponding ejecting portions 600 and change in voltage value, by performing class-D amplification on the waveforms respectively defined by the drive data signals dA11 to dAnm based on the voltage VHV. Then, the drive signals COM11 to COMnm are output from the terminals 127*a*-COM11 to 127*a*-COMnm included in the terminal group 27*a*, propagated through the cable 17, and input to the print head 3 via the terminals 127*b*-COM11 to 127*b*-COMnm.

As described above, the drive signal output circuit has a total of n×m class-D amplifier circuits that generate the drive signals COM11 to COMnm. Here, the drive data signals dA11 to dAnm may be signals capable of respectively defining the waveforms of the drive signals COM11 to COMnm and may be, for example, analog signals. In addition, the drive signal output circuit 72 may be capable of amplifying the waveforms respectively defined by the drive data signals dA11 to dAnm and may be configured to include, for example, a class-A amplifier circuit, a class-B amplifier circuit, or a class-AB amplifier circuit.

Here, the drive signal COM11 corresponds to the drive signal COM input to the head chip 310-1 included in the head main body 31-1 and the drive signal COMnm corresponds to the drive signal COM input to the head chip 310-*m* included in the head main body 31-*n*. Further, the drive data signal dA11 is a digital signal that defines the waveform of the drive signal COM11 and the drive data signal dAnm is a digital signal that defines the waveform of the drive signal COMnm.

In addition, ejecting portion state signals DI11 to DInm indicating the state of the ejecting portion 600 included in the print head 3 are input from the ejecting portion state determination circuit 73 to the print head control circuit 71. In addition, residual vibration signals NVT11 to NVTnm corresponding to the residual vibration generated in the ejecting portion 600 included in the print head 3 are input to the ejecting portion state determination circuit 73 via the terminals 127*b*-NVT11 to 127*b*-NVTnm included in the terminal group 27*b*, the cable 17, and the terminals 127*a*-NVT11 to 127*a*-NVTnm included in the terminal group 27*a*.

The ejecting portion state determination circuit 73 generates the ejecting portion state signals DI11 to DInm indicating the state of the corresponding ejecting portion 600 based on the input residual vibration signals NVT11 to NVTnm and outputs the ejecting portion state signals DI11 to DInm to the print head control circuit 71. Then, the print head control circuit 71 determines, based on the input ejecting portion state signals DI11 to DInm, whether or not to cause the maintenance mechanism 6 to execute the wiping processing, the flushing processing, or the like, generates the print head operation information signal IHD indicating the result of the determination, and outputs the print head operation information signal IHD to the liquid ejecting apparatus control circuit 81 via the terminal 128*b*-IHD, the cable 18, and the terminal 128*a*-IHD.

Here, in the following description, the residual vibration signals NVT11 to NVTnm may be simply referred to as a residual vibration signal NVT in a case where it is not necessary to particularly distinguish the residual vibration signals NVT11 to NVTnm and the ejecting portion state signals DI11 to DInm may be simply referred to as an ejecting portion state signal DI in a case where it is not necessary to particularly distinguish the ejecting portion state signals DI11 to DInm. In addition, the residual vibration signal NVT11 corresponds to the residual vibration signal NVT corresponding to the ejecting portion 600 included in the head chip 310-1 of the head main body 31-1 and the residual vibration signal NVTnm corresponds to the residual vibration signal NVT corresponding to the ejecting portion 600 included in the head chip 310-*m* of the head main body 31-*n*. Further, the ejecting portion state signal DI11 indicates the state of the ejecting portion 600 corresponding to the residual vibration signal NVT11 and the ejecting portion state signal DInm indicates the state of the ejecting portion 600 corresponding to the residual vibration signal NVTnm.

In addition, the print head control circuit 71 outputs memory control signals MC1 to MCn for controlling a memory 200 (described later) included in the branch wiring substrate 335. Here, examples of the control of the memory 200 include reading processing in which the memory 200 reads information stored in the memory 200 and writing processing in which the memory 200 writes information into the memory 200.

In addition, in a case where the print head control circuit 71 has output the memory control signals MC1 to MCn for reading the information stored in the memory 200, a storage data signal MI corresponding to the information read from the memory 200 in accordance with the memory control signals MC1 to MCn is input to the print head control circuit 71. Here, the memory control signal MC1 is a signal for controlling the memory 200 in order to cause the memory 200 to read or write information corresponding to the head main body 31-1 and the memory control signal MCn is a signal for controlling the memory 200 in order to cause the memory 200 to read or write information corresponding to the head main body 31-*n*.

In the liquid ejecting apparatus 1 according to the present embodiment, the memory control signal MC1 output from the print head control circuit 71 propagates through wiring common with the printing data signal SI11 and is input to the print head 3 and the memory control signal MCn output from the print head control circuit 71 propagates through wiring common with the printing data signal SIn1 and is input to the print head 3. In other words, the reading processing for reading the information stored in the memory 200 and corresponding to the head main body 31-1 is controlled via the terminal and the wiring where the printing data signal SI11 propagates and the reading processing for reading the information stored in the memory 200 and corresponding to the head main body 31-*n* is performed via the terminal and the wiring where the printing data signal SIn1 propagates.

Accordingly, the print head control circuit 71 outputs the memory control signal MC1 for executing the processing of reading the information stored in the memory 200 at a timing when the printing data signal SI11 is not output and outputs the memory control signal MCn for executing the processing of reading the information stored in the memory 200 at a timing when the printing data signal SIn1 is not output. As a result, it is not necessary to newly provide wiring and a terminal for controlling the memory 200 and it is possible to reduce the number of wires of the cable 17 included in the liquid ejecting apparatus 1 and the number of terminals included in the terminal group. It should be noted that the plurality of terminals β included in the terminal group α where both the printing data signal SI11 and the memory control signal MC1 are output may be referred to as a terminal β-SI11_MC1 and, similarly, the plurality of terminals β included in the terminal group α where both the printing data signal SIij (i being one of 1 to n and j being one of 1 to m) and the memory control signal MCi are output may be referred to as a terminal β-SIij_MCi in the following description.

It should be noted that the print head drive circuit substrate 7 is not limited to being constituted by one substrate and may be constituted by a plurality of substrates. Specifically, at least some of the plurality of circuits mounted on the print head drive circuit substrate 7 including the print head control circuit 71, the drive signal output circuit 72, and the ejecting portion state determination circuit 73 included in the print head drive circuit substrate 7 may be mounted on different substrates and electrically coupled by a connector (not illustrated), a cable (not illustrated), or the like in an alternative configuration.

1.3.3 Functional Configuration of Print Head

Returning to FIG. 6, the functional configuration of the print head 3 will be described below. As illustrated in FIG. 6, the print head 3 has the branch wiring substrate 335 and the n head main bodies 31. Further, a terminal group 337 provided in each of the n head main bodies 31 and each terminal group 368 provided on the branch wiring substrate 335 so as to correspond to the terminal group 337 are electrically coupled by the cable 366. In other words, each of the n head main bodies 31 is electrically coupled to the branch wiring substrate 335.

Figure 9:
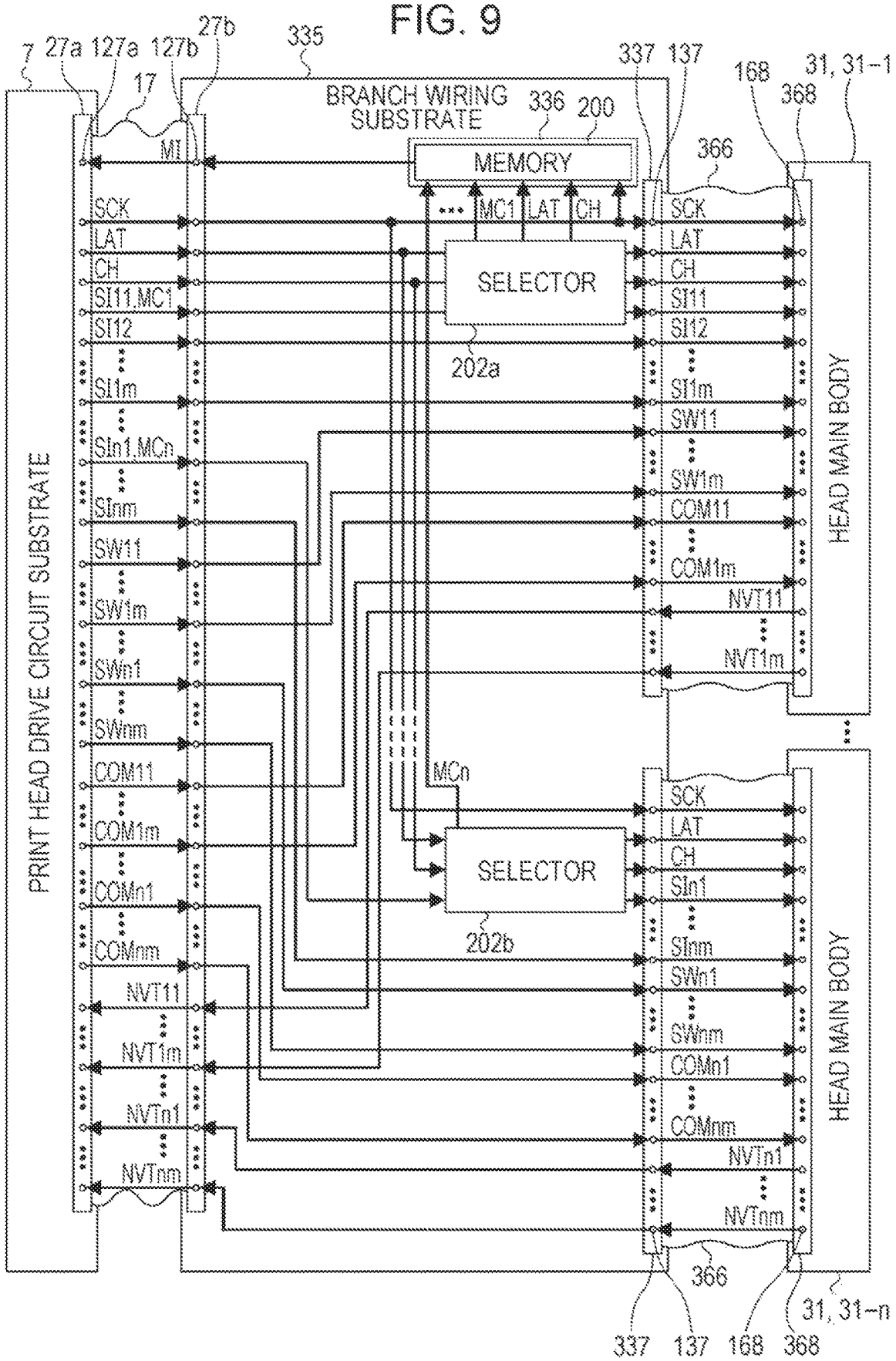
FIG. 9 is a diagram for describing details of a branch wiring substrate.

In addition, FIG. 9 illustrates a plurality of terminals 137 included in the terminal group 337 and a plurality of terminals 168 included in the terminal group 368. In a case where it is necessary in the following description to distinguish each of the plurality of terminals 137 included in the terminal group 337 and in a case where each of the plurality of terminals 168 included in the terminal group 368 are distinguished in the following description, the sign of the signal propagating at the terminal that is distinguished is added with "-" to the end of the terminal. Specifically, in the following description, a terminal β, which is one of a plurality of the terminals β included in a terminal group α and at which a signal γ is propagated, will be referred to as a terminal β-γ.

First, the functional configuration of the branch wiring substrate 335 will be described with reference to FIG. 9. FIG. 9 is a diagram for describing details of the branch wiring substrate 335. The drive signals COM11 to COMnm, the printing data signals SI11 to SInm, the clock signal SCK, the latch signal LAT, the change signal CH, and the switching signals SW11 to SWnm are input from the print head drive circuit substrate 7 to the branch wiring substrate 335 via the plurality of terminals 127*b* included in the terminal group 27*a*, the cable 17, and the plurality of terminals 127*b* included in the terminal group 27*b*. Then, each of the drive signals COM11 to COMnm, the printing data signals SI11 to SInm, the clock signal SCK, the latch signal LAT, the change signal CH, and the switching signals SW11 to SWnm propagates through the branch wiring substrate 335 and then is input to the corresponding head main body 31.

Specifically, the branch wiring substrate 335 propagates the printing data signals SI11 to SI1*m*, the clock signal SCK, the latch signal LAT, the change signal CH, the switching signals SW11 to SW1*m*, and the drive signals COM11 to COM1*m* corresponding to the head main body 31-1 to the terminal group 337 corresponding to the head main body 31-1. Likewise, the branch wiring substrate 335 propagates the printing data signals SIn1 to SInm, the clock signal SCK, the latch signal LAT, the change signal CH, the switching signals SWn1 to SWnm, and the drive signals COMn1 to COMnm corresponding to the head main body 31-*n* to the terminal group 337 corresponding to the head main body 31-*n*.

Specifically, in the branch wiring substrate 335, the drive signals COM11 to COM1*m* output to the head main body 31-1 respectively propagate to the terminals 137-COM11 to 137-COM1*m* of the terminal group 337 electrically coupled via the cable 366 to the terminal group 368 of the head main body 31-1, the printing data signals SI11 to SI1*m* respectively propagate to the terminals 137-SI11 to 137-SI1*m* of the terminal group 337 electrically coupled via the cable 366 to the terminal group 368 of the head main body 31-1, the clock signal SCK propagates to the terminal 137-SCK of the terminal group 337 electrically coupled via the cable 366 to the terminal group 368 of the head main body 31-1, the latch signal LAT propagates to the terminal 137-LAT of the terminal group 337 electrically coupled via the cable 366 to the terminal group 368 of the head main body 31-1, and the switching signals SW11 to SW1*m* respectively propagate to the terminals 137-SW11 to 137-SW1*m* of the terminal group 337 electrically coupled via the cable 366 to the terminal group 368 of the head main body 31-1.

Likewise, in the branch wiring substrate 335, the drive signals COMn1 to COMnm output to the head main body 31-*n* respectively propagate to the terminals 137-COMn1 to 137-COMnm of the terminal group 337 electrically coupled via the cable 366 to the terminal group 368 of the head main body 31-*n*, the printing data signals SIn1 to SInm respectively propagate to the terminals 137-SIn1 to 137-SInm of the terminal group 337 electrically coupled via the cable 366 to the terminal group 368 of the head main body 31-*n*, the clock signal SCK propagates to the terminal 137-SCK of the terminal group 337 electrically coupled via the cable 366 to the terminal group 368 of the head main body 31-*n*, the latch signal LAT propagates to the terminal 137-LAT of the terminal group 337 electrically coupled via the cable 366 to the terminal group 368 of the head main body 31-*n*, and the switching signals SWn1 to SWnm respectively propagate to the terminals 137-SWn1 to 137-SWnm of the terminal group 337 electrically coupled via the cable 366 to the terminal group 368 of the head main body 31-1.

As described above, the branch wiring substrate 335 performs branching on the signal input via the terminal group 27*b* from the print head drive circuit substrate 7 for each signal corresponding to the head main bodies 31-1 to 31-*n* and then outputs the resultant signals to the head main bodies 31-1 to 31-*n*.

In addition, the branch wiring substrate 335 has the integrated circuit 336 including the memory 200 and selectors 202*a* and 202*b*. In other words, the memory 200 is disposed on the branch wiring substrate 335.

The selector 202*a* is provided so as to correspond to the head main body 31-1. The printing data signal SI11, the memory control signal MC1, the latch signal LAT, and the change signal CH input from the print head drive circuit substrate 7 are input to the selector 202*a*. Then, the selector 202*a* selects, in accordance with the logic levels of the input latch signal LAT and change signal CH, whether to output the printing data signal SI11, the latch signal LAT, and the change signal CH to the head main body 31-1 or to output the memory control signal MC1, the latch signal LAT, and the change signal CH to the memory 200.

Figure 20:
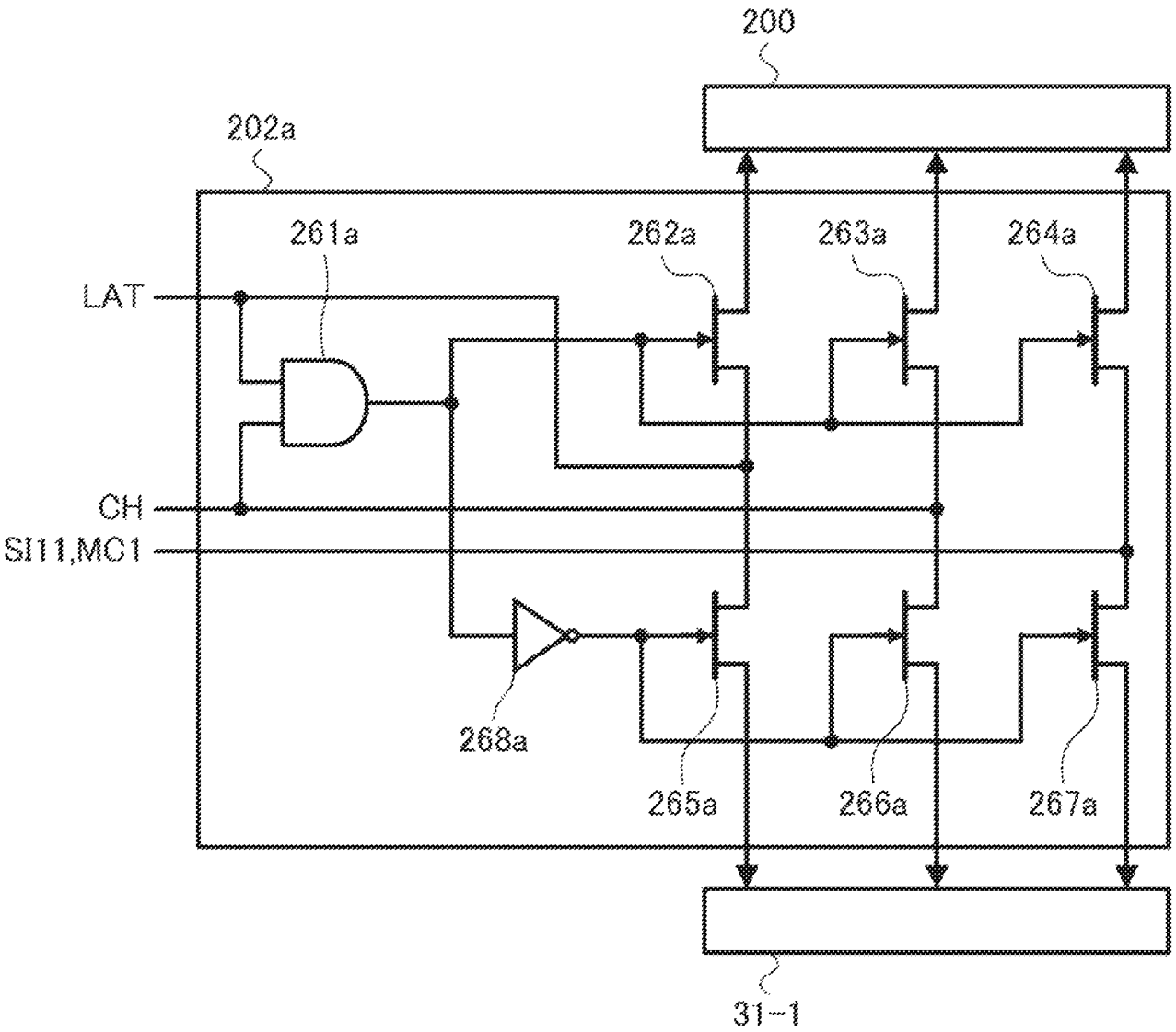
FIG. 20 is a diagram illustrating an example of the configuration of a selector 202*a*.

FIG. 20 is a diagram illustrating an example of the configuration of the selector 202*a*. As illustrated in FIG. 20, the selector 202*a* includes an AND circuit 261*a*, transistors 262*a*, 263*a*, 264*a*, 265*a*, 266*a*, and 267*a*, and a NOT circuit 268*a*. The latch signal LAT and the change signal CH are input to the input end of the AND circuit 261*a*. The output end of the AND circuit 261*a* is coupled to the gate terminals of the transistors 262*a*, 263*a*, and 264*a* and the input end of the NOT circuit 268*a*. Further, the output end of the NOT circuit 268*a* is coupled to the gate terminals of the transistors 265*a*, 266*a*, and 267*a*.

The source terminal of the transistor 262*a* is coupled to the memory 200, and the source terminal of the transistor 265*a* is coupled to the head main body 31-1. Further, the latch signal LAT is input to the drain terminal of the transistor 262*a* and the drain terminal of the transistor 265*a*. In addition, the source terminal of the transistor 263*a* is coupled to the memory 200 and the source terminal of the transistor 266*a* is coupled to the head main body 31-1. Further, the change signal CH is input to the drain terminal of the transistor 263*a* and the drain terminal of the transistor 266*a*. In addition, the source terminal of the transistor 264*a* is coupled to the memory 200 and the source terminal of the transistor 267*a* is coupled to the head main body 31-1. Further, the printing data signal SI11 and the memory control signal MC1 are input to the drain terminal of the transistor 264*a* and the drain terminal of the transistor 267*a*.

In a case where both the latch signal LAT and the change signal CH are H-level signals in the selector 202*a* configured as described above, the transistors 262*a*, 263*a*, and 264*a* are controlled to become conductive and the transistors 265*a*, 266*a*, and 267*a* are controlled to become non-conductive. Accordingly, the printing data signal SI11 or the memory control signal MC1, the latch signal LAT, and the change signal CH are input to the memory 200. In addition, in a case where at least one of the latch signal LAT and the change signal CH is not an H-level signal, the transistors 262*a*, 263*a*, and 264*a* are controlled to become non-conductive and the transistors 265*a*, 266*a*, and 267*a* are controlled to become conductive. Accordingly, the printing data signal SI11 or the memory control signal MC1, the latch signal LAT, and the change signal CH are input to the head main body 31-1.

Returning to FIG. 9, the selector 202*b* is provided so as to correspond to each of the head main bodies 31-2 to 31-*n*. In other words, the branch wiring substrate 335 is provided with n−1 selectors 202*b*. Here, the n−1 selectors 202*b* provided so as to respectively correspond to the head main bodies 31-2 to 31-*n* have the same configuration. Accordingly, the selector 202*b* corresponding to the head main body 31-*n* will be described as an example in the following description and description of the other selectors 202*b* will be omitted.

The printing data signal SIn1, the memory control signal MCn, the latch signal LAT, and the change signal CH input from the print head drive circuit substrate 7 are input to the selector 202*b* corresponding to the head main body 31-*n*. Then, the selector 202*b* switches, in accordance with the logic levels of the latch signal LAT and the change signal CH, between whether to output the printing data signal SIn1, the latch signal LAT, and the change signal CH to the head main body 31-*n* or to output the memory control signal MCn to the memory 200.

Figure 21:
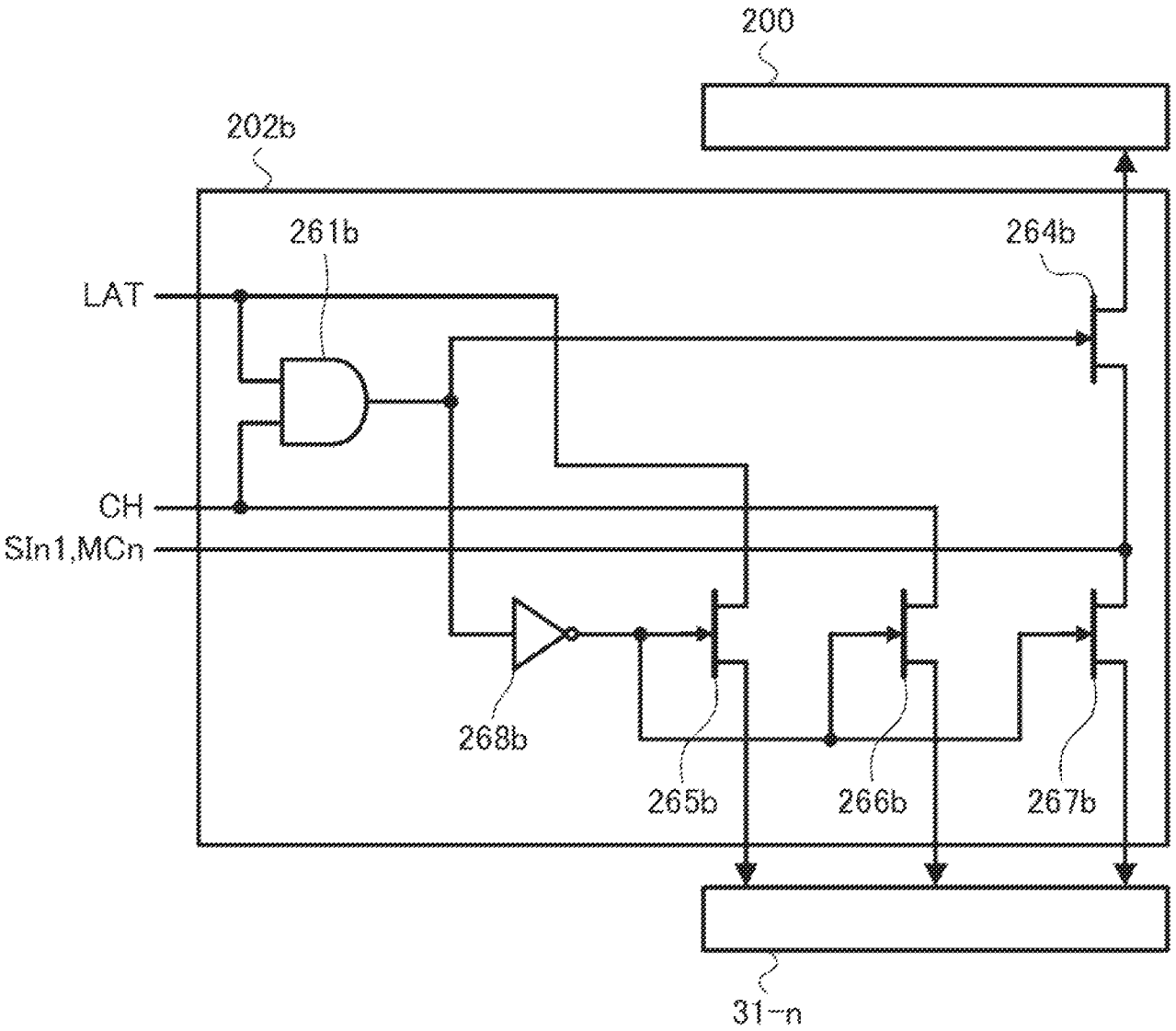
FIG. 21 is a diagram illustrating an example of the configuration of a selector 202*b*.

FIG. 21 is a diagram illustrating an example of the configuration of the selector 202*b*. As illustrated in FIG. 21, the selector 202*b* includes an AND circuit 261*b*, transistors 264*b*, 265*b*, 266*b*, and 267*b*, and a NOT circuit 268*b*. The latch signal LAT and the change signal CH are input to the input end of the AND circuit 261*b*. The output end of the AND circuit 261*b* is coupled to the gate terminal of the transistor 264*b* and the input end of the NOT circuit 268*b*. Further, the output end of the NOT circuit 268*b* is coupled to the gate terminals of the transistors 265*b*, 266*b*, and 267*b*.

The source terminal of the transistor 265*b* is coupled to the head main body 31-*n*, and the latch signal LAT is input to the drain terminal of the transistor 265*b*. In addition, the source terminal of the transistor 266*b* is coupled to the head main body 31-*n* and the change signal CH is input to the drain terminal of the transistor 266*b*. In addition, the source terminal of the transistor 264*b* is coupled to the memory 200 and the source terminal of the transistor 267*b* is coupled to the head main body 31-*n*. Further, the printing data signal SIn1 and the memory control signal MCn are input to the drain terminal of the transistor 264*b* and the drain terminal of the transistor 267*b*.

In a case where both the latch signal LAT and the change signal CH are H-level signals in the selector 202*b* configured as described above, the transistor 264*b* is controlled to become conductive and the transistors 265*b*, 266*b*, and 267*b* are controlled to become non-conductive. Accordingly, the printing data signal SIn1 or the memory control signal MCn is input to the memory 200. In addition, in a case where at least one of the latch signal LAT and the change signal CH is not an H-level signal, the transistor 264*b* is controlled to become non-conductive and the transistors 265*b*, 266*b*, and 267*b* are controlled to become conductive. Accordingly, the printing data signal SIn1 or the memory control signal MCn, the latch signal LAT, and the change signal CH are input to the head main body 31-*n*.

The memory 200 stores information indicating the operation state of the print head 3 and threshold information for determining whether or not to update the information. It should be noted that the information indicating the operation state of the print head 3 and the threshold for determining whether or not to update the information, which are stored in the memory 200, may be referred to as ejecting portion-related information in the following description. Here, the memory 200 in the present embodiment is an ultraviolet-erasable non-volatile memory and, specifically, a One Time PROM, an EPROM, or the like is used as the memory 200.

In the ultraviolet-erasable non-volatile memory, it is possible to remove the electric charge that is stored in the gate of a transistor (not illustrated) by irradiating the gate of the transistor included in the memory 200, which is a non-volatile memory, with ultraviolet rays. Here, the ultraviolet rays in the present embodiment may be light having a wavelength at which it is possible to supply sufficient energy in order to remove the electric charge stored in the gate of the transistor (not illustrated) included in the memory 200, which is a non-volatile memory, and the ultraviolet rays are specifically light having a wavelength of less than 400 nm. In other words, the ultraviolet rays in the present embodiment are not limited to long-wavelength, medium-wavelength, and short-wavelength ultraviolet rays and include, for example, X-rays and the like.

Further, the memory 200 is mounted on the integrated circuit 336 illustrated in FIG. 3. Accordingly, the memory 200 is covered with a resinous mold member or the like. In other words, the memory 200 is covered so as not to be irradiated with ultraviolet rays. As a result, the possibility of rewriting of the storage content of the memory 200 attributable to unintended irradiation of the memory 200 with ultraviolet rays is reduced. It should be noted that the material that covers the memory 200 in order to reduce the possibility of irradiation of the memory 200 with ultraviolet rays is not limited to the resinous mold member described above and the material may be a metal material, a photoresist material, a polyimide material, and so on. In other words, the material that covers the memory 200 may be selected from various materials capable of reducing the possibility of irradiation with ultraviolet rays.

The memory 200 configured as described above is controlled by the memory control signals MC1 to MCn, the clock signal SCK, the latch signal LAT, and the change signal CH input via the selectors 202*a* and 202*b*. Specifically, the printing data signals SI11 to SIn1 or the memory control signals MC1 to MCn, the latch signal LAT, and the change signal CH are input from the selectors 202*a* and 202*b* to the memory 200. The memory 200 performs processing in accordance with the memory control signals MC1 to MCn in a case where the logic levels of the latch signal LAT and the change signal CH are in a predetermined state. In the present embodiment, the memory 200 executes the reading processing or the writing processing in accordance with the memory control signals MC1 to MCn in a case where the logic levels of the latch signal LAT and the change signal CH input to the memory 200 are the H level. It should be noted that specifics examples of the processing of reading and writing the information stored in the memory 200 and the information stored in the memory 200 will be described later.

Next, the functional configuration of the head main body 31 electrically coupled to the branch wiring substrate 335 via the terminal group 337, the cable 366, and the terminal group 368 will be described with reference to FIG. 10. Here, the head main bodies 31-1 to **31-*n* of the print head 3 have the same configuration. Accordingly, the head main body 31-1 will be described as an example in the description of FIG. 10 and the head main bodies 31-2 to 31-*n*** will not be described.

Figure 10:
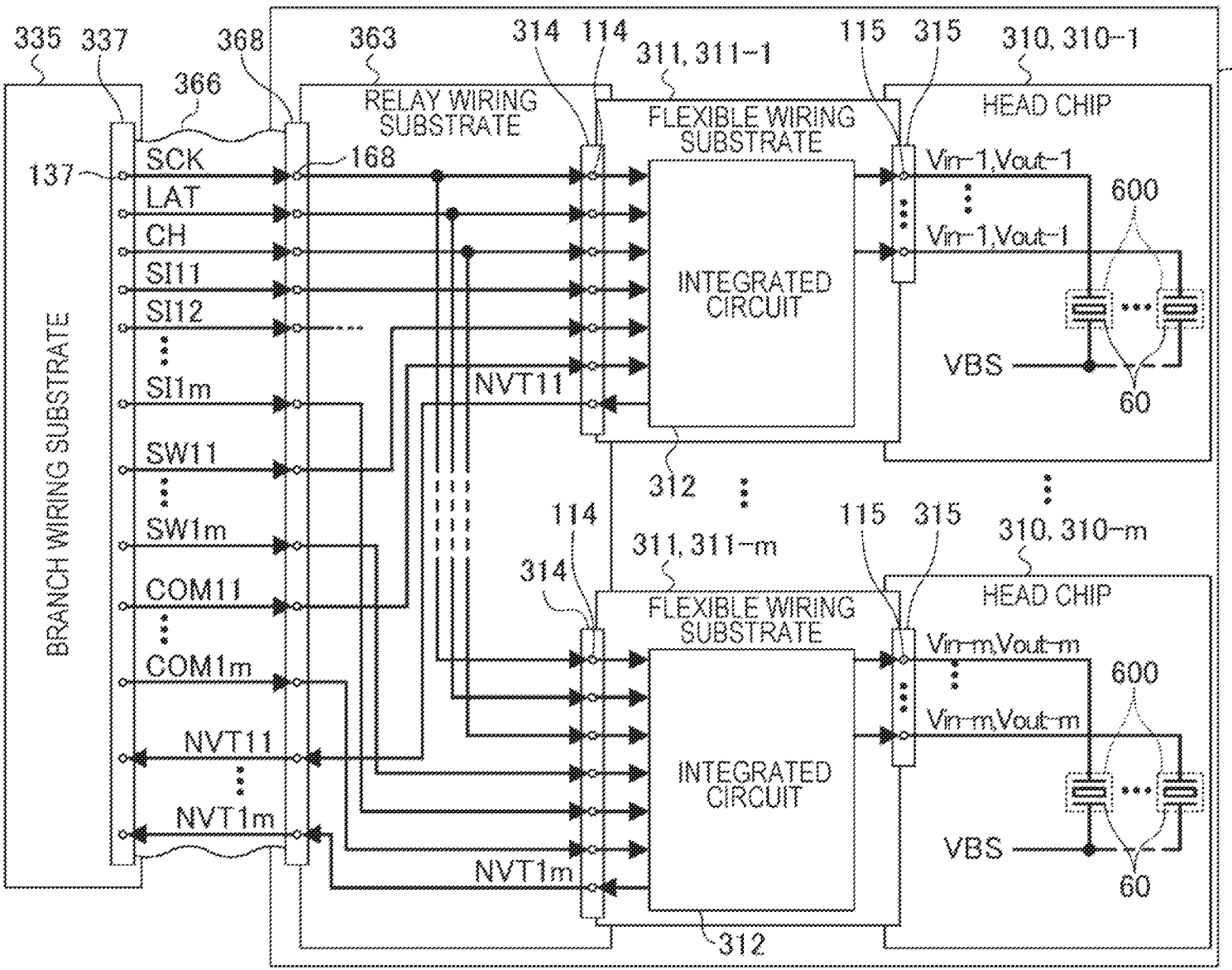
FIG. 10 is a diagram for describing details of the head main body.

FIG. 10 is a diagram for describing details of the head main body 31-1. As illustrated in FIG. 10, the head main body 31-1 has the relay substrate 363, the head chips 310-1 to **310-*m*, and the flexible wiring substrates 311-1 to 311-*m*. Further, the flexible wiring substrates 311-1 to 311-*m* are coupled in common to the relay substrate 363 via a corresponding terminal group 314 and the flexible wiring substrates 311-1 to 311-*m* are electrically and respectively coupled to the head chips 310-1 to 310-*m* via a corresponding terminal group 315. Specifically, the relay substrate 363 and the head chip 310-1 are electrically coupled via the corresponding terminal groups 314 and 315 and the flexible wiring substrate 311-1 and the relay substrate 363 and the head chip 310-*m* are electrically coupled via the corresponding terminal groups 314 and 315 and the flexible wiring substrate 311-*m***.

Each of the drive signals COM11 to COM**1*m*, the printing data signals SI11 to SI1*m*, the clock signal SCK, the latch signal LAT, the change signal CH, and the switching signals SW11 to SW1*m* is input from the branch wiring substrate 335 to the relay substrate 363 via the terminal group 337, the cable 366, and the terminal group 368. Specifically, the corresponding drive signals COM11 to COM1*m* are respectively input to the relay substrate 363 via the terminal 168-COM11 to 168-COM1*m* included in the terminal group 368, the corresponding printing data signals SI11 to SI1*m* are respectively input to the relay substrate 363 via the terminals 168-SI11 to 168-SI1*m* included in the terminal group 368, the clock signal SCK is input to the relay substrate 363 via the terminal 168-SCK included in the terminal group 368, the latch signal LAT is input to the relay substrate 363 via the terminal 168-LAT included in the terminal group 368, the change signal CH is input to the relay substrate 363 via the terminal 168-CH included in the terminal group 368, and the corresponding switching signals SW11 to SW1*m* are respectively input to the relay substrate 363 via the terminals 168-SW11 to 168-SW1*m* included in the terminal group 368**.

Then, each of the drive signals COM11 to COM**1*m*, the printing data signals SI11 to SI1*m*, the clock signal SCK, the latch signal LAT, the change signal CH, and the switching signals SW11 to SW1*m* input to the relay substrate 363 propagates through the relay substrate 363 and then is input to the corresponding flexible wiring substrate 311 via the terminal group 314**.

Specifically, the relay substrate 363 outputs the printing data signal SI11, the clock signal SCK, the latch signal LAT, the change signal CH, the switching signal SW11, and the drive signal COM11 corresponding to the flexible wiring substrate 311-1 and the head chip 310-1 electrically coupled to the flexible wiring substrate 311-1 to the flexible wiring substrate 311-1. Likewise, the relay substrate 363 outputs the printing data signal SI**1*m*, the clock signal SCK, the latch signal LAT, the change signal CH, the switching signal SW1*m*, and the drive signal COM1*m* corresponding to the flexible wiring substrate 311-*m* and the head chip 310-*m* electrically coupled to the flexible wiring substrate 311-*m* to the flexible wiring substrate 311-*m***.

In other words, the relay substrate 363 allows the drive signals COM11 to COM**1*m*, the printing data signals SI11 to SI1*m*, the clock signal SCK, the latch signal LAT, the change signal CH, and the switching signals SW11 to SW1*m* to branch and be relayed between the branch wiring substrate 335 and the m head chips 310**.

Each of the flexible wiring substrates 311-1 to **311-*m* has the integrated circuit 312. In addition, the head chips 310-1 to 310-*m* have the plurality of ejecting portions 600**.

The drive signal COM11, the printing data signal SI11, the clock signal SCK, the latch signal LAT, the change signal CH, and the switching signal SW11 input to the flexible wiring substrate 311-1 are input to the integrated circuit 312 included in the flexible wiring substrate 311-1. Then, the integrated circuit 312 included in the flexible wiring substrate 311-1 generates a drive signal Vin-1 by controlling whether or not to select a signal waveform included in the drive signal COM11 at the timing defined by the printing data signal SI11, the clock signal SCK, the latch signal LAT, and the change signal CH and outputs the drive signal Vin-1 via the terminal group 315 to the electrode 602 of the piezoelectric element 60 included in the ejecting portion 600 included in the head chip 310-1. In addition, a reference voltage signal VBS is supplied to the electrode 603 of the piezoelectric element 60. Accordingly, the piezoelectric element 60 included in the ejecting portion 600 included in the head chip 310-1 is driven in accordance with the potential difference between the drive signal Vin-1 supplied to the electrode 602 and the reference voltage signal VBS supplied to the electrode 603. As a result, ink is ejected from the corresponding ejecting portion 600 by an amount corresponding to the driving of the piezoelectric element 60.

In addition, a residual vibration Vout-1 generated in the ejecting portion 600 driven based on the drive signal Vin-1 is input via the terminal group 315 to the integrated circuit 312 included in the flexible wiring substrate 311-1. The integrated circuit 312 included in the flexible wiring substrate 311-1 generates the residual vibration signal NVT11 based on the input residual vibration Vout-1. The residual vibration signal NVT11 is input to the ejecting portion state determination circuit 73 included in the print head drive circuit substrate 7 via the relay substrate 363 and the branch wiring substrate 335.

Here, the switching signal SW11 input to the flexible wiring substrate 311-1 switches between whether the integrated circuit 312 outputs the drive signal Vin-1 or the residual vibration Vout-1 generated in the corresponding ejecting portion 600 is input to the integrated circuit 312.

Likewise, the drive signal COM**1*m*, the printing data signal SI1*m*, the clock signal SCK, the latch signal LAT, the change signal CH, and the switching signal SW1*m* input to the flexible wiring substrate 311-*m* are input to the integrated circuit 312 included in the flexible wiring substrate 311-*m*. Then, the integrated circuit 312 included in the flexible wiring substrate 311-*m* controls whether or not to select a signal waveform included in the drive signal COM1*m* at the timing defined by the printing data signal SI1*m*, the clock signal SCK, the latch signal LAT, and the change signal CH. As a result, the integrated circuit 312 included in the flexible wiring substrate 311-*m* generates a drive signal Vin-m and outputs the drive signal Vin-m via the terminal group 315 to the electrode 602 of the piezoelectric element 60 included in the ejecting portion 600 included in the head chip 310**-*m*. In addition, a reference voltage signal VBS is supplied to the electrode 603 of the piezoelectric element 60. Accordingly, the piezoelectric element 60 included in the ejecting portion 600 included in the head chip 310-*m* is driven in accordance with the potential difference between the drive signal Vin-m supplied to the electrode 602 and the reference voltage signal VBS supplied to the electrode 603. As a result, ink is ejected from the corresponding ejecting portion 600 by an amount corresponding to the driving of the piezoelectric element 60.

In addition, a residual vibration Vout-m generated in the ejecting portion 600 driven based on the drive signal Vin-m is input via the terminal group 315 to the integrated circuit 312 included in the flexible wiring substrate 311-*m*. The integrated circuit 312 included in the flexible wiring substrate 311-*m* generates the residual vibration signal NVT1*m* based on the input residual vibration Vout-m. The residual vibration signal NVT1*m* is input to the ejecting portion state determination circuit 73 included in the print head drive circuit substrate 7 via the relay substrate 363 and the branch wiring substrate 335.

Here, the switching signal SW1*m* input to the flexible wiring substrate 311-*m* switches between whether the integrated circuit 312 outputs the drive signal Vin-m or the residual vibration Vout-m generated in the corresponding ejecting portion 600 is input to the integrated circuit 312.

Here, the reference voltage signal VBS is a potential signal that serves as a reference for displacement of the piezoelectric element 60 and is, for example, a signal of a ground potential or a potential of DC 5.5 V, DC 6 V, or the like. In addition, the reference voltage signal VBS is generated by, for example, the drive signal output circuit 72 or a voltage generation circuit (not illustrated). In addition, in the following description, the drive signals Vin-1 to Vin-m may be simply referred to as a drive signal Vin in a case where it is not necessary to particularly distinguish the drive signals Vin-1 to Vin-m and the residual vibrations Vout-1 to Vout-m may be simply referred to as a residual vibration Vout in a case where it is not necessary to particularly distinguish the residual vibrations Vout-1 to Vout-m.

Here, the residual vibration Vout generated in the ejecting portion 600 will be described. After ink is ejected from the ejecting portion 600, damped vibration occurs in the diaphragm 621 included in the ejecting portion 600. Specifically, the internal pressure of the pressure generation chamber 12 changes by the ink being ejected from the ejecting portion 600. When the supply of the drive signal Vin to the electrode 602 is subsequently stopped, the damped vibration occurs in the diaphragm 621 in accordance with the change in the internal pressure of the pressure generation chamber 12. Then, the piezoelectric element 60 provided on the diaphragm 621 is displaced in accordance with the damped vibration as a result of the damped vibration of the diaphragm 621. As a result, a signal corresponding to the damped vibration is output from the piezoelectric element 60. The residual vibration Vout is the signal that is output from the piezoelectric element 60 based on the damped vibration resulting from the change in the internal pressure of the pressure generation chamber 12.

At least one of the cycle and the vibration frequency of the residual vibration Vout described above varies with the state of the ejecting portion 600, examples of which include a case where the ejecting portion 600 is normal, a case where the viscosity of the ink ejected from the ejecting portion 600 is abnormal, a case where air bubbles are mixed in the pressure generation chamber 12 of the ejecting portion 600, and a case where paper dust or the like adheres to the vicinity of the nozzle 651 of the ejecting portion 600. In other words, the ejecting portion state determination circuit 73 included in the print head drive circuit substrate 7 determines the cycle and the vibration frequency of the corresponding residual vibration Vout based on the residual vibration signals NVT11 to NVTnm, generates the ejecting portion state signals DI11 to DInm indicating the state of the corresponding ejecting portion 600 based on the result of the determination, and outputs the ejecting portion state signals DI11 to DInm to the print head control circuit 71.

1.3.4 Functional Configuration of Drive Signal Line Selection Control Circuit

Here, the configuration of the integrated circuit 312 that outputs the drive signal Vin-1 supplied to the ejecting portion 600 and generates the residual vibration signal NVT1*m* based on the residual vibration Vout-m input to the integrated circuit 312 will be described. It should be noted that each integrated circuit 312 included in the print head 3 has the same configuration and thus the integrated circuit 312 included in the flexible wiring substrate 311-1 of the head main body 31-1 will be described as an example in the following description and the rest of the integrated circuits 312 will not be described.

Figure 11:
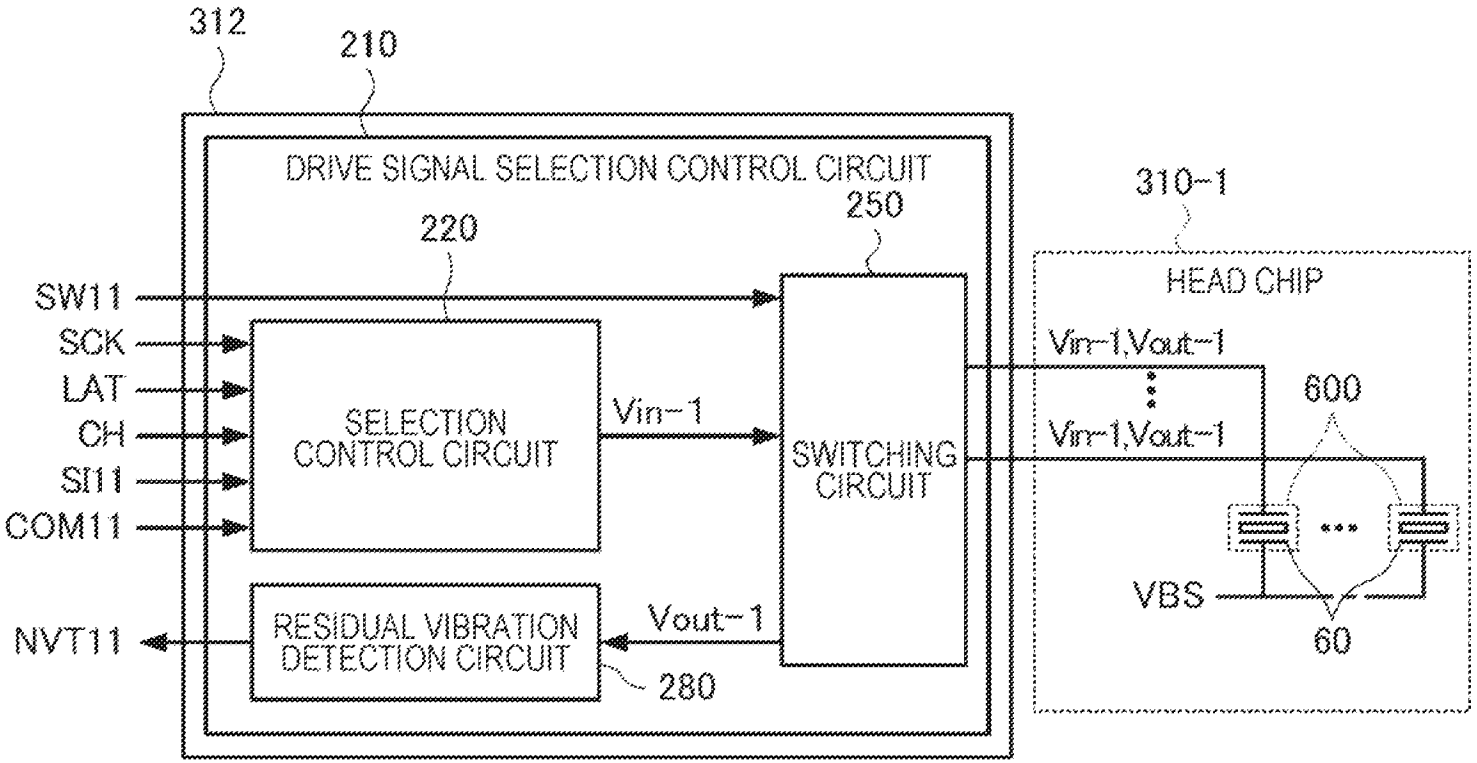
FIG. 11 is a diagram for describing details of an integrated circuit 312.

FIG. 11 is a diagram for describing details of the integrated circuit 312. As illustrated in FIG. 11, the integrated circuit 312 includes a drive signal selection control circuit 210. In addition, the drive signal selection control circuit 210 includes a selection control circuit 220, a switching circuit 250, and a residual vibration detection circuit 280.

The clock signal SCK, the latch signal LAT, the change signal CH, the printing data signal SI11, and the drive signal COM11 are input to the selection control circuit 220. Then, the selection control circuit 220 generates and outputs the drive signal Vin-1 by controlling whether or not to select a signal waveform included in the drive signal COM11 based on the clock signal SCK, the latch signal LAT, the change signal CH, and the printing data signal SI11. The switching circuit 250 switches, based on the switching signal SW11, between whether to supply the drive signal Vin-1 to the head chip 310 or to supply the residual vibration Vout-1 generated after the drive signal Vin-1 is supplied to the head chip 310 to the residual vibration detection circuit 280. Then, the residual vibration detection circuit 280 detects the input residual vibration Vout-1 and outputs the residual vibration signal NVT11 based on the detected residual vibration Vout-1.

Figure 12:
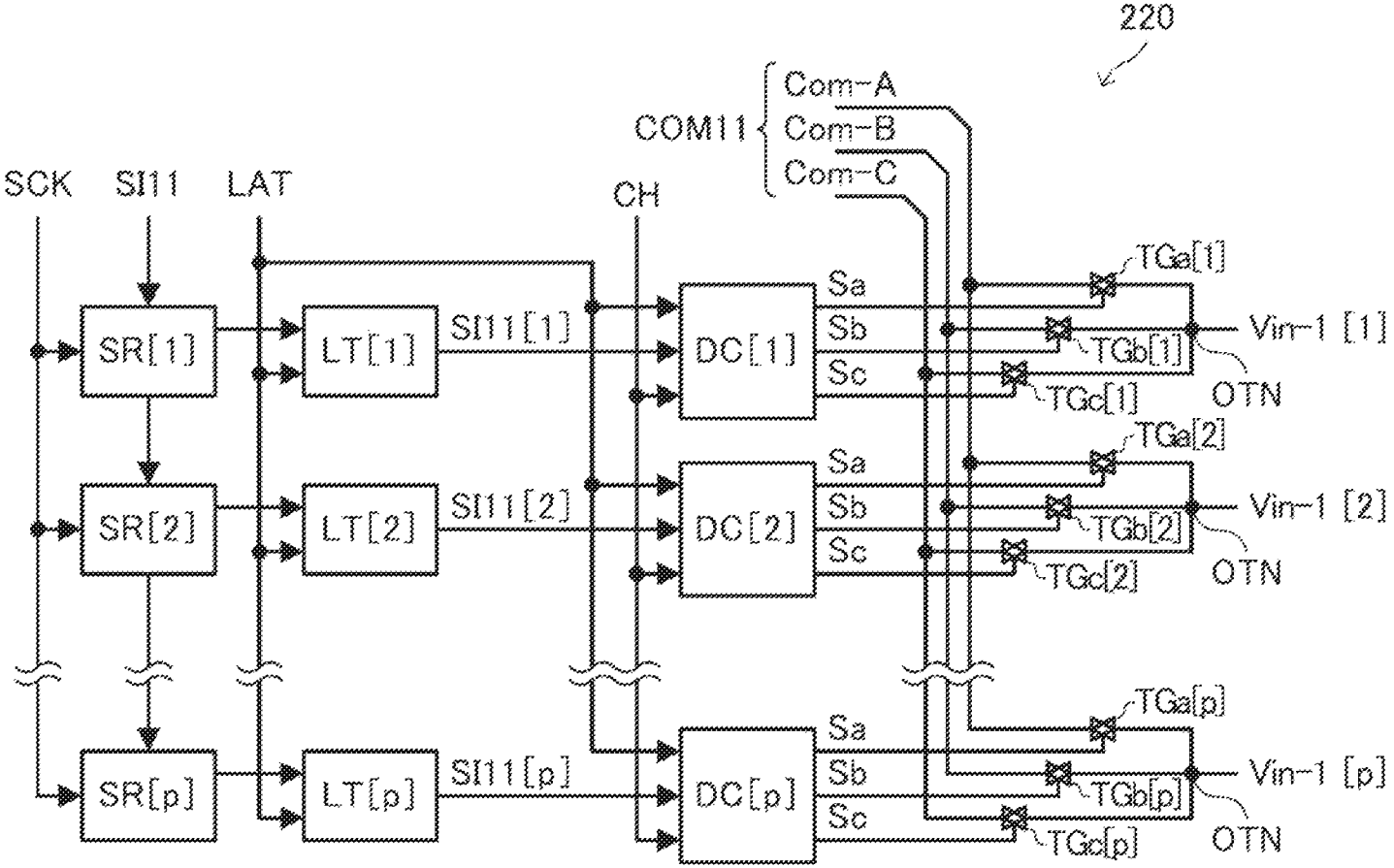
FIG. 12 is a block diagram illustrating the configuration of a selection control circuit.

First, the configuration and operation of the selection control circuit 220 will be described. FIG. 12 is a block diagram illustrating the configuration of the selection control circuit 220. As illustrated in FIG. 12, the selection control circuit 220 includes the same number of shift registers SR, latch circuits LT, decoders DC, and transmission gates TGa, TGb, and TGc as the ejecting portions 600 included in the head chip 310-1. In other words, the selection control circuit 220 includes the same number of sets of the shift register SR, the latch circuit LT, the decoder DC, and the transmission gates TGa, TGb, and TGc as the ejecting portion 600 included in the head chip 310-1.

It should be noted that the head chip 310-1 is assumed to include p ejecting portions 600 in the following description. Further, the respective elements of the shift register SR, the latch circuit LT, the decoder DC, and the transmission gates TGa, TGb, and TGc of the selection control circuit 220 are referred to as a first stage, a second stage, . . . , a p stage in order from the upper side in FIG. 12 so as to respectively correspond to the p ejecting portions 600. Here, in FIG. 12, the shift registers SR respectively corresponding to the first stage, the second stage, . . . , the p stage are indicated as SR[1], SR[2], . . . , SR[p], the latch circuits LT respectively corresponding to the first stage, the second stage, . . . , the p stage are indicated as LT[1], LT[2], . . . , LT[p], the decoders DC respectively corresponding to the first stage, the second stage, . . . , the p stage are indicated as DC[1], DC[2], . . . , DC[p], the drive signals Vin-1 respectively corresponding to the first stage, the second stage, . . . , the p stage are indicated as Vin-1[1], Vin-1[2], . . . , Vin-1[*p*], the transmission gates TGa respectively corresponding to the first stage, the second stage, . . . , the p stage are indicated as TGa[1], TGa[2], . . . , TGa1[*p*], the transmission gates TGb respectively corresponding to the first stage, the second stage, . . . , the p stage are indicated as TGb[1], TGb[2], . . . , TGb1[*p*], and the transmission gates TGc respectively corresponding to the first stage, the second stage, . . . , the p stage are indicated as TGc[1], TGc[2], . . . , TGc1[*p*].

The clock signal SCK, the printing data signal SI11, the latch signal LAT, the change signal CH, and the drive signal COM11 are supplied to the selection control circuit 220. In addition, as illustrated in FIG. 12, the drive signal COM11 includes three drive signals Com-A, Com-B, and Com-C.

The printing data signal SI11 is a digital signal defining the amount of ink ejected from the nozzle 651 of the corresponding ejecting portion 600 in a case where one dot of an image is formed. Specifically, the printing data signal SI11 includes three-bit printing data [b1, b2, b3] corresponding to each of the p ejecting portions 600. In other words, the printing data signal SI11 includes a total of 3p bits of data. Further, the amount of ink ejected from the ejecting portion 600 is defined by the printing data [b1, b2, b3]. The printing data signal SI11 is input to the selection control circuit 220 in synchronization with the clock signal SCK. The selection control circuit 220 outputs the drive signal Vin-1 corresponding to the amount of ink ejected from the ejecting portion 600 based on the input printing data signal SI11. The drive signal Vin-1 is supplied to the piezoelectric element 60 included in the corresponding ejecting portion 600. Then, the four gradations of non-recording, small-dot, medium-dot, and large-dot are expressed on the medium P by the drive signal Vin-1 being supplied to the corresponding piezoelectric element 60. In addition, the selection control circuit 220 also generates the drive signal Vin-1 for inspection for inspecting the state of the ejecting portion 600 based on the input printing data signal SI11.

Each of the shift registers SR temporarily holds the three-bit printing data [b1, b2, b3] included in the printing data signal SI11 and sequentially transfers the three-bit printing data [b1, b2, b3] to the subsequent shift register SR in accordance with the clock signal SCK. Specifically, the p shift registers SR respectively corresponding to the p ejecting portions 600 are coupled in cascade. Further, the serially supplied printing data signal SI11 is sequentially transferred to the subsequent shift register SR in accordance with the clock signal SCK. Subsequently, the supply of the clock signal SCK is stopped at the point in time when the printing data signal SI11 is transferred to all of the p shift registers SR. As a result, each of the p shift registers SR holds the three-bit printing data [b1, b2, b3] corresponding to each of the p ejecting portions 600.

Each of the p latch circuits LT latches the three-bit printing data [b1, b2, b3] held by each of the p shift registers SR in synchronization with the rise of the latch signal LAT. Here, the SI11[1] to SI11[*p*] that are illustrated in FIG. 12 indicate p pieces of printing data [b1, b2, b3] respectively held by the p shift registers SR[1] to SR[p] and latched by the corresponding latch circuits LT[1] to LT[p].

By the way, the operation period in which the liquid ejecting apparatus 1 executes printing includes a plurality of unit operation periods Tu. In addition, each unit operation period Tu includes a control period Ts1 and a control period Ts2 subsequent to the control period Ts1. The plurality of unit operation periods Tu include, for example, the unit operation period Tu in which printing processing is executed, the unit operation period Tu in which ejection abnormality detection processing is executed, and the unit operation period Tu in which both the printing processing and the ejection abnormality detection processing are executed.

The printing data signal SI11 is supplied to the selection control circuit 220 for each unit operation period Tu, and the latch circuit LT latches the printing data signal SI11 for each unit operation period Tu. In other words, the drive signal Vin-1 is supplied to the piezoelectric elements 60 included in the p ejecting portions 600 for each unit operation period Tu.

Specifically, in a case where the print head 3 executes only the printing processing in the unit operation period Tu, the selection control circuit 220 supplies the drive signal Vin-1 for printing with respect to the piezoelectric elements 60 included in the p ejecting portions 600. In this case, ink is ejected to the medium P by an amount corresponding to the image that is formed from each nozzle 651.

On the other hand, in a case where the print head 3 executes only the ejection abnormality detection processing in the unit operation period Tu, the selection control circuit 220 supplies the drive signal Vin-1 for inspection with respect to the piezoelectric elements 60 included in the p ejecting portions 600. In this case, detection processing is executed as to whether or not an abnormality has occurred in the corresponding ejecting portion 600.

In addition, in a case where the print head 3 executes both the printing processing and the ejection abnormality detection processing in the unit operation period Tu, the selection control circuit 220 supplies the drive signal Vin-1 for printing with respect to some of the piezoelectric elements 60 included in the p ejecting portions 600 and supplies the drive signal Vin-1 for inspection with respect to the piezoelectric elements 60 included in the rest of the ejecting portions 600.

The decoder DC decodes the three-bit printing data [b1, b2, b3] latched by the latch circuit LT and outputs H-level or L-level selection signals Sa, Sb, and Sc in each of the control periods Ts1 and Ts2.

FIG. 13 is a diagram illustrating the content of the decoding performed by the decoder DC. As illustrated in FIG. 13, in a case where the input printing data [b1, b2, b3] is [1, 0, 0], the decoder DC sets the selection signals Sa, Sb, and Sc respectively to the H, L, and L levels in the control period Ts1 and sets the selection signals Sa, Sb, and Sc respectively to the L, H, and L levels in the control period Ts2.

Returning to FIG. 12, the selection signal Sa is input to the transmission gates TGa[1] to TGa[p] from the corresponding decoders DC[1] to DC[p], respectively. Then, each of the transmission gates TGa[1] to TGa[p] becomes conductive in a case where the input selection signal Sa is at the H level and becomes non-conductive in a case where the input selection signal Sa is at the L level. Likewise, the selection signal Sb is input to the transmission gates TGb[1] to TGb[p] from the corresponding decoders DC[1] to DC[p], respectively. Then, each of the transmission gates TGb[1] to TGb[p] becomes conductive in a case where the input selection signal Sb is at the H level and becomes non-conductive in a case where the input selection signal Sb is at the L level. Likewise, the selection signal Sc is input to the transmission gates TGc[1] to TGb[p] from the corresponding decoders DC[1] to DC[p], respectively. Then, each of the transmission gates TGc[1] to TGc[p] becomes conductive in a case where the input selection signal Sc is at the H level and becomes non-conductive in a case where the input selection signal Sc is at the L level.

In other words, in a case where the printing data [b1, b2, b3] generated based on the printing data signals SI11[1] to SI11[*p*] is [1, 0, 0] in the example illustrated in FIG. 13, the corresponding transmission gates TGa[1] to TGa[p] are controlled to be conductive, the corresponding transmission gates TGb[1] to TGb[p] are controlled to be non-conductive, and the corresponding transmission gates TGc[1] to TGc[p] are controlled to be non-conductive in the control period Ts1. In addition, in the control period Ts2, the transmission gates TGa[1] to TGa[p] are controlled to be non-conductive, the transmission gates TGb[1] to TGb[p] are controlled to be conductive, and the transmission gates TGc[1] to TGc[p] are controlled to be non-conductive.

As illustrated in FIG. 12, the drive signal Com-A in the drive signal COM11 is supplied to one end of the transmission gates TGa[1] to TGa[p], the drive signal Com-B in the drive signal COM11 is supplied to one end of the transmission gates TGb[1] to TGb[p], and the drive signal Com-C in the drive signal COM11 is supplied to one end of the transmission gates TGc[1] to TGc[p]. In addition, the other respective ends of the transmission gates TGa[1] to TGa[p], TGb[1] to TGb[p], and TGc[1] to TGc[p] are coupled in common to an output end OTN. Accordingly, the drive signals Com-A, Com-B, and Com-C included in the drive signal COM11 are selectively output to the output end OTN by the t transmission gates TGa[1] to TGa[p], TGb[1] to TGb[p], and TGc[1] to TGc[p] becoming conductive or non-conductive in each of the control periods Ts1 and Ts2. The signal input to the output end OTN is supplied to a switching circuit 53 as the drive signal Vin-1.

Figure 14:
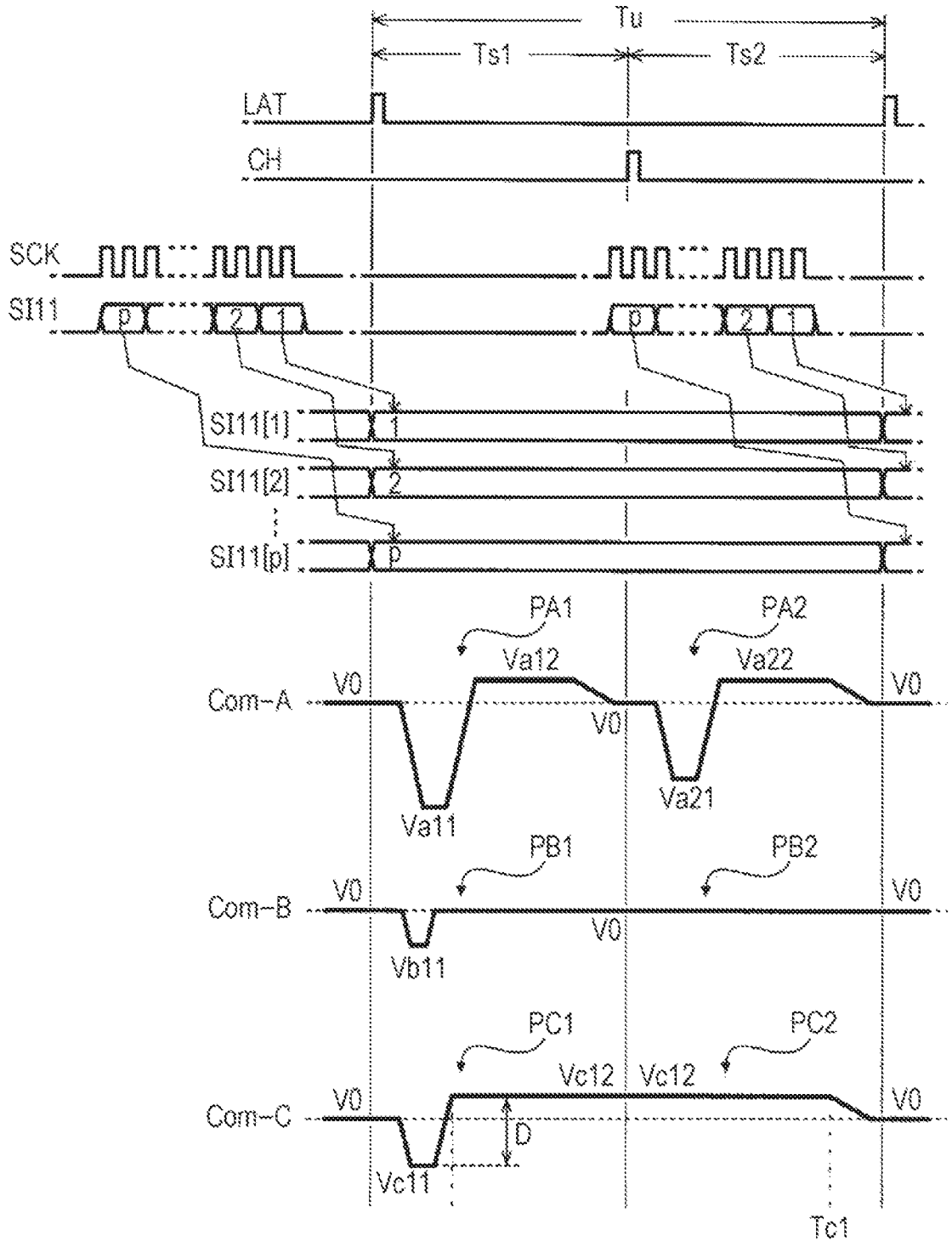
FIG. 14 is a diagram for describing the operation of the selection control circuit in a unit operation period.

FIG. 14 is a diagram for describing the operation of the selection control circuit 220 in the unit operation period Tu. As illustrated in FIG. 14, the unit operation period Tu is defined by the latch signal LAT. In addition, the control periods Ts1 and Ts2 included in the unit operation period Tu are defined by the latch signal LAT and the change signal CH.

Of the drive signals COM11 input to the selection control circuit 220, the drive signal Com-A is a signal for generating the drive signal Vin-1 for printing in the unit operation period Tu. Specifically, the drive signal Com-A includes a waveform in which a unit waveform PA1 disposed in the control period Ts1 and a unit waveform PA2 disposed in the control period Ts2 are continuous. As for the unit waveform PA1 and the unit waveform PA2, each of the voltage values at the start and end timings is a reference potential V0. In addition, the potential difference between a voltage value Va11 and a voltage value Va12 of the unit waveform PA1 is larger than the potential difference between a voltage value Va21 and a voltage value Va22 of the unit waveform PA2. Accordingly, the amount of ink ejected from the corresponding nozzle 651 in a case where the unit waveform PA1 is supplied to the piezoelectric element 60 is larger than the amount of ink ejected from the corresponding nozzle 651 in a case where the unit waveform PA2 is supplied to the piezoelectric element 60. Here, in the following description, the amount of ink ejected from the nozzle 651 based on the unit waveform PA1 is referred to as a medium amount and the amount of ink ejected from the nozzle 651 based on the unit waveform PA2 is referred to as a small amount.

In addition, of the drive signals COM11 input to the selection control circuit 220, the drive signal Com-B is a signal for generating the drive signal Vin-1 for printing in the unit operation period Tu. Specifically, the drive signal Com-B includes a waveform in which a unit waveform PB1 disposed in the control period Ts1 and a unit waveform PB2 disposed in the control period Ts2 are continuous. The voltage value of the unit waveform PB1 is the reference potential V0 at both the start and end timings, and the voltage value of the unit waveform PB2 is the reference potential V0 over the control period Ts2. In addition, the potential difference between a voltage value Vb11 of the unit waveform PB1 and the reference potential V0 is smaller than the potential difference between the voltage value Va21 of the unit waveform PA2 and the reference potential V0 and the potential difference between the voltage value Va22 and the reference potential V0. In a case where the unit waveform PB1 is supplied to the piezoelectric element 60, the piezoelectric element 60 is driven to the extent that no ink is ejected from the corresponding nozzle 651. In addition, in a case where the unit waveform PB2 is supplied to the piezoelectric element 60, the piezoelectric element is not displaced. Accordingly, no ink is ejected from the nozzle 651.

In addition, of the drive signals COM11 input to the selection control circuit 220, the drive signal Com-C is a signal for generating the drive signal Vin for inspection in the unit operation period Tu. Specifically, the drive signal Com-C includes a waveform in which a unit waveform PC1 disposed in the control period Ts1 and a unit waveform PC2 disposed in the control period Ts2 are continuous. Both the voltage value at the start timing of the unit waveform PC1 and the voltage value at the end timing of the unit waveform PC2 are the reference potential V0. In addition, the voltage value of the unit waveform PC1 transitions from the reference potential V0 to a voltage value Vc11 and then from the voltage value Vc11 to a voltage value Vc12. After maintaining the voltage value Vc12 until a control time Tc1, the unit waveform PC2 transitions from the voltage value Vc12 to the reference potential V0 before the control period Ts2 ends.

As illustrated in FIG. 14, the printing data signals SI11[1] to SI11[*p*] supplied as serial signals are sequentially propagated to the shift register SR by the clock signal SCK. When the clock signal SCK is subsequently stopped, the corresponding printing data signals SI11[1] to SI11[*p*] are held by the shift registers SR[1] to SR[p]. Then, the p latch circuits LT latch the printing data signals SI11[1] to SI11[*p*] respectively held by the shift registers SR[1] to SR[p] at the rise timing of the latch signal LAT, that is, the start timing of the unit operation period Tu. In each of the control periods Ts1 and Ts2, each of the p decoders DC outputs the selection signals Sa, Sb, and Sc of the logic levels corresponding to the printing data signals SI11[1] to SI11[*p*] latched by the latch circuit LT in accordance with the content of FIG. 13. Each of the p sets of transmission gates TGa, TGb, and TGc is controlled to be conductive or non-conductive based on the logic levels of the input selection signals Sa, Sb, and Sc. As a result, each of the drive signals Com-A, Com-B, and Com-C included in the drive signal COM11 is controlled to be selected or non-selected and the drive signal Vin-1 is output to the output end OTN as a result of the control.

Figure 15:
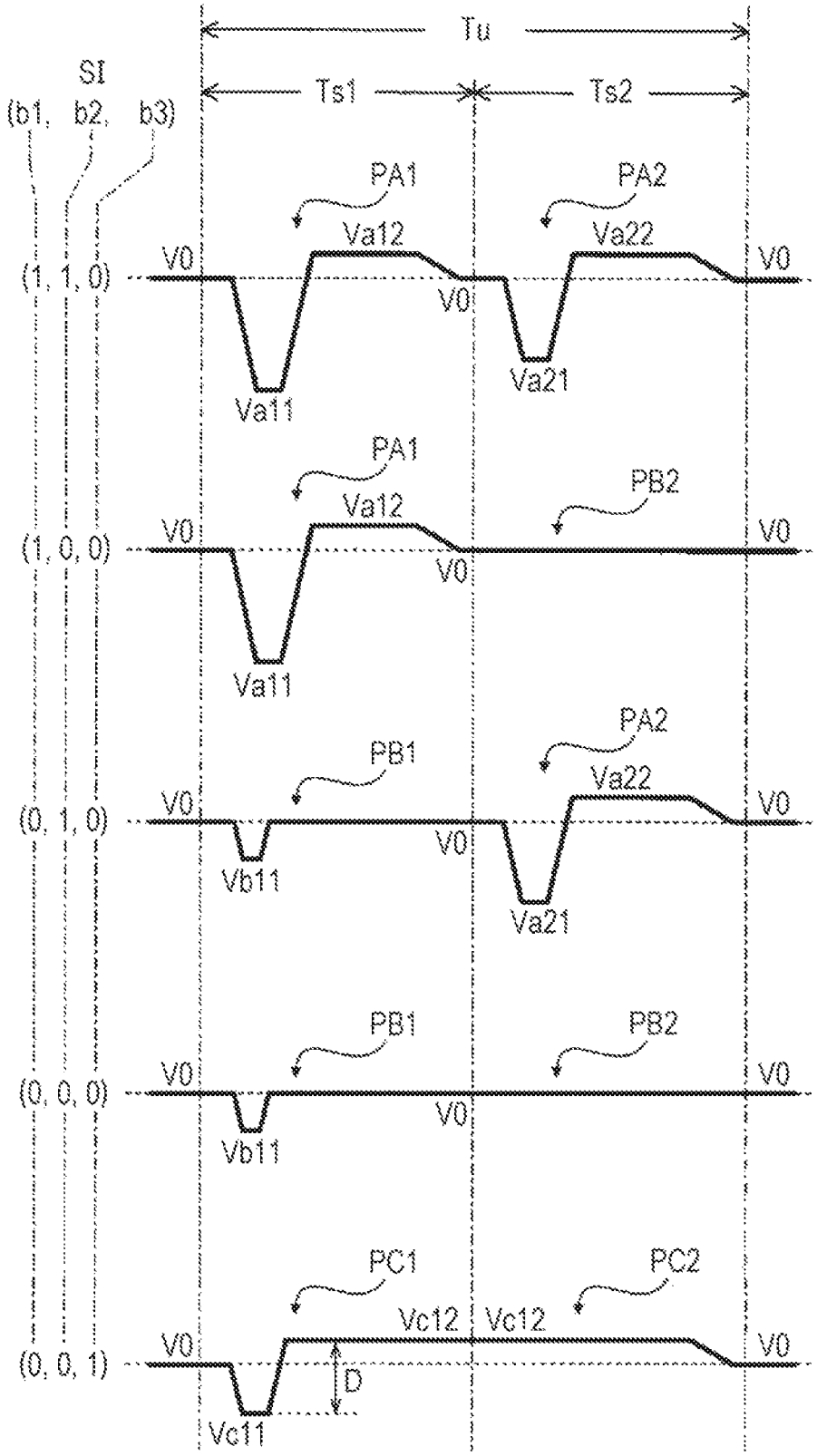
FIG. 15 is a diagram illustrating an example of the waveform of a drive signal Vin-1.

An example of the waveform of the drive signal Vin-1 output in the unit operation period Tu from the selection control circuit 220 configured as described above will be described. FIG. 15 is a diagram illustrating an example of the waveform of the drive signal Vin-1.

In a case where the printing data [b1, b2, b3] included in the printing data signal SI11 supplied to the selection control circuit 220 in the unit operation period Tu is [1, 1, 0], the decoder DC sets the logic levels of the selection signals Sa, Sb, and Sc in the control period Ts1 to the H, L, and L levels and sets the logic levels of the selection signals Sa, Sb, and Sc in the control period Ts2 to the H, L, and L levels. Accordingly, the drive signal Com-A is selected in the control period Ts1 and the drive signal Com-A is selected in the control period Ts2. As a result, the selection control circuit 220 outputs the drive signal Vin-1 having a waveform in which the unit waveform PA1 and the unit waveform PA2 are continuous in the unit operation period Tu. Accordingly, in the unit operation period Tu, the medium amount of ink based on the unit waveform PA1 and the small amount of ink based on the unit waveform PA2 are ejected from the nozzle 651 included in the ejecting portion 600 to which the drive signal Vin-1 is supplied. Then, large dots are formed on the medium P by the ink ejected from the nozzle 651 being joined on the medium P.

In addition, in a case where the printing data [b1, b2, b3] included in the printing data signal SI11 supplied to the selection control circuit 220 in the unit operation period Tu is [1, 0, 0], the decoder DC sets the logic levels of the selection signals Sa, Sb, and Sc in the control period Ts1 to the H, L, and L levels and sets the logic levels of the selection signals Sa, Sb, and Sc in the control period Ts2 to the L, H, and L levels. Accordingly, the drive signal Com-A is selected in the control period Ts1 and the drive signal Com-B is selected in the control period Ts2. As a result, the selection control circuit 220 outputs the drive signal Vin-1 having a waveform in which the unit waveform PA1 and the unit waveform PB2 are continuous in the unit operation period Tu. Accordingly, in the unit operation period Tu, the medium amount of ink based on the unit waveform PA1 is ejected from the nozzle 651 included in the ejecting portion 600 to which the drive signal Vin-1 is supplied and medium dots are formed on the medium P.

In addition, in a case where the printing data [b1, b2, b3] included in the printing data signal SI11 supplied to the selection control circuit 220 in the unit operation period Tu is [0, 1, 0], the decoder DC sets the logic levels of the selection signals Sa, Sb, and Sc in the control period Ts1 to the L, H, and L levels and sets the logic levels of the selection signals Sa, Sb, and Sc in the control period Ts2 to the H, L, and L levels. Accordingly, the drive signal Com-B is selected in the control period Ts1 and the drive signal Com-A is selected in the control period Ts2. As a result, the selection control circuit 220 outputs the drive signal Vin-1 having a waveform in which the unit waveform PB1 and the unit waveform PA2 are continuous in the unit operation period Tu. Accordingly, in the unit operation period Tu, the small amount of ink based on the unit waveform PA2 is ejected from the nozzle 651 included in the ejecting portion 600 to which the drive signal Vin-1 is supplied and small dots are formed on the medium P.

In addition, in a case where the printing data [b1, b2, b3] included in the printing data signal SI11 supplied to the selection control circuit 220 in the unit operation period Tu is [0, 0, 0], the decoder DC sets the logic levels of the selection signals Sa, Sb, and Sc in the control period Ts1 to the L, H, and L levels and sets the logic levels of the selection signals Sa, Sb, and Sc in the control period Ts2 to the L, H, and L levels. Accordingly, the drive signal Com-B is selected in the control period Ts1 and the drive signal Com-B is selected in the control period Ts2. As a result, the selection control circuit 220 outputs the drive signal Vin-1 having a waveform in which the unit waveform PB1 and the unit waveform PB2 are continuous in the unit operation period Tu. Accordingly, in the unit operation period Tu, no ink is ejected from the nozzle 651 included in the ejecting portion 600 to which the drive signal Vin-1 is supplied. Accordingly, no dot is formed on the medium P. In this case, the drive signal Vin-1 output by the selection control circuit 220 drives the piezoelectric element 60 to the extent that no ink is ejected from the nozzle 651. As a result, it is possible to prevent thickening of the ink near the nozzle.

In addition, in a case where the printing data [b1, b2, b3] included in the printing data signal SI11 supplied to the selection control circuit 220 in the unit operation period Tu is [0, 0, 1], the decoder DC sets the logic levels of the selection signals Sa, Sb, and Sc in the control period Ts1 to the L, L, and H levels and sets the logic levels of the selection signals Sa, Sb, and Sc in the control period Ts2 to the L, L, and H levels. Accordingly, the drive signal Com-C is selected in the control period Ts1 and the drive signal Com-C is selected in the control period Ts2. As a result, the selection control circuit 220 outputs the drive signal Vin-1 having a waveform in which the unit waveform PC1 and the unit waveform PC2 are continuous in the unit operation period Tu. Accordingly, in the unit operation period Tu, no ink is ejected from the nozzle 651 included in the ejecting portion 600 to which the drive signal Vin-1 is supplied. Accordingly, no dot is formed on the medium P. In this case, the drive signal Vin-1 output by the selection control circuit 220 corresponds to a waveform for inspection for detecting the residual vibration of the piezoelectric element 60.

As described above, the selection control circuit 220 defines the waveform selection of the drive signal Vin supplied to the piezoelectric element 60 by controlling the switching of the transmission gates TGa, TGb, and TGc under the condition defined by the printing data signal SI in the cycle defined by the latch signal LAT. In other words, the latch signal LAT is a signal defining the cycle of dot formation on the medium P, that is, a signal for defining the ejection timing of the ink ejected from the ejecting portion 600 with respect to the medium P. In addition, the printing data signal SI is a signal for selecting the voltage waveform supplied to the piezoelectric element 60 as the drive signal Vin from the waveforms respectively included in the drive signals Com-A, Com-B, and Com-C at the ink ejection timing defined by the latch signal LAT and the printing data signal SI in the present embodiment is a signal for controlling the switching of the transmission gates TGa, TGb, and TGc in order to define the selection of the waveform. Further, the change signal CH is a signal defining the switching timings of the waveforms respectively included in the drive signals Com-A, Com-B, and Com-C.

It should be noted that the description of the present embodiment assumes that the switching timings of the waveforms respectively included in the drive signals Com-A, Com-B, and Com-C included in the drive signal COM are the same and thus the waveform switching timings of the drive signals Com-A, Com-B, and Com-C are defined by one change signal CH and yet the switching timings of the waveforms respectively included in the drive signals Com-A, Com-B, and Com-C may be different and a plurality of the change signals CH corresponding to the switching timings of the respective waveforms of the drive signals Com-A, Com-B, and Com-C are used in that case.

Figure 16:
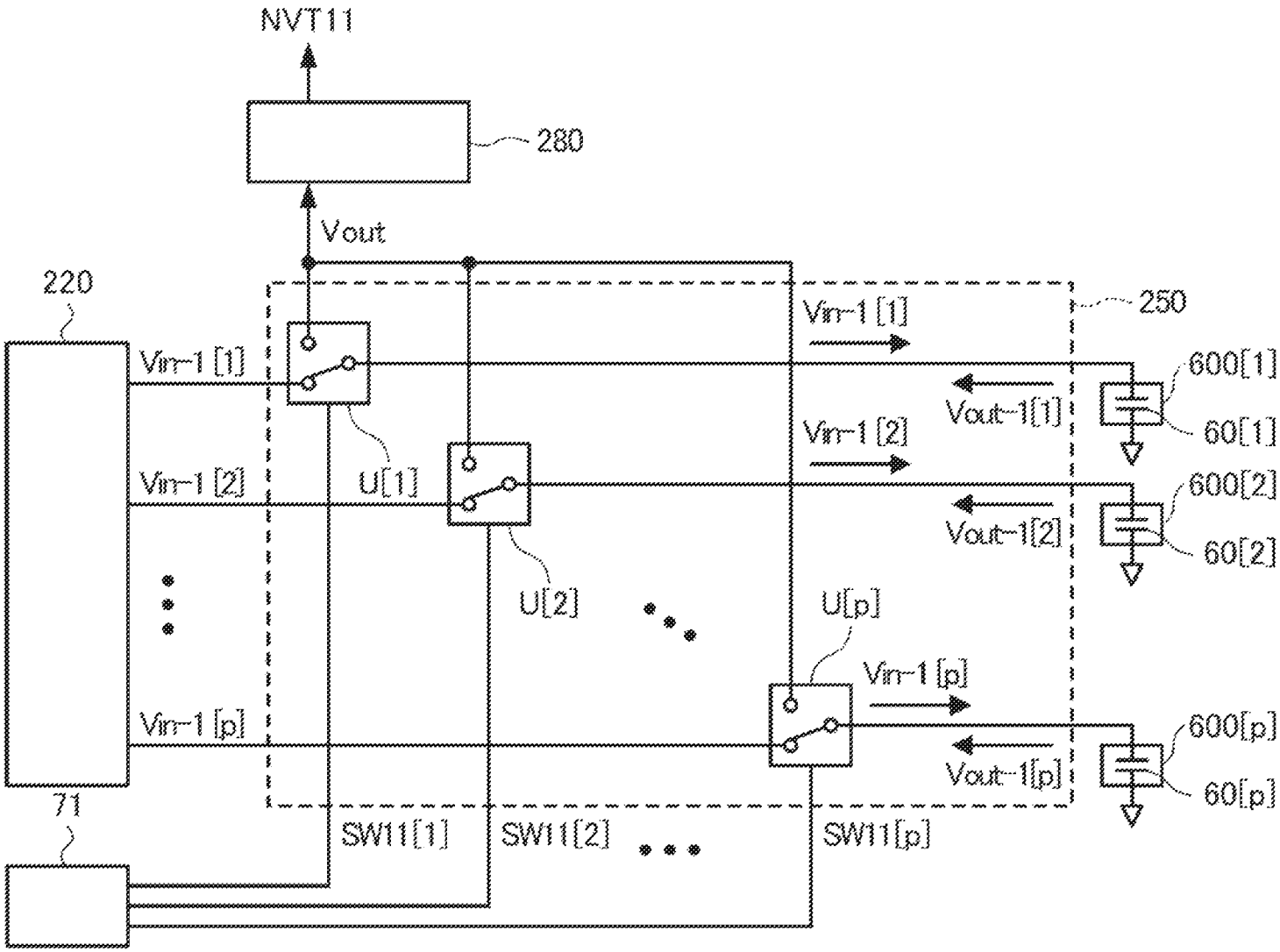
FIG. 16 is a diagram illustrating the electrical configuration of a switching circuit.

Next, the configuration and operation of the switching circuit 250 will be described. FIG. 16 is a diagram illustrating the electrical configuration of the switching circuit 250. The switching circuit 250 includes p changeover switches U as many as the p ejecting portions 600 included in the head chip 310-1. It should be noted that the changeover switches U to which the drive signals Vin-1[1], Vin-1[2], . . . , Vin-1[*p*] output from the selection control circuit 220 are input are indicated as U[1], U[2], . . . , U[p] in FIG. 16. Further, of the p piezoelectric elements 60 included in the p ejecting portions 600, the piezoelectric elements 60 to which the drive signals Vin-1[1], Vin-1[2], . . . , Vin-1[*p*] are input are indicated as 60[1], 60[2], . . . , 60[p]. The ejecting portions 600 including the piezoelectric elements 60[1], 60[2], 60[p] are indicated as 600[1], 600[2], . . . , 600[p].

Each of the changeover switches U switches, based on the switching signal SW11, between whether to supply the drive signal Vin-1 input from the selection control circuit 220 to the piezoelectric element 60 included in the corresponding ejecting portion 600 or to supply the residual vibration Vout-1 generated after the drive signal Vin-1 is supplied to the piezoelectric element 60 to the residual vibration detection circuit 280.

Specifically, the switching signal SW11[1] is input to the changeover switch U[1]. Then, the changeover switch U[1] switches, based on the switching signal SW11[1], whether to supply the drive signal Vin-1[1] to the piezoelectric element 60[1] or to supply the residual vibration Vout-1[1] generated in the piezoelectric element 60[1] after the drive signal Vin-1[1] is supplied to the piezoelectric element 60[1] to the residual vibration detection circuit 280.

Likewise, the switching signal SW11[*p*] is input to the changeover switch U[p]. Then, the changeover switch U[p] switches, based on the switching signal SW11[*p*], whether to supply the drive signal Vin-1[*p*] to the piezoelectric element 60[p] or to supply the residual vibration Vout-1[*p*] generated in the piezoelectric element 60[p] after the drive signal Vin-1[*p*] is supplied to the piezoelectric element 60[p] to the residual vibration detection circuit 280.

Here, in the unit operation period Tu, the switching signals SW11[1] to SW11[*p*] switch the changeover switches U[1] to U[p] such that any one of the piezoelectric elements 60[1] to 60[p] is electrically coupled to the residual vibration detection circuit 280. In other words, the residual vibration detection circuit 280 detects any one of the residual vibrations Vout-1[1] to Vout-1[*p*] respectively corresponding to the p piezoelectric elements 60[1] to 60[p] based on the switching signal SW11 and generates the residual vibration signal NVT11 in the corresponding ejecting portion 600. Accordingly, the switching signal SW11 may be capable of controlling the changeover switches U[1] to U[p] to be sequentially turned ON and may be a configuration sequentially controlling the p changeover switches U by sequentially propagating the switching signal SW11 by a register (not illustrated) or the like. It should be noted that the residual vibration Vout-1 is assumed to be input from the switching circuit 250 to the residual vibration detection circuit 280 in the following description.

Figure 17:
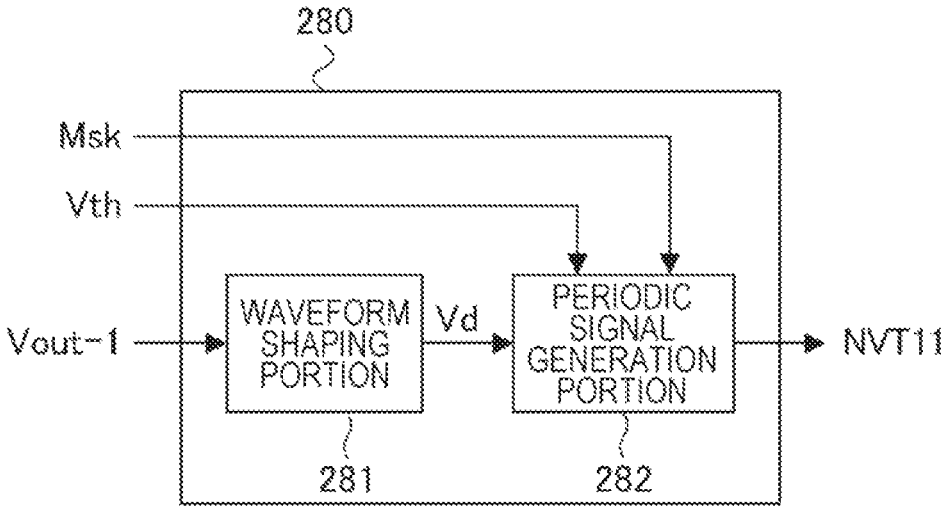
FIG. 17 is a block diagram illustrating the configuration of a residual vibration detection circuit.

Next, the configuration of the residual vibration detection circuit 280 will be described. FIG. 17 is a block diagram illustrating the configuration of the residual vibration detection circuit 280. The residual vibration detection circuit 280 detects the residual vibration Vout-1 and generates and outputs the residual vibration signal NVT11 indicating at least one of the cycle and the vibration frequency of the detected residual vibration Vout-1.

As illustrated in FIG. 17, the residual vibration detection circuit 280 includes a waveform shaping portion 281 and a periodic signal generation portion 282. The waveform shaping portion 281 generates a shaped waveform signal Vd, which is obtained by a noise component being removed from the residual vibration Vout-1. The waveform shaping portion 281 includes, for example, a high-pass filter for outputting a signal in which a frequency component lower in frequency band than the residual vibration Vout-1 is attenuated or a low-pass filter for outputting a signal in which a frequency component higher in frequency band than the residual vibration Vout-1 is attenuated. In other words, the waveform shaping portion 281 outputs the noise component-removed shaped waveform signal Vd by limiting the frequency range of the residual vibration Vout-1. In addition, the waveform shaping portion 281 may include a negative feedback-type amplifier circuit for adjusting the amplitude of residual vibration Vout-1, an impedance conversion circuit for converting the impedance of the residual vibration Vout-1, or the like.

The periodic signal generation portion 282 generates and outputs the residual vibration signal NVT11 indicating the cycle and the vibration frequency of the residual vibration Vout-1 based on the shaped waveform signal Vd. Specifically, the shaped waveform signal Vd, a mask signal Msk, and a threshold potential Vth are input to the periodic signal generation portion 282. Here, the mask signal Msk and the threshold potential Vth may be supplied from, for example, the print head control circuit 71 or may be supplied to the periodic signal generation portion 282 by information stored in a storage portion (not illustrated) being read.

Figure 18:
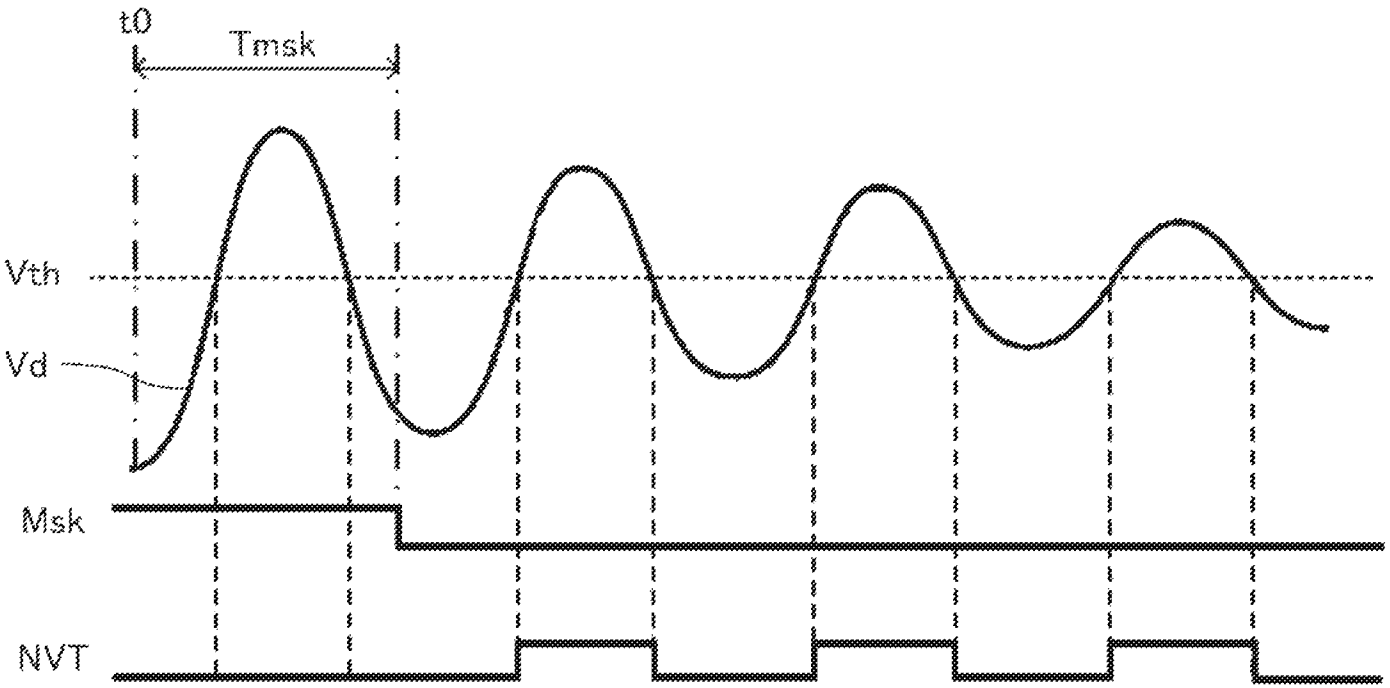
FIG. 18 is a diagram for describing the operation of a periodic signal generation portion.

FIG. 18 is a diagram for describing the operation of the periodic signal generation portion 282. Here, the threshold potential Vth illustrated in FIG. 18 is a threshold that is set to a potential of a predetermined level within the amplitude of the shaped waveform signal Vd and is set to, for example, a potential at the center level of the amplitude of the shaped waveform signal Vd. The periodic signal generation portion 282 generates and outputs the residual vibration signal NVT11 based on the input shaped waveform signal Vd and threshold potential Vth.

Specifically, the periodic signal generation portion 282 compares the voltage value of the shaped waveform signal Vd with the threshold potential Vth. Then, the periodic signal generation portion 282 generates the residual vibration signal NVT11 that becomes the H level in a case where the voltage value of the shaped waveform signal Vd is equal to or higher than the threshold potential Vth and becomes the L level in a case where the voltage value of the shaped waveform signal Vd is lower than the threshold potential Vth.

The residual vibration signal NVT11 generated by the residual vibration detection circuit 280 is input to the ejecting portion state determination circuit 73 illustrated in FIG. 8. The ejecting portion state determination circuit measures the cycle and the vibration frequency of the residual vibration Vout-1 by detecting the period until the logic level of the input residual vibration signal NVT11 becomes the H level again after a transition from the H level to the L level. Then, the ejecting portion state determination circuit 73 generates the ejecting portion state signal DI11 indicating the corresponding ejecting portion 600 based on the result of the cycle and vibration frequency measurement and inputs the ejecting portion state signal DI11 to the print head control circuit 71.

The mask signal Msk is a signal that is at the H level for a predetermined period Tmsk from time t0 when the supply of the shaped waveform signal Vd is started. The periodic signal generation portion 282 stops the generation of the residual vibration signal NVT11 while the mask signal Msk is at the H level and generates the residual vibration signal NVT11 while the mask signal Msk is at the L level. In other words, the periodic signal generation portion 282 generates the residual vibration signal NVT11 only for the shaped waveform signal Vd after the elapse of the period Tmsk among the shaped waveform signals Vd. As a result, it is possible to exclude a noise component that is superimposed immediately after the residual vibration Vout-1 is generated and the periodic signal generation portion 282 is capable of generating the high-precision residual vibration signal NVT11.

Here, a transmission gate or the like constitutes the changeover switches U[1] to U[p].

In the liquid ejecting apparatus 1 configured as described above, the drive signal COM, which is amplified by the high voltage VHV to a voltage sufficient to drive the print head 3 and changes in voltage value, is an example of a high voltage signal. In addition, the unit waveform PA1 included in the drive signal Com-A in the drive signal COM is an example of a first voltage waveform and the unit waveform PA2 for ejecting ink different in amount from the unit waveform PA1 is an example of a second voltage waveform. In addition, the unit waveform PB1 included in the drive signal Com-B is another example of the first voltage waveform and the unit waveform PB2 for ejecting ink different in amount from the unit waveform PB1 is another example of the second voltage waveform. Here, the drive signal Vin is generated by selection of the unit waveforms PA1 and PA2 included in the drive signal Com-A and the unit waveforms PB1 and PB2 included in the drive signal Com-B. Accordingly, the drive signal Vin is also an example of the high voltage signal.

In addition, of the head chips 310 having the plurality of ejecting portions 600 performing ejection by the drive signal Vin being supplied, the head chip 310-1 included in the head main body 31-1 is an example of a first ejecting portion group, the ejecting portion 600[1] included in the head chip 310-1 included in the head main body 31-1 is an example of a first ejecting portion, and the ejecting portion 600[2] included in the head chip 310-1 included in the head main body 31-1 is an example of a second ejecting portion. In addition, the head chip 310-1 included in the head main body 31-2 is an example of a second ejecting portion group and the ejecting portion 600[1] included in the head chip 310-1 included in the head main body 31-2 is an example of a third ejecting portion. Further, the head main body 31-1 is an example of a first ejecting module and the head main body 31-2 is an example of a second ejecting module. In addition, of the head chips 310 having the plurality of ejecting portions 600 performing ejection by the drive signal Vin being supplied, the head chip 310-2 included in the head main body 31-1 is another example of the second ejecting portion group and the ejecting portion 600[1] included in the head chip 310-2 included in the head main body 31-1 is another example of the third ejecting portion. In this case, the head chip 310-1 is another example of the first ejecting module and the head chip 310-2 is another example of the second ejecting module.

In addition, the transmission gate TGa[1] switching between whether or not to supply the ejecting portion 600[1] with the unit waveform PA1 and the unit waveform PA2 included in the drive signal Com-A and the unit waveform PB1 and the unit waveform PB2 included in the drive signal Com-B is an example of a first switch, the transmission gate TGa[2] switching between whether or not to supply the ejecting portion 600[2] with the unit waveform PA1 and the unit waveform PA2 included in the drive signal Com-A and the unit waveform PB1 and the unit waveform PB2 included in the drive signal Com-B is an example of a second switch, and the selection control circuit 220 having the transmission gates TGa[1] to TGa[p] including the transmission gates TGa[1] and TGa[2] is an example of a switch group.

In addition, the latch signal LAT, the change signal CH, and the printing data signals SI11 to SInm supplying the drive signal COM as the drive signal Vin with respect to the transmission gates TGa[1] and TGa[2], having a low maximum voltage value of 5 V or less as compared with the maximum voltage value of the drive signal COM, and changing in voltage value are an example of a low voltage logic signal. Further, the printing data signal SI11 for switching between whether or not to supply the head chip 310 with the drive signal COM as the drive signal Vin by switching between the transmission gates TGa[1] to TGa[p] of the selection control circuit 220 is an example of a first low voltage logic signal, the latch signal LAT defining the timing of ink ejection from the head chip 310 is an example of a second low voltage logic signal, and the change signal CH defining the waveform switching timings of the unit waveform PA1 and the unit waveform PA2 included in the drive signal Com-A and the unit waveform PB1 and the unit waveform PB2 included in the drive signal Com-B is an example of a third low voltage logic signal.

Here, controlling whether or not to supply the head chip 310 with the drive signal COM as the drive signal Vin by switching between the transmission gates TGa[1] to TGa[p], TGb[1] to TGb[p], and TGc[1] to TGc[p] based on the latch signal LAT, the change signal CH, and the printing data signals SI11 to nm as illustrated in FIGS. 11 to 18 will be referred to as ejection control processing in the following description.

1.4 Ejecting Portion-Related Information and Operation of Liquid Ejecting Apparatus and Print Head In the liquid ejecting apparatus 1 configured as described above, it is determined, based on the ejecting portion-related information stored in the memory 200 of the print head 3, whether the print head 3 assembled in the liquid ejecting apparatus 1 is a newly manufactured print head or a recycled or reused print head.

From the viewpoint of environmental load reduction in recent years, attention has been focused on so-called refurbished products in which a product having an initial defective product, a used product, or the like is refurbished, finished so as to become comparable to an unused product, and then re-distributed in a market. The amount of waste can be reduced by such refurbished products, and a reduction in environmental load can be achieved as a result. Regarding such efforts and liquid ejecting apparatuses such as ink jet printers, efforts for re-market distribution as recycled machines have been made by, for example, refurbishing and finishing of used ink cartridges, print heads, and so on into a state comparable to a state of non-use.

For example, in a case where an ink cartridge is refurbished, the used ink cartridge is collected and the collected ink cartridge is replenished with ink suitable for the structure of the ink cartridge and the specifications of a liquid ejecting apparatus in which the ink cartridge is used. When the ink with which the ink cartridge has been replenished is in an appropriate state in a case where the ink cartridge refurbished as described above is used in the liquid ejecting apparatus, it is possible to perform operation comparable to an unused product without applying an excessive load to the liquid ejecting apparatus. In addition, because the ink cartridge in the liquid ejecting apparatus is mostly a structure that can be easily attached and detached, a user can easily replace the ink cartridge with an ink cartridge replenished with appropriate ink in a case where the ink with which the ink cartridge has been replenished is not in an appropriate state.

On the other hand, in a case where a print head is refurbished, it is assumed as an example that a liquid ejecting apparatus in which an initial defective product has occurred, a used liquid ejecting apparatus, or the like is collected and the print head is removed from the collected liquid ejecting apparatus. Then, replacement of a deteriorated component in the print head or the like is conducted. However, as a plurality of components constitute the print head, the components constituting the print head may have different remaining service lives in the refurbished print head depending on the situation of use of the print head. Further, in a case where a print head including a component having a short remaining service life is assembled in a liquid ejecting apparatus, ink ejection characteristics in the liquid ejecting apparatus may deteriorate in a short period.

It is difficult to visually confirm the remaining service lives of components constituting such print heads, a single head chip may be provided with hundreds to thousands of ink ejecting nozzles in particular, and thus it is extremely laborious to visually confirm the remaining service lives of all of the nozzles. Further, in the case of market distribution of a liquid ejecting apparatus provided with a refurbished print head including a component having a short remaining service life, ink ejected from the liquid ejecting apparatus may have insufficient ejection characteristics and the service life of the liquid ejecting apparatus may decrease. In other words, there is room for improvement in terms of refurbishing a print head and re-distributing a liquid ejecting apparatus including the refurbished print head in a market.

Regarding the above-described problems in the case of re-market distribution of a liquid ejecting apparatus including a refurbished print head, the print head 3 in the present embodiment stores the ejecting portion-related information including information indicating a past operation state and threshold information for determining whether or not to update the information indicating the operation state. Further, it is possible to perform optimal maintenance in recycling or reusing the print head 3 by grasping the state of the print head 3 and the state of the ejecting portion 600 that are not visually confirmed with ease based on the ejecting portion-related information stored in the print head 3 and, in a case where the print head 3 that has been refurbished is incorporated into the liquid ejecting apparatus 1, the liquid ejecting apparatus 1 is capable of driving the print head 3 after grasping the past operation state of the print head 3. Accordingly, from the viewpoint of re-market distribution of the liquid ejecting apparatus 1 including the refurbished print head 3, a manufacturer can perform refurbishing based on the information stored in the print head 3 and can reduce the risk of accidentally discarding the recyclable or reusable print head 3. Further, a user can select the liquid ejecting apparatus 1 that is equipped with the print head 3 which is optimum for the period of use or applications, and thus the convenience of the user can be enhanced.

As described above, the print head 3 in the present embodiment is capable of solving at least one of the problems arising in the print head 3 that is recycled or reused by the memory 200 storing the information indicating the past operation state as the ejecting portion-related information.

1.4.1 Example of Ejecting Portion-Related Information

First, an example of the ejecting portion-related information stored in the print head 3 in the present embodiment will be described with reference to FIG. 19. FIG. is a diagram illustrating an example of the ejecting portion-related information stored in the memory 200 included in the print head 3. As illustrated in FIG. 19, information on a cumulative printing surface count TP, information on an elapsed day count LD, information on an error count EC, information on a transport error count CEC, information on a capping processing count CP, information on a cleaning processing count CL, and information on a wiping processing count WP are stored as the ejecting portion-related information in the memory 200. Specifically, the memory 200 stores three pieces of threshold information corresponding to each of the information on the cumulative printing surface count TP, the information on the elapsed day count LD, the information on the error count EC, the information on the transport error count CEC, the information on the capping processing count CP, the information on the cleaning processing count CL, and the information on the wiping processing count WP and three pieces of threshold determination information indicating whether or not the threshold defined by each threshold information has been exceeded.

The information on the cumulative printing surface count TP is information indicating the number of surfaces printed after the print head 3 is assembled to the liquid ejecting apparatus 1 and is stored in storage regions M1 to M6 of the memory 200. Here, the number of printing surfaces is the number of surfaces of the medium P where an image is formed with ink ejected from the ejecting portion 600 of the print head 3, is counted as "2" in a case where, for example, an image has been formed by the liquid ejecting apparatus 1 ejecting ink with respect to both surfaces of the medium P, and is counted as "1" in a case where, for example, printing has been performed by the liquid ejecting apparatus 1 allocating two pages included in the image data signal IMG with respect to one surface of the medium P.

Of the information on the cumulative printing surface count TP stored in the memory 200, cumulative printing surface count first threshold information TPth1 as a piece of the threshold information of the cumulative printing surface count TP is stored in the storage region M1. The cumulative printing surface count first threshold information TPth1 is set to, for example, "1". In other words, in a case where the print head 3 has ejected ink at least once with respect to the medium P, the cumulative printing surface count TP exceeds the cumulative printing surface count first threshold information TPth1. The cumulative printing surface count first threshold information TPth1 is also threshold information for determining whether or not the print head 3 has a use history.

Of the information on the cumulative printing surface count TP stored in the memory 200, cumulative printing surface count second threshold information TPth2 as a piece of the threshold information of the cumulative printing surface count TP is stored in the storage region M2. In addition, of the information on the cumulative printing surface count TP stored in the memory 200, cumulative printing surface count third threshold information TPth3 as a piece of the threshold information of the cumulative printing surface count TP is stored in the storage region M3. Here, the value of the cumulative printing surface count second threshold information TPth2 stored in the memory 200 is larger than the value of the cumulative printing surface count first threshold information TPth1 and smaller than the value of the cumulative printing surface count third threshold information TPth3.

The cumulative printing surface count third threshold information TPth3 is threshold information for determining whether or not the print head 3 can be recycled or reused. In other words, a case where the cumulative printing surface count TP indicating the number of surfaces printed after the print head 3 is assembled to the liquid ejecting apparatus 1 exceeds the cumulative printing surface count third threshold information TPth3 means that the print head 3 is not suitable for recycle or reuse.

The cumulative printing surface count second threshold information TPth2 is threshold information for dividing the state of the print head 3 to be recycled or reused. The ejection state in the print head 3 greatly fluctuates in an initial state and becomes stable after a predetermined number of ejections. In this regard, by using the cumulative printing surface count second threshold information TPth2 as the threshold information for dividing whether or not the ejection state of the print head 3 is stable, it is possible to divide the operation of the print head 3, such as whether or not to perform the processing of correcting the fluctuating ejection characteristic, in a case where the liquid ejecting apparatus 1 drives the print head 3. As a result, it is possible to stabilize the ink ejection state in the liquid ejecting apparatus 1 including the print head 3 to be recycled or reused.

In addition, the cumulative printing surface count second threshold information TPth2 may be threshold information indicating whether or not the number of surfaces printed until the cumulative printing surface count TP reaches the threshold information defined by the cumulative printing surface count third threshold information TPth3 is equal to or greater than a predetermined printing surface count. As a result, it is possible to estimate the remaining service life of each portion of the print head 3 to be recycled or reused. Accordingly, the print head 3 to be recycled or reused can be selected in accordance with the applications of the liquid ejecting apparatus 1 incorporating the print head 3 and it is possible to improve user convenience, reduce the amount of the print heads 3 to be discarded, and further reduce the environmental load as a result.

Of the information on the cumulative printing surface count TP stored in the memory 200, a cumulative printing surface count first flag TPf1 as a piece of the threshold determination information of the cumulative printing surface count TP is stored in the storage region M4. Further, the cumulative printing surface count first flag TPf1 is rewritten in a case where the cumulative printing surface count TP exceeds the cumulative printing surface count first threshold information TPth1 with ink ejected from the ejecting portion 600 of the print head 3. Likewise, of the information on the cumulative printing surface count TP stored in the memory 200, a cumulative printing surface count second flag TPf2 as a piece of the threshold determination information of the cumulative printing surface count TP is stored in the storage region M5. Further, the cumulative printing surface count second flag TPf2 is rewritten in a case where the cumulative printing surface count TP exceeds the cumulative printing surface count second threshold information TPth2 with ink ejected from the ejecting portion 600 of the print head 3. Likewise, of the information on the cumulative printing surface count TP stored in the memory 200, a cumulative printing surface count third flag TPf3 as a piece of the threshold determination information of the cumulative printing surface count TP is stored in the storage region M6. Further, the cumulative printing surface count third flag TPf3 is rewritten in a case where the cumulative printing surface count TP exceeds the cumulative printing surface count third threshold information TPth3 with ink ejected from the ejecting portion 600 of the print head 3.

Here, the state where ink is ejected from the ejecting portion 600 of the print head 3 is an example of a predetermined operation state, the cumulative printing surface count first threshold information TPth1 is an example of a first threshold, the cumulative printing surface count third threshold information TPth3 is an example of a second threshold, and the cumulative printing surface count second threshold information TPth2 is an example of a third threshold. In other words, the print head 3 stores a threshold corresponding to the cumulative printing surface count TP of the medium P where ink has been ejected by the ejecting portion 600 since the assembly of the print head 3 to the liquid ejecting apparatus 1. In addition, the storage region M4 storing the cumulative printing surface count first flag TPf1 rewritten in a case where the cumulative printing surface count first threshold information TPth1 is exceeded is an example of a first memory region, the storage region M6 storing the cumulative printing surface count third flag TPf3 rewritten in a case where the cumulative printing surface count third threshold information TPth3 is exceeded is an example of a second memory region, and the storage region M5 storing the cumulative printing surface count second flag TPf2 rewritten in a case where the cumulative printing surface count second threshold information TPth2 is exceeded is an example of a third memory region.

The information on the elapsed day count LD is information indicating the number of days that have elapsed since the assembly of the print head 3 to the liquid ejecting apparatus 1 and is stored in storage regions M7 to M12 of the memory 200. Here, the information on the elapsed day count LD may be calculated based on the elapsed time information YMD measured by the time measurement circuit 83 with the print head 3 assembled in the liquid ejecting apparatus 1 or may be calculated based on date and time information stored in a storage portion (not illustrated) and date information input from an external device such as a host computer with the storage portion storing the date and time of the assembly of the print head 3 to the liquid ejecting apparatus 1.

Of the information on the elapsed day count LD stored in the memory 200, elapsed day count first threshold information LDth1 as a piece of the threshold information of the elapsed day count LD is stored in the storage region M7. The elapsed day count first threshold information LDth1 is set to, for example, "1". In other words, in a case where one or more days have elapsed since the assembly of the print head 3 to the liquid ejecting apparatus 1, the elapsed day count LD exceeds the elapsed day count first threshold information LDth1. The elapsed day count first threshold information LDth1 is also threshold information for determining whether or not the print head 3 has a use history.

Of the information on the elapsed day count LD stored in the memory 200, elapsed day count second threshold information LDth2 as a piece of the threshold information of the elapsed day count LD is stored in the storage region M8. In addition, of the information on the elapsed day count LD stored in the memory 200, elapsed day count third threshold information LDth3 as a piece of the threshold information of the elapsed day count LD is stored in the storage region M9. Here, the value of the elapsed day count second threshold information LDth2 stored in the memory 200 is larger than the value of the elapsed day count first threshold information LDth1 and smaller than the value of the elapsed day count third threshold information LDth3.

The elapsed day count third threshold information LDth3 is threshold information for determining whether or not the print head 3 can be recycled or reused. In other words, a case where the elapsed day count LD indicating the number of days from the assembly of the print head 3 to the liquid ejecting apparatus 1 exceeds the elapsed day count third threshold information LDth3 means that the print head 3 is not suitable for recycle or reuse.

The elapsed day count second threshold information LDth2 is threshold information for dividing the state of the print head 3 to be recycled or reused. For example, the elapsed day count second threshold information LDth2 may be threshold information indicating whether or not the number of days until the elapsed day count LD reaches the threshold information defined by the elapsed day count third threshold information LDth3 is equal to or greater than a predetermined number of days. As a result, the remaining service life of the print head 3 to be recycled or reused can be grasped in detail. Accordingly, the print head 3 to be recycled or reused can be selected in accordance with the applications of the liquid ejecting apparatus 1 incorporating the print head 3 and it is possible to improve user convenience, reduce the amount of the print heads 3 to be discarded, and further reduce the environmental load.

An elapsed day count first flag LDf1 is stored in the storage region M10. Further, the elapsed day count first flag LDf1 is rewritten in a case where the elapsed day count LD exceeds the elapsed day count first threshold information LDth1 with the print head 3 assembled in the liquid ejecting apparatus 1. Likewise, an elapsed day count second flag LDf2 is stored in the storage region M11. Further, the elapsed day count second flag LDf2 is rewritten in a case where the elapsed day count LD exceeds the elapsed day count second threshold information LDth2 with the print head 3 assembled in the liquid ejecting apparatus 1. Likewise, an elapsed day count third flag LDf3 is stored in the storage region M12. Further, the elapsed day count third flag LDf3 is rewritten in a case where the elapsed day count LD exceeds the elapsed day count third threshold information LDth3 with the print head 3 assembled in the liquid ejecting apparatus 1.

Here, the state where the print head 3 is assembled in the liquid ejecting apparatus 1 is another example of the predetermined operation state, the elapsed day count first threshold information LDth1 is another example of the first threshold, the elapsed day count third threshold information LDth3 is another example of the second threshold, and the elapsed day count second threshold information LDth2 is another example of the third threshold. In other words, the print head 3 stores a threshold corresponding to the elapsed day count LD since the assembly of the print head 3 to the liquid ejecting apparatus 1. In addition, the storage region M10 storing the elapsed day count first flag LDf1 rewritten in a case where the elapsed day count first threshold information LDth1 is exceeded is another example of the first memory region, the storage region M12 storing the elapsed day count third flag LDf3 rewritten in a case where the elapsed day count third threshold information LDth3 is exceeded is another example of the second memory region, and the storage region M11 storing the elapsed day count second flag LDf2 rewritten in a case where the elapsed day count second threshold information LDth2 is exceeded is another example of the third memory region.

The information on the error count EC is information indicating the number of errors that have occurred in the print head 3 and the liquid ejecting apparatus 1 since the assembly of the print head 3 to the liquid ejecting apparatus 1 and is stored in storage regions M13 to M18 of the memory 200. Here, the information on the error count EC is information indicating a state where an error has occurred in the print head and specifically includes, for example, an ejecting portion abnormality in which no ink is ejected from the nozzle 651 in the ejecting portion 600, overvoltage and overcurrent abnormalities in the print head 3, and a transport abnormality in which the medium P is not transported normally. Further, the error count EC is calculated based on, for example, the ejecting portion state signal DI based on the residual vibration signal NVT output from the ejecting portion state determination circuit 73 described above, the medium transport error signal ERR1 output from the medium transport error detection circuit 58, and signals output from overvoltage and overcurrent detection circuits (not illustrated) and indicating the presence or absence of overvoltage and overcurrent abnormalities.

Of the information on the error count EC stored in the memory 200, error count first threshold information ECth1 as a piece of the threshold information of the error count EC is stored in the storage region M13. The error count first threshold information ECth1 is set to, for example, "1". In other words, in a case where an error has occurred once or more since the assembly of the print head 3 to the liquid ejecting apparatus 1, the error count EC exceeds the error count first threshold information ECth1. The error count first threshold information ECth1 is also threshold information for determining whether or not the print head 3 has a use history.

Of the information on the error count EC stored in the memory 200, error count second threshold information ECth2 as a piece of the threshold information of the error count EC is stored in the storage region M14. In addition, of the information on the error count EC stored in the memory 200, error count third threshold information ECth3 as a piece of the threshold information of the error count EC is stored in the storage region M15. Here, the value of the error count second threshold information ECth2 stored in the memory 200 is larger than the value of the error count first threshold information ECth1 and smaller than the value of the error count third threshold information ECth3.

The error count third threshold information ECth3 is threshold information for determining whether or not the print head 3 can be recycled or reused. In other words, a case where the error count EC indicating the number of errors that have occurred since the assembly of the print head 3 to the liquid ejecting apparatus 1 exceeds the error count third threshold information ECth3 means that the print head 3 is not suitable for recycle or reuse.

The error count second threshold information ECth2 is threshold information for dividing the state of the print head 3 to be recycled or reused. For example, the error count second threshold information ECth2 may be threshold information indicating whether or not the number of errors until the error count EC reaches the threshold information defined by the error count third threshold information ECth3 is equal to or greater than a predetermined number. As a result, the remaining service life of the print head 3 to be recycled or reused can be grasped in detail. Accordingly, the print head 3 to be recycled or reused can be selected in accordance with the applications of the liquid ejecting apparatus 1 incorporating the print head 3 and it is possible to improve user convenience, reduce the amount of the print heads 3 to be discarded, and further reduce the environmental load.

An error count first flag ECf1 is stored in the storage region M16. Further, the error count first flag ECf1 is rewritten in a case where the error count EC in the print head 3 exceeds the error count first threshold information ECth1 with the print head 3 assembled in the liquid ejecting apparatus 1. Likewise, an error count second flag ECf2 is stored in the storage region M17. Further, the error count second flag ECf2 is rewritten in a case where the error count EC in the print head 3 exceeds the error count second threshold information ECth2 with the print head 3 assembled in the liquid ejecting apparatus 1. Likewise, an error count third flag ECf3 is stored in the storage region M18. Further, the error count third flag ECf3 is rewritten in a case where the error count EC in the print head 3 exceeds the error count third threshold information ECth3 with the print head 3 assembled in the liquid ejecting apparatus 1.

Here, the state where an error has occurred in the print head 3 assembled in the liquid ejecting apparatus 1 is another example of the predetermined operation state, the error count first threshold information ECth1 is another example of the first threshold, the error count third threshold information ECth3 is another example of the second threshold, and the error count second threshold information ECth2 is another example of the third threshold. In other words, the print head 3 stores a threshold corresponding to the error count EC in the print head 3 since the assembly of the print head 3 to the liquid ejecting apparatus 1. In addition, the storage region M16 storing the error count first flag ECf1 rewritten in a case where the error count first threshold information ECth1 is exceeded is another example of the first memory region, the storage region M18 storing the error count third flag ECf3 rewritten in a case where the error count third threshold information ECth3 is exceeded is another example of the second memory region, and the storage region M17 storing the error count second flag ECf2 rewritten in a case where the error count second threshold information ECth2 is exceeded is another example of the third memory region.

The information on the transport error count CEC is information indicating the number of errors that have occurred during the transport of the medium P after the assembly of the print head 3 to the liquid ejecting apparatus 1 and is stored in storage regions M19 to M24 of the memory 200. Here, the information on the transport error count CEC is information indicating a state where a transport error has occurred in the medium P transported to the print head 3 and specifically includes, for example, a so-called jam that occurs after the assembly of the print head 3 to the liquid ejecting apparatus 1 and in which the medium P cannot be normally supplied or discharged in the medium transport mechanism 5. Further, the transport error count CEC is calculated based on the medium transport error signal ERR1 output from the medium transport error detection circuit 58 described above.

In the case of the so-called jam or the like in which the medium P cannot be normally supplied or discharged in the medium transport mechanism 5, the medium P comes into contact with the nozzle surface 652 of the print head 3 and the nozzle 651 may be damaged as a result. Accordingly, in the print head 3 to be recycled or reused, it is possible to enhance the precision of determination as to whether the print head 3 can be recycled or reused by individually storing the information on the transport error count CEC.

Of the information on the transport error count CEC stored in the memory 200, transport error count first threshold information CECth1 as a piece of the threshold information of the transport error count CEC is stored in the storage region M19. The transport error count first threshold information CECth1 is set to, for example, "1". In other words, in a case where a transport error has occurred once or more since the assembly of the print head 3 to the liquid ejecting apparatus 1, the transport error count CEC exceeds the transport error count first threshold information CECth1. The transport error count first threshold information CECth1 is also threshold information for determining whether or not the print head 3 has a use history.

Of the information on the transport error count CEC stored in the memory 200, transport error count second threshold information CECth2 as a piece of the threshold information of the transport error count CEC is stored in the storage region M20. In addition, of the information on the transport error count CEC stored in the memory 200, transport error count third threshold information CECth3 as a piece of the threshold information of the transport error count CEC is stored in the storage region M21. Here, the value of the transport error count second threshold information CECth2 stored in the memory 200 is larger than the value of the transport error count first threshold information CECth1 and smaller than the value of the transport error count third threshold information CECth3.

The transport error count third threshold information CECth3 is threshold information for determining whether or not the print head 3 can be recycled or reused. In other words, a case where the transport error count CEC indicating the number of transport errors that have occurred since the assembly of the print head 3 to the liquid ejecting apparatus 1 exceeds the transport error count third threshold information CECth3 means that the print head 3 is not suitable for recycle or reuse.

The transport error count second threshold information CECth2 is threshold information for dividing the state of the print head 3 to be recycled or reused. For example, the transport error count second threshold information CECth2 may be threshold information indicating whether or not the number of transport errors until the transport error count CEC reaches the threshold information defined by the transport error count third threshold information CECth3 is equal to or greater than a predetermined number. As a result, the remaining service life of the print head 3 to be recycled or reused can be grasped in detail. Accordingly, the print head 3 to be recycled or reused can be selected in accordance with the applications of the liquid ejecting apparatus 1 incorporating the print head 3 and it is possible to improve user convenience, reduce the amount of the print heads 3 to be discarded, and further reduce the environmental load.

A transport error count first flag CECf1 is stored in the storage region M22. Further, the transport error count first flag CECf1 is rewritten in a case where the transport error count CEC of the medium P in the medium transport mechanism 5 exceeds the transport error count first threshold information CECth1 with the print head 3 assembled in the liquid ejecting apparatus 1. Likewise, a transport error count second flag CECf2 is stored in the storage region M23. Further, the transport error count second flag CECf2 is rewritten in a case where the transport error count CEC of the medium P in the medium transport mechanism 5 exceeds the transport error count second threshold information CECth2 with the print head 3 assembled in the liquid ejecting apparatus 1. Likewise, a transport error count third flag CECf3 is stored in the storage region M24. Further, the transport error count third flag CECf3 is rewritten in a case where the transport error count CEC of the medium P in the medium transport mechanism 5 exceeds the transport error count third threshold information CECth3 with the print head 3 assembled in the liquid ejecting apparatus 1.

Here, the state where a transport error of the medium P has occurred in the medium transport mechanism 5 with the print head 3 assembled in the liquid ejecting apparatus 1 is another example of the predetermined operation state, the transport error count first threshold information CECth1 is another example of the first threshold, the transport error count third threshold information CECth3 is another example of the second threshold, and the transport error count second threshold information CECth2 is another example of the third threshold. In other words, the print head 3 stores a threshold corresponding to the transport error count CEC since the assembly of the print head 3 to the liquid ejecting apparatus 1. In addition, the storage region M22 storing the transport error count first flag CECf1 rewritten in a case where the transport error count first threshold information CECth1 is exceeded is another example of the first memory region, the storage region M24 storing the transport error count third flag CECf3 rewritten in a case where the transport error count third threshold information CECth3 is exceeded is another example of the second memory region, and the storage region M23 storing the transport error count second flag CECf2 rewritten in a case where the transport error count second threshold information CECth2 is exceeded is another example of the third memory region.

The information on the capping processing count CP is information indicating how many times the capping processing of attaching a cap to the nozzle surface 652 where the nozzle 651 is formed in order to reduce a change in the characteristics of the ink stored in the print head 3 has been executed and is stored in storage regions M25 to M30 of the memory 200. In other words, the information on the capping processing count CP is information indicating the state of execution of the capping processing where the cap is attached to the nozzle and is calculated based on how many times the capping processing of attaching the cap to the nozzle surface 652 has been executed since the assembly of the print head 3 to the liquid ejecting apparatus 1.

In such capping processing, the cap comes into contact with the nozzle surface 652 of the print head 3, and thus the nozzle 651 may be damaged by the cap. Accordingly, in the print head 3 to be recycled or reused, it is possible to enhance the precision of determination as to whether the print head 3 can be recycled or reused by individually storing the information on the capping processing count CP.

Of the information on the capping processing count CP stored in the memory 200, capping processing count first threshold information CPth1 as a piece of the threshold information of the capping processing count CP is stored in the storage region M25. The capping processing count first threshold information CPth1 is set to, for example, "1". In other words, in a case where the capping processing has been executed once or more since the assembly of the print head 3 to the liquid ejecting apparatus 1, the capping processing count CP exceeds the capping processing count first threshold information CPth1. The capping processing count first threshold information CPth1 is also threshold information for determining whether or not the print head 3 has a use history.

Of the information on the capping processing count CP stored in the memory 200, capping processing count second threshold information CPth2 as a piece of the threshold information of the capping processing count CP is stored in the storage region M26. In addition, of the information on the capping processing count CP stored in the memory 200, capping processing count third threshold information CPth3 as a piece of the threshold information of the capping processing count CP is stored in the storage region M27. Here, the value of the capping processing count second threshold information CPth2 stored in the memory 200 is larger than the value of the capping processing count first threshold information CPth1 and smaller than the value of the capping processing count third threshold information CPth3.

The capping processing count third threshold information CPth3 is threshold information for determining whether or not the print head 3 can be recycled or reused. In other words, a case where the capping processing count CP indicating the number of times of the capping processing that has been executed since the assembly of the print head to the liquid ejecting apparatus 1 exceeds the capping processing count third threshold information CPth3 means that the print head 3 is not suitable for recycle or reuse.

The capping processing count second threshold information CPth2 is threshold information for dividing the state of the print head 3 to be recycled or reused. For example, the capping processing count second threshold information CPth2 may be threshold information indicating whether or not the number of times of the capping processing until the capping processing count CP reaches the threshold information defined by the capping processing count third threshold information CPth3 is equal to or greater than a predetermined number. As a result, the remaining service life of the print head 3 to be recycled or reused can be grasped in detail. Accordingly, the print head 3 to be recycled or reused can be selected in accordance with the applications of the liquid ejecting apparatus 1 incorporating the print head 3 and it is possible to improve user convenience, reduce the amount of the print heads 3 to be discarded, and further reduce the environmental load.

A capping processing count first flag CPf1 is stored in the storage region M28. Further, the capping processing count first flag CPf1 is rewritten in a case where the capping processing count CP indicating how many times the capping processing has been executed exceeds the capping processing count first threshold information CPth1 with the print head 3 assembled in the liquid ejecting apparatus 1. Likewise, a capping processing count second flag CPf2 is stored in the storage region M29. Further, the capping processing count second flag CPf2 is rewritten in a case where the capping processing count CP indicating how many times the capping processing has been executed exceeds the capping processing count second threshold information CPth2 with the print head 3 assembled in the liquid ejecting apparatus 1. Likewise, a capping processing count third flag CPf3 is stored in the storage region M30. Further, the capping processing count third flag CPf3 is rewritten in a case where the capping processing count CP indicating how many times the capping processing has been executed exceeds the capping processing count third threshold information CPth3 with the print head 3 assembled in the liquid ejecting apparatus 1.

Here, the state where the capping processing has been executed with the print head 3 assembled in the liquid ejecting apparatus 1 is another example of the predetermined operation state, the capping processing count first threshold information CPth1 is another example of the first threshold, the capping processing count third threshold information CPth3 is another example of the second threshold, and the capping processing count second threshold information CPth2 is another example of the third threshold. In other words, the print head 3 stores a threshold corresponding to the capping processing count CP since the assembly of the print head 3 to the liquid ejecting apparatus 1. In addition, the storage region M28 storing the capping processing count first flag CPf1 rewritten in a case where the capping processing count first threshold information CPth1 is exceeded is another example of the first memory region, the storage region M30 storing the capping processing count third flag CPf3 rewritten in a case where the capping processing count third threshold information CPth3 is exceeded is another example of the second memory region, and the storage region M29 storing the capping processing count second flag CPf2 rewritten in a case where the capping processing count second threshold information CPth2 is exceeded is another example of the third memory region.

The information on the cleaning processing count CL is information indicating how many times cleaning processing for normally ejecting ink from the print head 3, examples of which include the wiping processing for removing a paper piece or the like attached to the nozzle surface 652 of the print head 3 and the flushing processing for maintaining the viscosity of the ink stored in the print head 3 in an appropriate range, has been executed and is stored in storage regions M31 to M36 of the memory 200. In other words, the information on the cleaning processing count CL is information indicating a state where the cleaning processing is executed on the ejecting portion 600 and is calculated based on the numbers of times of the wiping processing and the flushing processing that have been executed on the print head 3 since the assembly of the print head 3 to the liquid ejecting apparatus 1.

Of the information on the cleaning processing count CL stored in the memory 200, cleaning processing count first threshold information CLth1 as a piece of the threshold information of the cleaning processing count CL is stored in the storage region M31. The cleaning processing count first threshold information CLth1 is set to, for example, "1". In other words, in a case where the cleaning processing has been executed once or more since the assembly of the print head 3 to the liquid ejecting apparatus 1, the cleaning processing count CL exceeds the cleaning processing count first threshold information CLth1. The cleaning processing count first threshold information CLth1 is also threshold information for determining whether or not the print head 3 has a use history.

Of the information on the cleaning processing count CL stored in the memory 200, cleaning processing count second threshold information CLth2 as a piece of the threshold information of the cleaning processing count CL is stored in the storage region M32. In addition, of the information on the cleaning processing count CL stored in the memory 200, cleaning processing count third threshold information CLth3 as a piece of the threshold information of the cleaning processing count CL is stored in the storage region M33. Here, the value of the cleaning processing count second threshold information CLth2 stored in the memory 200 is larger than the value of the cleaning processing count first threshold information CLth1 and smaller than the value of the cleaning processing count third threshold information CLth3.

The cleaning processing count third threshold information CLth3 is threshold information for determining whether or not the print head 3 can be recycled or reused. In other words, a case where the cleaning processing count CL after the assembly of the print head 3 to the liquid ejecting apparatus 1 exceeds the cleaning processing count third threshold information CLth3 means that the print head 3 is not suitable for recycle or reuse.

The cleaning processing count second threshold information CLth2 is threshold information for dividing the state of the print head 3 to be recycled or reused. For example, the cleaning processing count second threshold information CLth2 may be threshold information indicating whether or not the number of times of the cleaning processing until the cleaning processing count CL reaches the threshold information defined by the cleaning processing count third threshold information CLth3 is equal to or greater than a predetermined number. As a result, the remaining service life of the print head 3 to be recycled or reused can be grasped in detail. Accordingly, the print head 3 to be recycled or reused can be selected in accordance with the applications of the liquid ejecting apparatus 1 incorporating the print head 3 and it is possible to improve user convenience, reduce the amount of the print heads 3 to be discarded, and further reduce the environmental load.

A cleaning processing count first flag CLf1 is stored in the storage region M34. Further, the cleaning processing count first flag CLf1 is rewritten in a case where the number of times of the cleaning processing executed on the print head 3 exceeds the cleaning processing count first threshold information CLth1 with the print head 3 assembled in the liquid ejecting apparatus 1. Likewise, a cleaning processing count second flag CLf2 is stored in the storage region M35. Further, the cleaning processing count second flag CLf2 is rewritten in a case where the number of times of the cleaning processing executed on the print head exceeds the cleaning processing count second threshold information CLth2 with the print head 3 assembled in the liquid ejecting apparatus 1. Likewise, a cleaning processing count third flag CLf3 is stored in the storage region M36. Further, the cleaning processing count third flag CLf3 is rewritten in a case where the number of times of the cleaning processing executed on the print head 3 exceeds the cleaning processing count third threshold information CLth3 with the print head 3 assembled in the liquid ejecting apparatus 1.

Here, the state where the cleaning processing has been executed with the print head 3 assembled in the liquid ejecting apparatus 1 is another example of the predetermined operation state, the cleaning processing count first threshold information CLth1 is another example of the first threshold, the cleaning processing count third threshold information CLth3 is another example of the second threshold, and the cleaning processing count second threshold information CLth2 is another example of the third threshold. In other words, the print head 3 stores a threshold corresponding to the cleaning processing count OL since the assembly of the print head 3 to the liquid ejecting apparatus 1. Further, the storage region M34 storing the cleaning processing count first flag CLf1 rewritten in a case where the cleaning processing count first threshold information CLth1 is exceeded is another example of the first memory region, the storage region M36 storing the cleaning processing count third flag CLf3 rewritten in a case where the cleaning processing count third threshold information CLth3 is exceeded is another example of the second memory region, and the storage region M35 storing the cleaning processing count second flag CLf2 rewritten in a case where the cleaning processing count second threshold information CLth2 is exceeded is another example of the third memory region.

The information on the wiping processing count WP is information indicating how many times the wiping processing for removing a paper piece or the like attached to the nozzle surface 652 of the print head 3 has been executed and is stored in storage regions M37 to M42 of the memory 200. In other words, the information on the wiping processing count WP includes information indicating the state of execution of the wiping processing of wiping the nozzle surface 652 provided with the nozzle 651 where ink is ejected from the ejecting portion 600. Here, the information on the wiping processing count WP is calculated based on how many times the wiping processing has been executed since the assembly of the print head 3 to the liquid ejecting apparatus 1. During the wiping processing, the nozzle surface 652 of the print head 3 is directly wiped, and thus the nozzle 651 may be damaged. Accordingly, in the print head 3 to be recycled or reused, it is possible to enhance the precision of determination as to whether the print head 3 can be recycled or reused by individually storing the information on the wiping processing count WP.

Of the information on the wiping processing count WP stored in the memory 200, wiping processing count first threshold information WPth1 as a piece of the threshold information of the wiping processing count WP is stored in the storage region M37. The wiping processing count first threshold information WPth1 is set to, for example, "1". In other words, in a case where the wiping processing has been executed once or more since the assembly of the print head 3 to the liquid ejecting apparatus 1, the wiping processing count WP exceeds the wiping processing count first threshold information WPth1. The wiping processing count first threshold information WPth1 is also threshold information for determining whether or not the print head 3 has a use history.

Of the information on the wiping processing count WP stored in the memory 200, wiping processing count second threshold information WPth2 as a piece of the threshold information of the wiping processing count WP is stored in the storage region M38. In addition, of the information on the wiping processing count WP stored in the memory 200, wiping processing count third threshold information WPth3 as a piece of the threshold information of the wiping processing count WP is stored in the storage region M39. Here, the value of the wiping processing count second threshold information WPth2 stored in the memory 200 is larger than the value of the wiping processing count first threshold information WPth1 and smaller than the value of the wiping processing count third threshold information WPth3.

The wiping processing count third threshold information WPth3 is threshold information for determining whether or not the print head 3 can be recycled or reused. In other words, a case where the wiping processing count WP indicating the number of times of the wiping processing that has been executed since the assembly of the print head 3 to the liquid ejecting apparatus 1 exceeds the wiping processing count third threshold information WPth3 means that the print head 3 is not suitable for recycle or reuse.

The wiping processing count second threshold information WPth2 is threshold information for dividing the state of the print head 3 to be recycled or reused. For example, the wiping processing count second threshold information WPth2 may be threshold information indicating whether or not the number of times of the wiping processing until the wiping processing count WP reaches the threshold information defined by the wiping processing count third threshold information WPth3 is equal to or greater than a predetermined number. As a result, the remaining service life of the print head 3 to be recycled or reused can be grasped in detail. Accordingly, the print head 3 to be recycled or reused can be selected in accordance with the applications of the liquid ejecting apparatus 1 incorporating the print head 3 and it is possible to improve user convenience, reduce the amount of the print heads 3 to be discarded, and further reduce the environmental load.

A wiping processing count first flag WPf1 is stored in the storage region M40. Further, the wiping processing count first flag WPf1 is rewritten in a case where the wiping processing count WP indicating how many times the wiping processing has been executed exceeds the wiping processing count first threshold information WPth1 with the print head 3 assembled in the liquid ejecting apparatus 1. Likewise, a wiping processing count second flag WPf2 is stored in the storage region M41. Further, the wiping processing count second flag WPf2 is rewritten in a case where the wiping processing count WP indicating how many times the wiping processing has been executed exceeds the wiping processing count second threshold information WPth2 with the print head 3 assembled in the liquid ejecting apparatus 1. Likewise, a wiping processing count third flag WPf3 is stored in the storage region M42. Further, the wiping processing count third flag WPf3 is rewritten in a case where the wiping processing count WP indicating how many times the wiping processing has been executed exceeds the wiping processing count third threshold information WPth3 with the print head 3 assembled in the liquid ejecting apparatus 1.

Here, the state where the wiping processing of wiping the nozzle surface 652 has been executed with the print head 3 assembled in the liquid ejecting apparatus 1 is another example of the predetermined operation state, the wiping processing count first threshold information WPth1 is another example of the first threshold, the wiping processing count third threshold information WPth3 is another example of the second threshold, and the wiping processing count second threshold information WPth2 is another example of the third threshold. In other words, the print head 3 stores a threshold corresponding to the wiping processing count WP since the assembly of the print head 3 to the liquid ejecting apparatus 1. In addition, the storage region M40 storing the wiping processing count first flag WPf1 rewritten in a case where the wiping processing count first threshold information WPth1 is exceeded is another example of the first memory region, the storage region M42 storing the wiping processing count third flag WPf3 rewritten in a case where the wiping processing count third threshold information WPth3 is exceeded is another example of the second memory region, and the storage region M41 storing the wiping processing count second flag WPf2 rewritten in a case where the wiping processing count second threshold information WPth2 is exceeded is another example of the third memory region.

1.4.2 Memory Control

Here, the three pieces of threshold information corresponding to each of the information on the cumulative printing surface count TP, the information on the elapsed day count LD, the information on the error count EC, the information on the transport error count CEC, the information on the capping processing count CP, the information on the cleaning processing count CL, and the information on the wiping processing count WP written in the memory 200 of the print head 3 and the three pieces of threshold determination information corresponding to each threshold information are read based on the latch signal LAT, the change signal CH, the clock signal SCK, and the memory control signals MC1 to MCn input from the print head control circuit 71. In other words, the memory 200 executes the reading processing in accordance with the input latch signal LAT, change signal CH, clock signal SCK, and memory control signals MC1 to MCn.

After the reading from the memory 200, the three pieces of threshold information corresponding to each of the information on the cumulative printing surface count TP, the information on the elapsed day count LD, the information on the error count EC, the information on the transport error count CEC, the information on the capping processing count CP, the information on the cleaning processing count CL, and the information on the wiping processing count WP and the three pieces of threshold determination information corresponding to each threshold information are input to the print head control circuit 71. Then, the print head control circuit 71 controls the operation of the print head 3 based on the read information.

In addition, the print head control circuit 71 counts how many times the predetermined operation states have occurred that respectively correspond to the information on the cumulative printing surface count TP, the information on the elapsed day count LD, the information on the error count EC, the information on the transport error count CEC, the information on the capping processing count CP, the information on the cleaning processing count CL, and the information on the wiping processing count WP. Then, in a case where a request for updating the threshold determination information stored in the memory 200 has been input, the print head control circuit 71 compares the three pieces of threshold information read from the memory 200 with how many times the operation states have occurred that respectively correspond to the information on the cumulative printing surface count TP, the information on the elapsed day count LD, the information on the error count EC, the information on the transport error count CEC, the information on the capping processing count CP, the information on the cleaning processing count CL, and the information on the wiping processing count WP, determines whether or not to rewrite the corresponding threshold determination information in accordance with the result of the comparison, and outputs the memory control signal MC corresponding to the result of the determination. Then, the memory 200 writes information corresponding to the memory control signal MC. In other words, the memory 200 executes the reading processing in accordance with the input latch signal LAT, change signal CH, clock signal SCK, and memory control signals MC1 to MCn.

Figure 22:
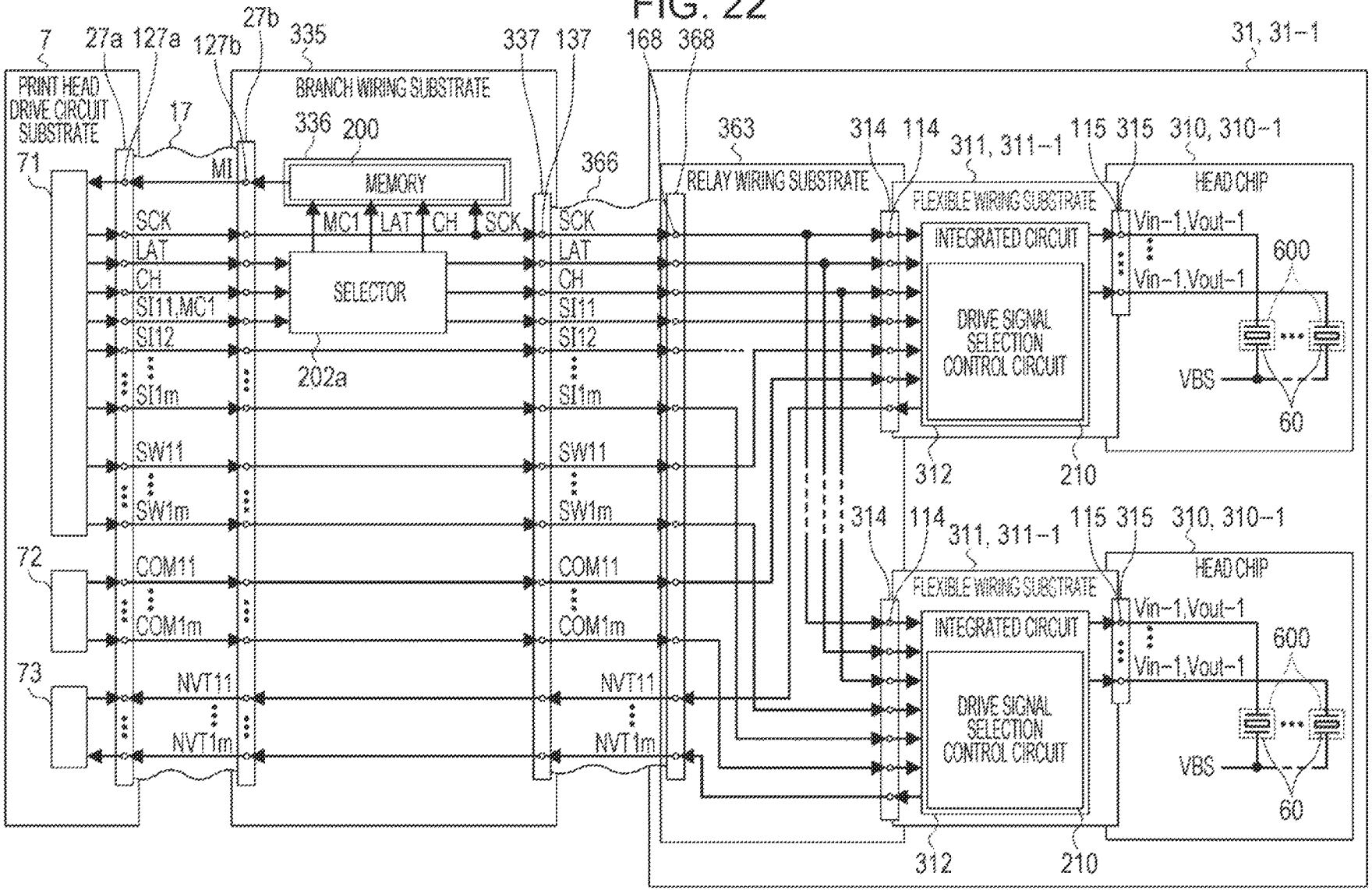
FIG. 22 is a functional configuration diagram for describing writing processing and reading processing with respect to a memory.
Figure 23:
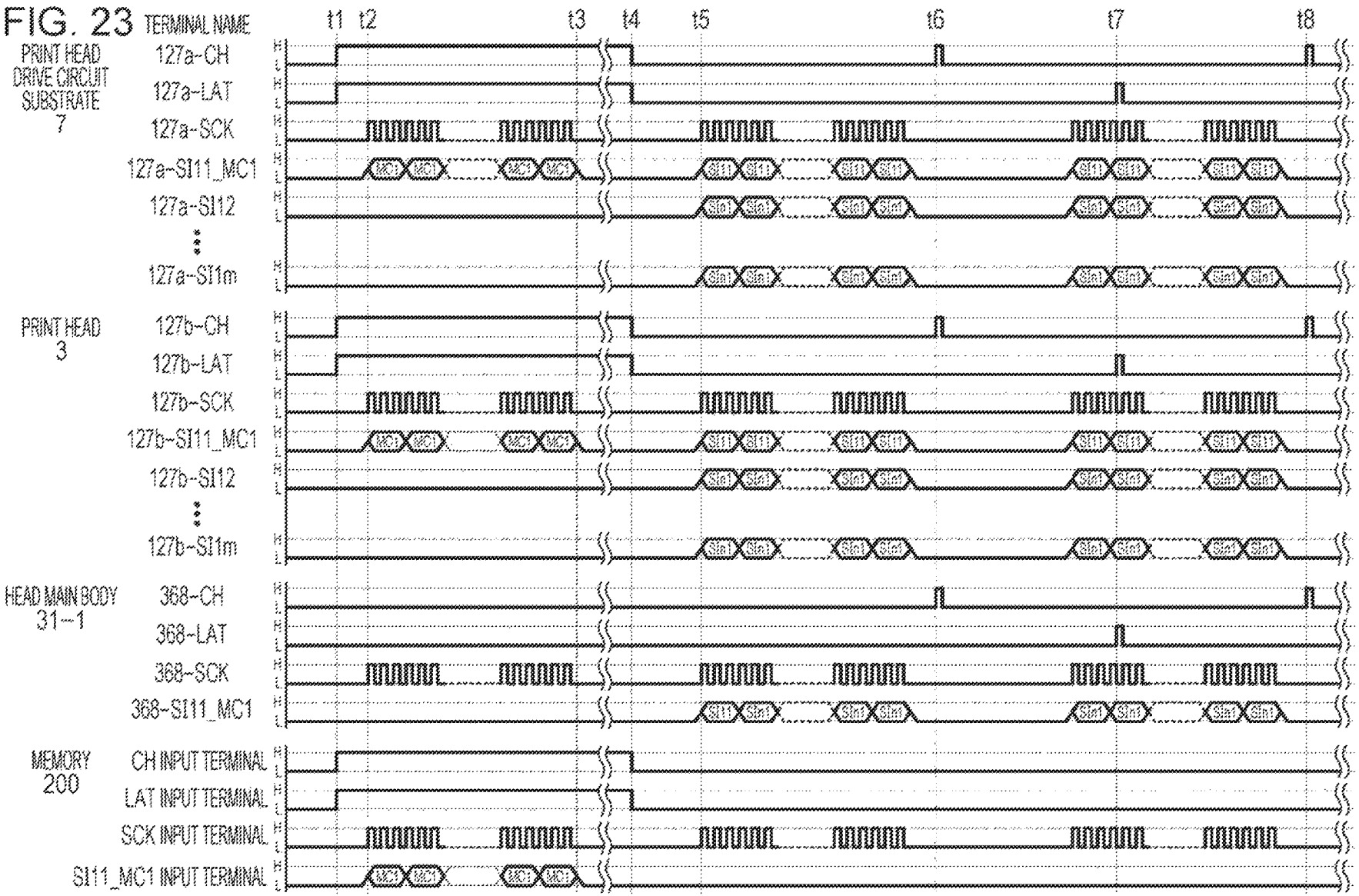
FIG. 23 is a timing chart diagram for describing the writing processing and the reading processing with respect to the memory.

Here, the relationship between the reading processing of reading each information from the memory 200 and the writing processing of writing each information to the memory 200 and the ejection control processing of ejecting ink from the print head 3 will be described. FIG. 22 is a functional configuration diagram for describing the writing processing and the reading processing with respect to the memory 200. FIG. 23 is a timing chart diagram for describing the writing processing and the reading processing with respect to the memory 200. Here, the writing processing and the reading processing performed with respect to the head main bodies 31-1 to **31-*n* included in the liquid ejecting apparatus 1 are the same. Accordingly, the writing processing and the reading processing with respect to the head main body 31-1 will be described below and the writing processing and the reading processing performed with respect to the head main bodies 31-2 to 31-*n*** will not be described.

In addition, in the following description, a case where the potential of each terminal included in the terminal groups included in the liquid ejecting apparatus 1 is an L-level potential will be referred to as an L-level state and a case where the potential of each terminal included in the terminal groups is an H-level potential will be referred to as an H-level state. Here, the case where the potential of each terminal included in the terminal groups is the L-level potential means a case where the potential of a signal input to each terminal group is lower than a predetermined threshold and the case where the potential of each terminal included in the terminal groups is the H-level potential means a case where the potential of a signal input to each terminal group is higher than the predetermined threshold. Accordingly, each terminal group being in the L-level state means a state where the potential of the terminal is lower than the predetermined threshold and each terminal group being in the H-level state means a state where the potential of the terminal is higher than the predetermined threshold. It should be noted that the predetermined threshold is defined by the use of the integrated circuits 336 and 312.

As illustrated in FIGS. 22 and 23, before time t1, the print head control circuit 71 outputs the L-level latch signal LAT, the change signal CH, the clock signal SCK, the printing data signals SI11 to SI**1*m*, and the memory control signal MC1. As a result, the L-level state is reached by each of the terminal 127*a*-LAT where the latch signal LAT propagates, which are included in the terminal group 27*a* provided on the print head drive circuit substrate 7, the terminal 127*a*-CH where the change signal CH propagates, the terminal 127*a*-SCK where the clock signal SCK propagates, the terminal 127*a*-SI11_MC1 where the printing data signal SI11 and the memory control signal MC1 propagate, and the terminals 127*a*-SI12 to 127*a*-SI1*m* where the printing data signals SI12 to SI1*m*** propagate.

Accordingly, the L-level state is also reached by each of the terminals **127*b*-LAT, 127*b*-CH, 127*b*-SCK, 127*b*-SI11_MC1, and 127*b*-SI12 to 127*b*-SI1*m* included in the terminal group 27*b* provided on the branch wiring substrate 335 of the print head 3, which are respectively and electrically coupled via the cable 17 to the terminals 127*a*-LAT, 127*a*-CH, 127*a*-SCK, 127*a*-SI11_MC1, and 127*a*-SI12 to 127*a*-SI1*m***.

In this case, the L-level latch signal LAT and the L-level change signal CH are input to the selector **202*a* via the terminals 127*b*-LAT and 127*b*-CH. Accordingly, the selector 202*a* outputs the input latch signal LAT, change signal CH, clock signal SCK, printing data signal SI11, and memory control signal MC1 to the terminal group 337. As a result, the L-level state is reached by each of the terminal 137-LAT where the latch signal LAT propagates, the terminal 137-CH where the change signal CH propagates, the terminal 137-SCK where the clock signal SCK propagates, and the terminal 137-SI11_MC1 where the printing data signal SI11 and the memory control signal MC1 propagate, which are included in the terminal group 337 provided on the branch wiring substrate 335. As a result, the L-level latch signal LAT, the change signal CH, the clock signal SCK, the printing data signal SI11, and the memory control signal MC1 are input to the drive signal selection control circuit 210 included in the integrated circuit 312 corresponding to the head chip 310-1 electrically coupled via the relay substrate 363 to each of the terminals 137-LAT, 137-CH, 137-SCK, and 137-SI11_MC1. As a result, the drive signal selection control circuit 210 does not execute the ejection control processing illustrated in FIGS. 11 to 18**.

Likewise, the L-level latch signal LAT, the change signal CH, the clock signal SCK, and the corresponding printing data signals SI12 to SI**1*m* are input to the drive signal selection control circuit 210 included in the integrated circuit 312 corresponding to the head chips 310-2 to 310-*m* electrically coupled via the relay substrate 363. As a result, the drive signal selection control circuit 210 included in the integrated circuit 312 corresponding to the head chips 310-2 to 310-*m*** does not execute the ejection control processing, either.

In addition, since the L-level latch signal LAT and the L-level change signal CH are input to the selector 202*a*, the latch signal LAT, the change signal CH, the printing data signal SI11, and the memory control signal MC1 are not input to the memory 200. Accordingly, in the memory 200 and before time t1, the LAT input terminal to which the latch signal LAT is input, the CH input terminal to which the change signal CH is input, and the SI11_MC1 input terminal to which the printing data signal SI11 and the memory control signal MC1 are input reach the L-level state. Further, since the clock signal SCK is at the L level as illustrated in FIG. 32, the SCK input terminal to which the clock signal SCK is input in the memory 200 also reaches the L level. As a result, the memory 200 does not execute the writing processing and the reading processing.

At time t1, the print head control circuit 71 outputs the H-level latch signal LAT and change signal CH and the L-level clock signal SCK, printing data signals SI11 to SI1*m*, and memory control signal MC1. As a result, the terminal 127*a*-LAT and the terminal 127*a*-CH reach the H-level state and each of the terminal 127*a*-SCK, the terminal 127*a*-SI11_MC1, and the terminals 127*a*-SI12 to 127*a*-SI1*m* remain in the L-level state.

Accordingly, the terminal 127*b*-LAT and the terminal 127*b*-CH respectively and electrically coupled via the cable to the terminals 127*a*-LAT, 127*a*-CH, 127*a*-SCK, 127*a*-SI11_MC1, and 127*a*-SI12 to 127*a*-SI1*m* reach the H-level state and each of the terminals 127*b*-SCK, 127*b*-SI11_MC1, and 127*b*-SI12 to 127*b*-SI1*m* reaches the L-level state.

In this case, the H-level latch signal LAT and the H-level change signal CH are input to the selector 202*a* via the terminals 127*b*-LAT and 127*b*-CH. Accordingly, the selector 202*a* outputs the input latch signal LAT, change signal CH, clock signal SCK, printing data signal SI11, and memory control signal MC1 to the memory 200.

In other words, the selector 202*a* does not output the input latch signal LAT, change signal CH, clock signal SCK, printing data signal SI11, and memory control signal MC1 to the terminal group 337. As a result, each of the terminals 137-LAT, 137-CH, 137-SCK, and 137-SI11_MC1 included in the terminal group 337 provided on the branch wiring substrate 335 reaches the L-level state. As a result, the L-level latch signal LAT, the change signal CH, the clock signal SCK, the printing data signal SI11, and the memory control signal MC1 are input to the drive signal selection control circuit 210 included in the integrated circuit 312 corresponding to the head chip 310-1 electrically coupled via the relay substrate 363 to each of the terminals 137-LAT, 137-CH, 137-SCK, and 137-SI11_MC1. As a result, the drive signal selection control circuit 210 does not execute the ejection control processing.

Likewise, the L-level latch signal LAT, the change signal CH, the clock signal SCK, and the corresponding printing data signals SI12 to SI1*m* are input to the drive signal selection control circuit 210 included in the integrated circuit 312 corresponding to the head chips 310-2 to 310-*m* electrically coupled via the relay substrate 363. As a result, the drive signal selection control circuit 210 included in the integrated circuit 312 corresponding to the head chips 310-2 to 310-*m* does not execute the ejection control processing, either.

In addition, since the H-level latch signal LAT and the H-level change signal CH are input to the selector 202*a*, the latch signal LAT, the change signal CH, the printing data signal SI11, and the memory control signal MC1 input to the selector 202*a* are input to the memory 200. Accordingly, in the memory 200 and at time t1, the LAT input terminal to which the latch signal LAT is input and the CH input terminal to which the change signal CH is input reach the H-level state. As a result, the memory 200 becomes capable of performing the writing processing and the reading processing in accordance with information based on the printing data signal SI11 and the memory control signal MC1.

In the period of time t2 to time t3, the print head control circuit 71 continues to output the H-level latch signal LAT and change signal CH and outputs the memory control signal MC1 including information for performing the writing processing and reading processing of the memory 200.

Here, since the memory control signal MC1 includes the information for performing the writing processing and the reading processing, switching occurs between the H- and L-level signals. In other words, in the period of time t2 to time t3, the latch signal LAT is input to the print head 3 as a signal for bringing the terminal 127*a*-LAT into the H-level state, the change signal CH is input to the print head 3 as a signal for bringing the terminal 127*a*-CH into the H-level state, and the memory control signal MC1 is input to the print head 3 as a signal for changing the terminal 127*a*-SI11_MC1 between the H- and L-level states.

In this case, the H-level latch signal LAT and change signal CH are input to the selector 202*a*. Accordingly, the selector 202*a* outputs, to the memory 200, the memory control signal MC1 including information for the memory 200 to perform the writing processing and reading processing. As a result, the memory 200 executes the writing processing and reading processing in accordance with the memory control signal MC1.

In addition, since the H-level latch signal LAT and the H-level change signal CH are input to the selector 202*a*, the selector 202*a* does not output the input latch signal LAT, change signal CH, clock signal SCK, printing data signal SI11, and memory control signal MC1 to the terminal group 337. As a result, each of the terminals 137-LAT, 137-CH, 137-SCK, and 137-SI11_MC1 included in the terminal group 337 provided on the branch wiring substrate 335 reaches the L-level state. As a result, the L-level latch signal LAT, the change signal CH, the clock signal SCK, the printing data signal SI11, and the memory control signal MC1 are input to the drive signal selection control circuit 210 included in the integrated circuit 312 corresponding to the head chip 310-1 electrically coupled via the relay substrate 363 to each of the terminals 137-LAT, 137-CH, 137-SCK, and 137-SI11_MC1. Accordingly, the drive signal selection control circuit 210 does not execute the ejection control processing.

As described above, in the period of time t2 to time t3, the print head 3 executes the reading processing of reading the information stored in the memory 200 and does not execute the ejection control processing of controlling whether or not to supply the drive signal COM to the plurality of ejecting portions 600 by switching between the transmission gates TGa, TGb, and TGc included in the drive signal selection control circuit 210 in accordance with the latch signal LAT, the change signal CH, and the memory control signal MC1. The operation mode of the print head 3 in the period of time t2 to t3 illustrated in FIG. 23 is an example of a first mode.

Subsequently, at time t4, the print head control circuit 71 sets the latch signal LAT and the change signal CH to the L level. In other words, the memory 200 ends the writing processing and reading processing in accordance with the information based on the printing data signal SI11 and the memory control signal MC1.

Then, at time t5, the print head control circuit 71 outputs the printing data signals SI11 to SI1*m*. In this case, the print head control circuit 71 outputs the L-level latch signal LAT and the change signal CH. In other words, the print head drive circuit including the print head control circuit 71 and the drive signal output circuit 72 outputs a signal for bringing the terminal 127*a*-LAT into the L-level state and a signal for bringing the terminal 127*a*-CH into the L-level state. Accordingly, the terminal 127*b*-LAT electrically coupled to the terminal 127*a*-LAT reaches the L-level state and the terminal 127*b*-CH electrically coupled to the terminal 127*a*-CH reaches the L-level state. As a result, the L-level latch signal LAT and change signal CH are input to the selector 202*a*. Accordingly, the selector 202*a* outputs the input printing data signal SI11 to the drive signal selection control circuit 210 included in the integrated circuit 312 corresponding to the head chip 310-1 electrically coupled via the branch wiring substrate 335 and the relay substrate 363. As a result and as described above, the printing data signal SI11 is held by the shift register SR included in the corresponding drive signal selection control circuit 210.

At time t6, the print head control circuit 71 outputs the H-level latch signal LAT and the L-level change signal CH. As a result, the printing data signals SI11 to SI1*m* held by the shift register SR included in the corresponding drive signal selection control circuit 210 are latched all at once. Then, the ejection control processing described with reference to FIGS. 11 to 18 is executed.

The print head control circuit 71 outputs at least one of the latch signal LAT and the change signal CH as the L level in the period of time t5 to time t8 when the ejection control processing is executed. In other words, in the period of time t5 to time t8, the print head drive circuit including the print head control circuit 71 and the drive signal output circuit 72 outputs the latch signal LAT and the change signal CH such that at least one of the terminal 127*a*-LAT and the terminal 127*a*-CH does not reach H-level state. Accordingly, in the period of time t5 to t8, the terminal 127*b*-LAT electrically coupled to the terminal 127*a*-LAT and the terminal 127*b*-CH electrically coupled to the terminal 127*a*-CH do not simultaneously reach the H-level state. In other words, in the period of time t5 to time t8, a signal for preventing the terminal 127*b*-LAT and the terminal 127*b*-CH from simultaneously reaching the H-level state is input to the print head 3. Accordingly, the selector 202*a* does not output the latch signal LAT, the change signal CH, the clock signal SCK, and the printing data signal SI11 to the memory 200. Accordingly, in the period of time t5 to t8, the writing processing and reading processing with respect to the memory 200 are not executed.

As described above, in the period of time t5 to t8, the print head 3 executes the reading processing of reading the information stored in the memory 200 and executes the ejection control processing of controlling whether or not to supply the drive signal COM to the plurality of ejecting portions 600 by switching between the transmission gates TGa, TGb, and TGc included in the drive signal selection control circuit 210 in accordance with the latch signal LAT, the change signal CH, and the memory control signal MC1. The operation mode of the print head 3 in the period of time t5 to t8 as described above is an example of a second mode.

Here, in the branch wiring substrate 335 where each signal is input to the print head 3, the terminal 127*b*-COM11 to which the drive signal COM11 is input is an example of a high voltage signal input terminal, the terminal 127*b*-SI11_MC1 to which the printing data signal SI11 is input is an example of a first low voltage logic signal input terminal, the terminal 127*b*-LAT to which the latch signal LAT is input is an example of a second low voltage logic signal input terminal, and the terminal 127*b*-CH to which the change signal CH is input is an example of a third low voltage logic signal input terminal. Accordingly, at least one of the terminal 127*b*-SI11_MC1, the terminal 127*b*-LAT, and the terminal 127*b*-CH is an example of a low voltage logic signal input terminal.

In addition, whether the operation mode of the print head 3 is to be the first mode or the second mode is controlled by the memory control signal MC1 output from the terminal 127*a*-SI11_MC11 electrically coupled to the terminal 127*b*-SI11_MC1, the latch signal LAT output from the terminal 127*a*-LAT electrically coupled to the terminal 127*b*-LAT, and the change signal CH output from the terminal 127*a*-CH electrically coupled to the terminal 127*b*-CH. In other words, at least one of the memory control signal MC1, the latch signal LAT, and the change signal CH respectively input to the terminals 127*b*-SI11_MC1, 127*b*-LAT, and 127*b*-CH of the print head 3 is an example of an input signal.

Here, the reading processing and the writing processing of the information stored in the memory 200 described above may occur at any timing with the print head 3 incorporated in the same liquid ejecting apparatus 1 and, for example, the reading processing may be executed even after the drive signal COM is supplied to the print head 3. The request may occur at, for example, a timing when a request for removing the print head 3 incorporated in the liquid ejecting apparatus 1 has been made, a timing when each condition has exceeded a predetermined threshold, and a timing when a request for writing to the memory 200 has been made as a result of user operation. As a result, the print head 3 can be operated based on the latest information.

In addition, the reading processing of the information stored in the memory 200 is preferably executed after the power supply voltage is supplied to the print head 3 and before the drive signal COM for liquid ejection from the ejecting portion 600 is supplied to the ejecting portion 600. As a result, it is possible to drive the print head 3 after grasping the state of the print head 3 before liquid ejection from the print head 3, and thus it is possible to reduce the possibility of ink ejection precision deterioration attributable to deterioration of the print head 3. In addition, of the various types of information stored in the memory 200, the three pieces of threshold information corresponding to each of the information on the cumulative printing surface count TP, the information on the elapsed day count LD, the information on the error count EC, the information on the transport error count CEC, the information on the capping processing count CP, the information on the cleaning processing count CL, and the information on the wiping processing count WP may be written in, for example, a step of manufacturing the print head 3. The determination threshold for determining the information on whether or not the print head 3 can be recycled or reused is determined in a step of manufacturing the print head 3. By storing such a determination threshold in the print head 3, it is possible to determine the state of the print head 3 by a uniform reference during refurbishing for recycling or reusing the print head 3. Accordingly, the quality of the liquid ejecting apparatus 1 is stable in the case of re-market distribution of the liquid ejecting apparatus 1 including the recycled or reused print head 3.

It should be noted that the three pieces of threshold information corresponding to each of the information on the cumulative printing surface count TP, the information on the elapsed day count LD, the information on the error count EC, the information on the transport error count CEC, the information on the capping processing count CP, the information on the cleaning processing count CL, and the information on the wiping processing count WP read from the memory 200 may be stored in a storage portion (not illustrated) included in the print head control circuit 71. In this case, writing in the storage portion may be performed in a step of manufacturing the liquid ejecting apparatus 1. As a result, the storage capacity of the memory 200 included in the print head 3 can be reduced.

Further, the respective storage capacities of the storage regions M1 to M42 as illustrated in FIG. 19 may be different storage capacities depending on the capacity of stored data and a controllable address region or the same storage capacity.

1.5 Action and Effect

As described above, the print head 3 in the present embodiment has the memory 200 including a non-volatile memory having a storage region that can be rewritten in accordance with the operation state of the print head 3. Further, the information stored in the storage regions M4, M10, M16, M22, M28, M34, and M40 among the storage regions of the memory 200 is rewritten in accordance with the threshold information indicating the presence or absence of the use history of the print head 3 determined based on the operation state of the print head 3 and the information stored in the storage regions M6, M12, M18, M24, M30, M36, and M42 is rewritten based on the threshold information determined based on the operation state of the print head 3 and indicating whether or not the print head 3 is suitable for recycle or reuse. In other words, the print head 3 in the present embodiment has a plurality of storage regions that can be rewritten in accordance with the operation state of the print head 3. As a result, it is possible to grasp the degree of deterioration of the print head 3 and the ejecting portion 600 included in the print head 3 in stages and it is possible as a result to more appropriately recognize the state of the print head 3 to be recycled or reused.

2. Second Embodiment

Next, the liquid ejecting apparatus 1 and the print head 3 in a second embodiment will be described.

It should be noted that configurations identical to those of the liquid ejecting apparatus 1 and the print head in the first embodiment will be denoted by the same reference numerals and description thereof will be simplified or omitted in the following description of the liquid ejecting apparatus 1 and the print head 3 of the second embodiment.

Figure 24:
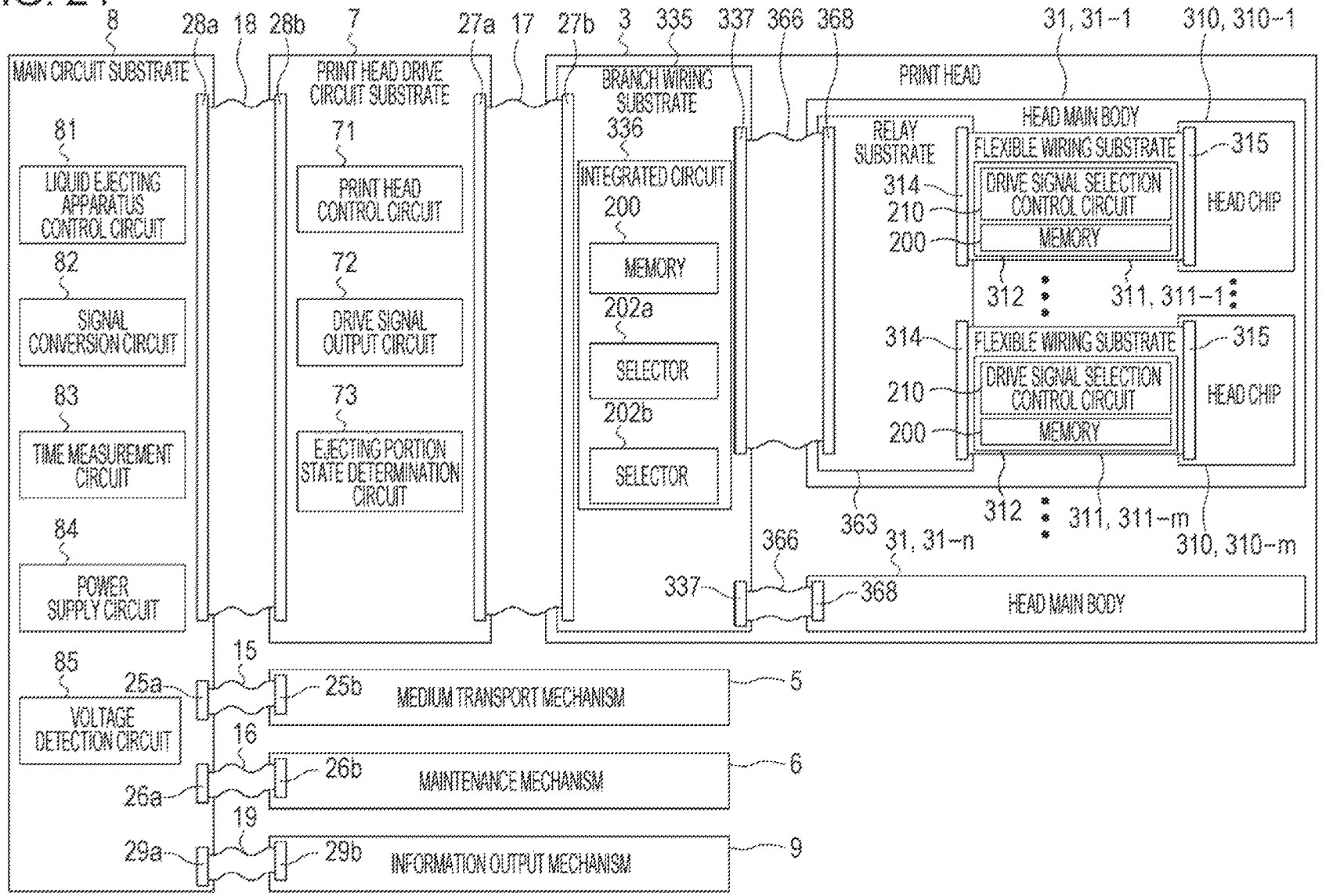
FIG. 24 is a diagram illustrating the functional configuration of a liquid ejecting apparatus of a second embodiment.
Figure 25:
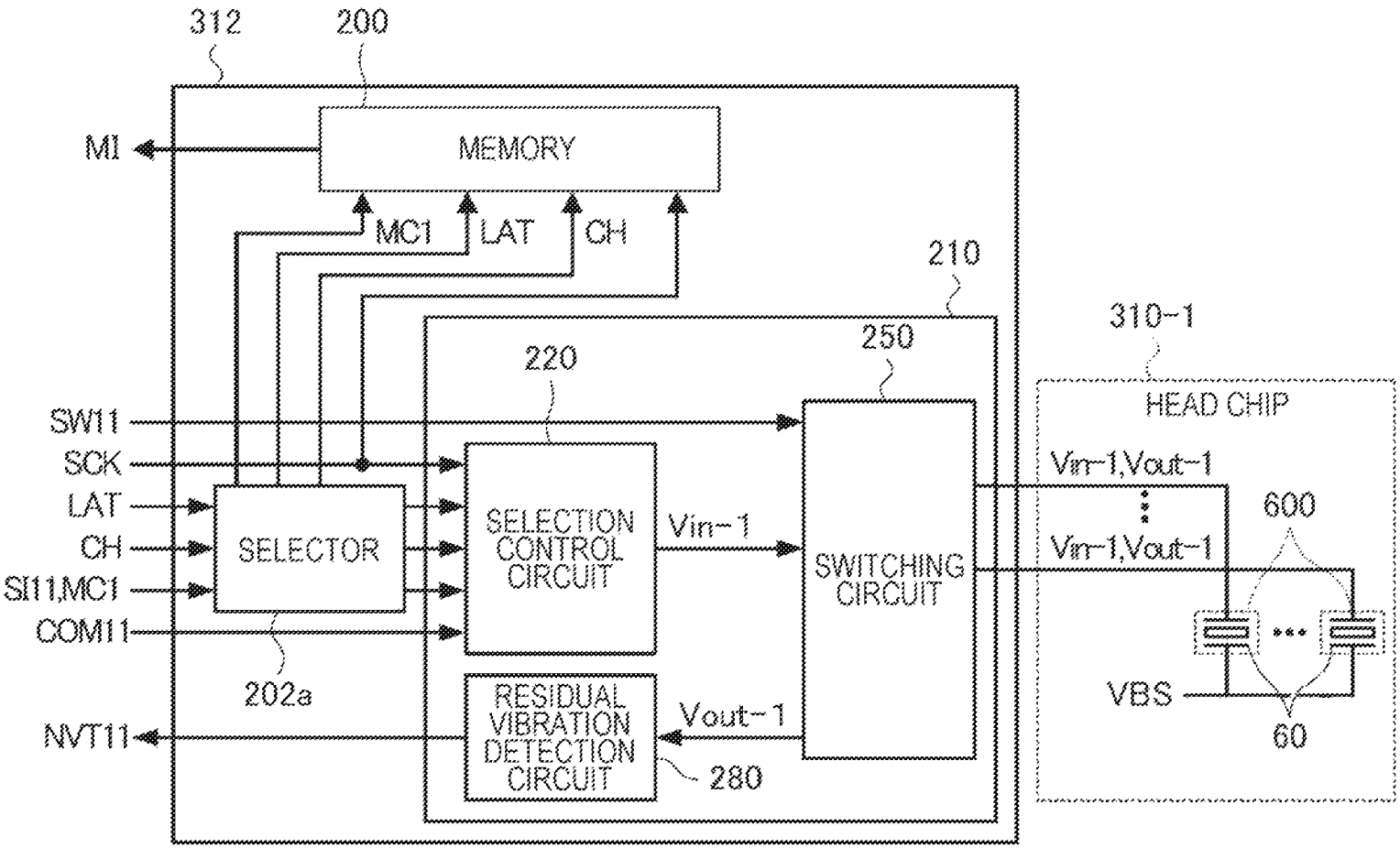
FIG. 25 is a diagram for describing details of the integrated circuit 312 of the second embodiment.

FIG. 24 is a diagram illustrating the functional configuration of the liquid ejecting apparatus 1 of the second embodiment. FIG. 25 is a diagram for describing details of the integrated circuit 312 of the second embodiment. As illustrated in FIGS. 24 and 25, the liquid ejecting apparatus 1 in the second embodiment is different from the liquid ejecting apparatus 1 of the first embodiment in that the memory 200 is mounted on the integrated circuit 312 provided on the flexible wiring substrate 311. In other words, the print head 3 includes the head chip 310 including the ejecting portion 600, the flexible wiring substrate 311 electrically coupled to the head chip 310, the branch wiring substrate 335 and the relay substrate 363 to which the flexible wiring substrate 311 is electrically coupled, and the base member 33 to which the branch wiring substrate 335, the relay substrate 363, the head chip 310, and the flexible wiring substrate 311 are assembled. Further, the memory 200 storing the ejecting portion-related information is disposed on the flexible wiring substrate 311.

Here, the configuration that includes the flexible wiring substrate 311 and the head chip 310 including the ejecting portion 600 is an example of an ejecting module in the second embodiment and the relay substrate 363 to which the ejecting module is electrically coupled or the branch wiring substrate 335 to which the ejecting module is electrically coupled via the cable 366 is an example of a circuit substrate in the second embodiment. Further, the base member 33 to which the branch wiring substrate 335, the relay substrate 363, the head chip 310, and the flexible wiring substrate 311 are assembled is an example of a housing.

In the memory 200, the print head 3 in which the head main body 31 including the plurality of head chips 310 is assembled in the base member 33 stores ejecting portion-related information including information on the cumulative printing surface count TP, information on the elapsed day count LD, information on the error count EC, information on the transport error count CEC, information on the capping processing count CP, information on the cleaning processing count CL, and information on the wiping processing count WP for each head chip 310 subsequent to assembly to the liquid ejecting apparatus 1. In other words, the memory 200 is capable of storing ejecting portion-related information with respect to each of the plurality of head chips 310. Accordingly, in a case where the print head 3 including the plurality of head chips 310 is recycled or reused, it is possible to grasp the recyclability or reusability and the state of each individual head chip 310 stored in the memory 200. Accordingly, the liquid ejecting apparatus 1 incorporating the print head 3 to be recycled or reused is capable of selecting the print head 3 classified in more detail in accordance with applications and it is possible as a result to further improve user convenience, further reduce the amount of the print heads 3 to be discarded, and further reduce the environmental load.

3. Modification Example

Figure 26:
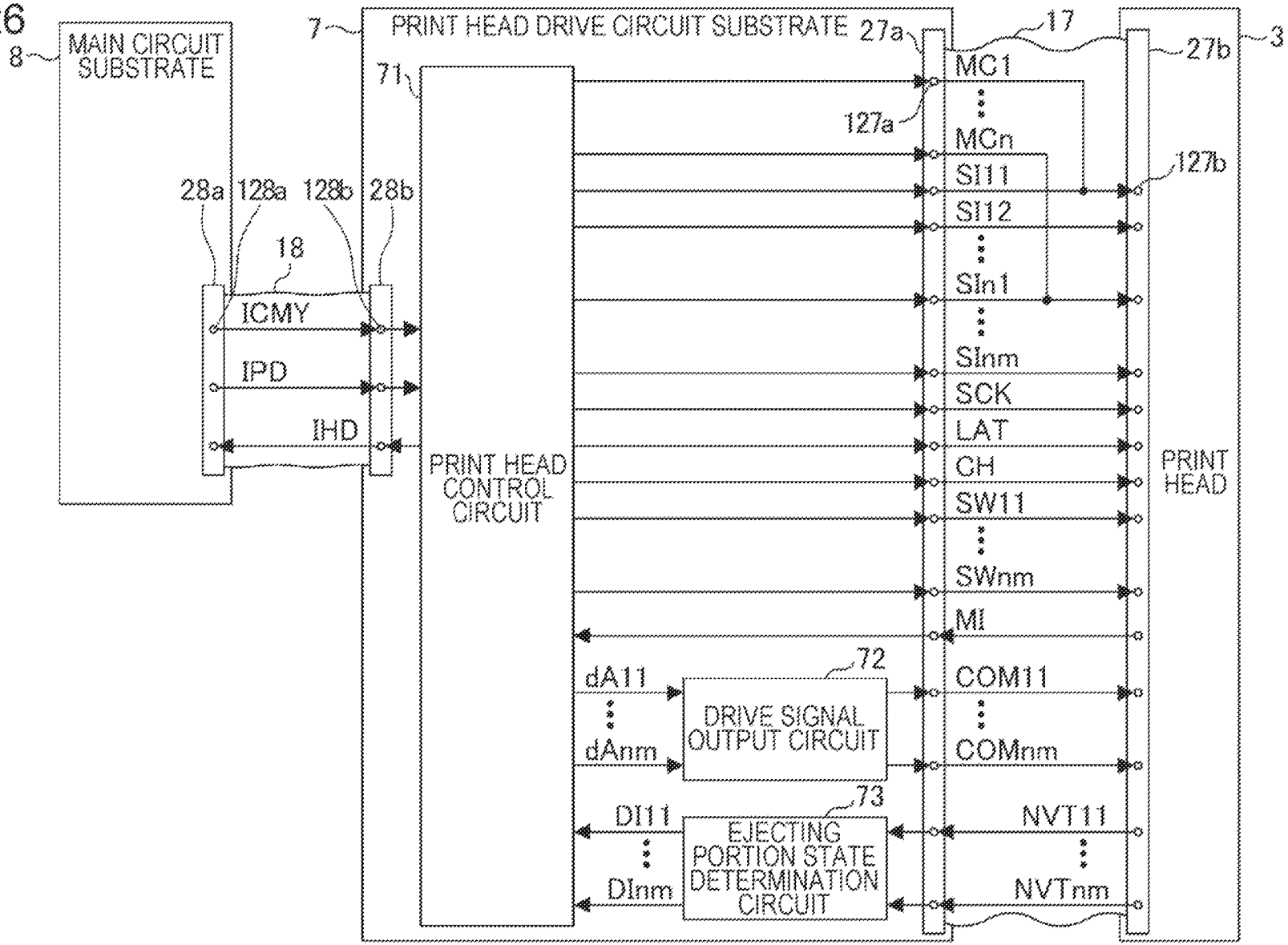
FIG. 26 is a diagram illustrating the functional configuration of a liquid ejecting apparatus of a modification example.

Although the printing data signal SI11 and the memory control signal MC1 are output from the common terminal 127*a*-SI11_MC1 of the terminal group 27*a* provided on the print head drive circuit substrate 7 in the liquid ejecting apparatus 1 and the print head 3 in the first and second embodiments, the printing data signal SI11 and the memory control signal MC1 may be output from different terminals of the terminal group 27*a* provided on the print head drive circuit substrate 7 as illustrated in FIG. 26. Even in this case, the same action and effect as in the above-described embodiments can be obtained.

Although embodiments and modification examples have been described above, the present disclosure is not limited to the embodiments and can be implemented in various aspects without departing from the scope of the present disclosure. For example, the above-described embodiments can be combined as appropriate.

The present disclosure includes a configuration that is substantially identical to the configuration described in the embodiments (such as a configuration identical in function, method, and result and a configuration identical in object and effect). In addition, the present disclosure includes a configuration in which a non-essential part of the configuration described in the embodiments has been replaced. In addition, the present disclosure includes a configuration that is identical in action and effect to the configuration described in the embodiments or a configuration that is capable of achieving the same object as the configuration described in the embodiments. In addition, the present disclosure includes a configuration in which a known technique has been added to the configuration described in the embodiments.

The following content is derived from the above-described embodiments and modification examples.

One aspect of the print head is a print head assembled to a liquid ejecting apparatus ejecting liquid with respect to a medium, the print head including: a first ejecting portion ejecting the liquid by being supplied with a high voltage signal changing in voltage value; a second ejecting portion ejecting the liquid by being supplied with the high voltage signal; a first ejecting portion group having a plurality of ejecting portions including the first ejecting portion and the second ejecting portion; a first switch switching between whether or not to supply the high voltage signal to the first ejecting portion in accordance with a low voltage logic signal having a maximum voltage value lower than a maximum voltage value of the high voltage signal and changing in voltage value; a second switch switching between whether or not to supply the high voltage signal to the second ejecting portion in accordance with the low voltage logic signal; a switch group having a plurality of switches including the first switch and the second switch; a memory; a high voltage signal input terminal to which the high voltage signal is input; and a low voltage logic signal input terminal to which the low voltage logic signal is input, in which the print head has: a first mode in which the print head executes reading processing of reading information stored in the memory and does not execute ejection control processing of controlling whether or not to supply the high voltage signal to the first ejecting portion group by switching the switch group in accordance with an input signal input from the low voltage logic signal input terminal; and a second mode in which the print head does not execute the reading processing and executes the ejection control processing in accordance with the input signal.

According to this print head, the reading control for reading the information stored in the memory is executed in accordance with the input signal input to the print head. In other words, in a case where the print head is driven, it is possible to grasp the state of the print head based on the information recorded in the memory and drive the print head under a drive condition in accordance with the state of the print head. Accordingly, it is possible to drive the print head under appropriate drive conditions even in a case where the print head is reused.

In addition, according to this print head, the reading processing of the memory and the ejection control processing with respect to the ejecting portion group are executed in accordance with the signal input to the input terminal as the low voltage logic signal. Accordingly, it is not necessary to individually provide a terminal for propagating a signal for executing the reading processing and a terminal for propagating a signal for executing the ejection control processing. As a result, the number of terminals provided in the print head can be reduced. Accordingly, the size of the print head can be reduced.

Further, a terminal to which a signal for executing the reading processing is input and a terminal to which a signal for executing the ejection control processing is input can be a common terminal, and thus a circuit can be shared in a case where the circuit or the like is provided for external noise impact reduction. Accordingly, the size of the print head can be reduced.

In one aspect of the print head, the low voltage logic signal may include a first low voltage logic signal, a second low voltage logic signal, and a third low voltage logic signal. The low voltage logic signal input terminal may include a first low voltage logic signal input terminal to which the first low voltage logic signal is input and including two states of an H-level state and an L-level state, a second low voltage logic signal input terminal to which the second low voltage logic signal is input and including two states of an H-level state and an L-level state, and a third low voltage logic signal input terminal to which the third low voltage logic signal is input and including two states of an H-level state and an L-level state. A signal for causing the second low voltage logic signal input terminal to reach the H-level state may be input, a signal for causing the third low voltage logic signal input terminal to reach the H-level state may be input, and a signal for causing the first low voltage logic signal input terminal to change between the H-level state and the L-level state may be input in the first mode. A signal for preventing the second low voltage logic signal input terminal and the third low voltage logic signal input terminal from simultaneously reaching the H-level state may be input in the second mode.

According to this print head, the first low voltage logic signal input terminal having the two states of the H-level state and the L-level state, the second low voltage logic signal input terminal having the two states of the H-level state and the L-level state, and the third low voltage logic signal input terminal having the two states of the H-level state and the L-level state are provided as the low voltage logic signal input terminal. Further, the print head switches between whether to execute the reading processing or to execute the ejection control processing depending on the combination between the state of the second low voltage logic signal input terminal and the state of the third low voltage logic signal input terminal. Accordingly, the print head does not have to be individually provided with a terminal to which a switching signal for switching between whether to execute the reading processing or to execute the ejection control processing is input. In other words, the number of terminals provided in the print head can be further reduced. Accordingly, it is possible to further reduce the size of the print head.

In one aspect of the print head, a signal for executing the reading processing may be input to the first low voltage logic signal input terminal in the first mode.

In one aspect of the print head, the first low voltage logic signal for switching between whether or not to supply the high voltage signal to the first ejecting portion group by switching the switch group may be input in the second mode.

According to this print head, a signal having a high frequency of switching between the H level and the L level and input in a case where the ejection control processing is executed and a signal switching between the H level and the L level and input in a case where the reading control is executed are propagated from the same terminal. Accordingly, the signal having a high frequency of switching between the H level and the L level and input in a case where the ejection control processing is executed and the signal switching between the H level and the L level and input in a case where the reading control is executed are not simultaneously input to the print head. Accordingly, the possibility of mutual interference between the signal having a high frequency of switching between the H level and the L level and input in a case where the ejection control processing is executed and the signal switching between the H level and the L level and input in a case where the reading control is executed is reduced. Accordingly, a stable signal is input to the print head and the operation of the print head can be stabilized as a result.

In one aspect of the print head, the second low voltage logic signal for defining an ejection timing when the liquid is ejected from the first ejecting portion group may be input in the second mode.

In one aspect of the print head, the high voltage signal may include a first voltage waveform and a second voltage waveform in accordance with the amount of the liquid ejected from the first ejecting portion group. The third low voltage logic signal for defining a timing of switching between the first voltage waveform and the second voltage waveform may be input in the second mode.

In one aspect of the print head, the reading processing may be executed after a power supply voltage is supplied and before the high voltage signal for ejecting the liquid from the first ejecting portion group is supplied to the first ejecting portion group.

According to this print head, it is possible to perform the reading processing of reading the information held in the memory before supplying the high voltage signal. As a result, the state of the print head can be grasped before the print head executes the ejection control processing. Accordingly, the possibility that a high voltage signal not suitable for the state of the print head is supplied to the print head is reduced and the print head that is reused can be driven under more appropriate drive conditions.

In one aspect of the print head, the reading processing may be executed even after the high voltage signal is supplied to the print head.

According to this print head, the reading processing of reading the information held in the memory is performed even after the high voltage signal is supplied to the print head, and thus the print head can be driven under appropriate drive conditions in accordance with a change in state resulting from the ejection operation of the print head.

In one aspect of the print head, the memory may include: a first memory region rewritable when a predetermined operation state occurs in excess of a first threshold; and a second memory region rewritable when the predetermined operation state occurs in excess of a second threshold larger than the first threshold.

In one aspect of the print head, the memory may be a non-volatile memory.

In one aspect of the print head, the non-volatile memory may be a One Time PROM.

In one aspect of the print head, the non-volatile memory may be an EPROM.

In one aspect of the print head, the non-volatile memory may be covered so as not to be irradiated with an ultraviolet ray.

In one aspect of the print head, a third ejecting portion ejecting the liquid by being supplied with the high voltage signal; a second ejecting portion group having a plurality of ejecting portions including the third ejecting portion; a first ejecting module including the first ejecting portion group; a second ejecting module including the second ejecting portion group; and a circuit substrate electrically coupled to the first ejecting module and the second ejecting module, in which the print head has: in which the memory may be disposed on the circuit substrate.

In one aspect of the print head, an ejecting module including the first ejecting portion group; a circuit substrate electrically coupled to the ejecting module; and a housing where the circuit substrate and the ejecting module are assembled, in which the print head has: in which the memory may be disposed in the ejecting module.

In one aspect of the print head, the predetermined operation state may include a state where the liquid is ejected from the first ejecting portion group. The first threshold and the second threshold may include a threshold corresponding to a cumulative printing surface count of the medium where the liquid is ejected by the first ejecting portion group after the assembly of the print head to the liquid ejecting apparatus.

Deterioration attributable to the number of times of liquid ejection is a factor that changes the ejection characteristics of the print head. Particularly in the case of liquid ejection with respect to a medium that is transported, a slight contact may occur between the print head and the medium and then a water-repellent film formed by coating on the print head or the like may be consumed. According to this print head, it is possible to provide notification on the state of the ejecting portion group, which is hardly confirmed visually, based on the recorded cumulative printing surface count information by recording the threshold information on the cumulative printing surface count in the memory. Accordingly, the print head can be driven in accordance with the state of the ejecting portion group. In other words, the print head can be driven under appropriate drive conditions in accordance with the state of the print head.

In one aspect of the print head, the predetermined operation state may include a state where the print head is assembled in the liquid ejecting apparatus. The first threshold and the second threshold may include a threshold corresponding to an elapsed day count after the assembly of the print head to the liquid ejecting apparatus.

According to this print head, it is possible to provide notification on the degree of deterioration of a print head component that may deteriorate with time. Accordingly, the print head can be driven under appropriate drive conditions in accordance with the degree of component deterioration.

In one aspect of the print head, the predetermined operation state may include a state where an error occurs in the print head. The first threshold and the second threshold may include a threshold corresponding to how many times the error occurs in the print head after the assembly of the print head to the liquid ejecting apparatus.

According to this print head, the threshold information on the print head error is stored in the memory, and thus it is possible to provide notification on the degree of print head stress caused by the error. Accordingly, the print head can be driven under appropriate drive conditions with the impact of past stress on the print head considered.

In one aspect of the print head, the predetermined operation state may include a state where a transport error occurs in the medium transported to the print head. The first threshold and the second threshold may include a threshold corresponding to how many times the transport error occurs after the assembly of the print head to the liquid ejecting apparatus.

In one aspect of the print head, the predetermined operation state may include a state where capping processing of attaching a cap to a nozzle where the liquid is ejected from the first ejecting portion is executed. The first threshold and the second threshold may include a threshold corresponding to how many times the capping processing is executed after the assembly of the print head to the liquid ejecting apparatus.

The cap is directly attached to the ejecting portion group of the print head during the capping processing, and thus the capping processing is likely to deteriorate the ejecting portion group. By recording the threshold information on the capping processing in the memory, it is possible to provide more detailed notification on the state of the print head. As a result, according to this print head, it is possible to drive the print head under more appropriate drive conditions in accordance with the degree of print head deterioration.

In one aspect of the print head, the predetermined operation state may include a state where wiping processing of wiping a nozzle surface provided with a nozzle where the liquid is ejected from the first ejecting portion is executed. The first threshold and the second threshold may include a threshold corresponding to how many times the wiping processing is executed after the assembly of the print head to the liquid ejecting apparatus.

The ejecting portion group of the print head is directly wiped during the wiping processing, and thus the degree of ejecting portion group deterioration may vary with and liquid ejection characteristics may be affected by how many times the wiping processing is performed. It is possible to grasp the state of the print head by storing the threshold information on the wiping processing in the memory. As a result, according to this print head, it is possible to drive the print head under more appropriate drive conditions in accordance with the degree of print head deterioration.

In one aspect of the print head, the predetermined operation state may include a state where cleaning processing is executed in the first ejecting portion group. The first threshold and the second threshold may include a threshold corresponding to how many times the cleaning processing is executed after the assembly of the print head to the liquid ejecting apparatus.

A load other than the ejection operation is applied to the print head by the cleaning processing being performed. Accordingly, the degree of print head deterioration varies with the number of times of the cleaning processing. It is possible to grasp the state of the print head by storing the threshold information on the cleaning processing in the memory. As a result, according to this print head, it is possible to drive the print head under more appropriate drive conditions in accordance with the degree of print head deterioration.

In one aspect of the print head, the predetermined operation state may include a state where the liquid is ejected from the first ejecting portion group. The first threshold and the second threshold may include a threshold corresponding to a cumulative printing surface count of the medium where the liquid is ejected by the ejecting portion after the assembly of the ejecting module to the liquid ejecting apparatus.

Deterioration attributable to the number of times of liquid ejection is a factor that changes the ejection characteristics of the print head. Particularly in the case of liquid ejection with respect to a medium that is transported, a slight contact may occur between the print head and the medium and then a water-repellent film formed by coating on the print head or the like may be consumed. According to this print head, it is possible to provide notification on the state of the ejecting portion group, which is hardly confirmed visually, based on the recorded cumulative printing surface count information by recording the threshold information on the cumulative printing surface count in the memory. Accordingly, the print head can be driven in accordance with the state of the ejecting portion group. In other words, the print head can be driven under appropriate drive conditions in accordance with the state of the print head.

In one aspect of the print head, the predetermined operation state may include a state where the ejecting module is assembled in the liquid ejecting apparatus. The first threshold and the second threshold may include a threshold corresponding to an elapsed day count after the assembly of the ejecting module to the liquid ejecting apparatus.

According to this print head, it is possible to provide notification on the degree of deterioration of a print head component that may deteriorate with time. Accordingly, the print head can be driven under appropriate drive conditions in accordance with the degree of component deterioration.

In one aspect of the print head, the predetermined operation state may include a state where an error occurs in the ejecting module. The first threshold and the second threshold may include a threshold corresponding to how many times the error occurs in the ejecting module after the assembly of the ejecting module to the liquid ejecting apparatus.

According to this print head, the threshold information on the print head error is stored in the memory, and thus it is possible to provide notification on the degree of print head stress caused by the error. Accordingly, the print head can be driven under appropriate drive conditions with the impact of past stress on the print head considered.

In one aspect of the print head, the predetermined operation state may include a state where a transport error occurs in the medium transported to the print head. The first threshold and the second threshold may include a threshold corresponding to how many times the transport error occurs after the assembly of the ejecting module to the liquid ejecting apparatus.

In one aspect of the print head, the predetermined operation state may include a state where capping processing of attaching a cap to a nozzle where the liquid is ejected from the first ejecting portion is executed. The first threshold and the second threshold may include a threshold corresponding to how many times the capping processing is executed after the assembly of the ejecting module to the liquid ejecting apparatus.

The cap is directly attached to the ejecting portion group of the print head during the capping processing, and thus the capping processing is likely to deteriorate the ejecting portion group. By recording the threshold information on the capping processing in the memory, it is possible to provide more detailed notification on the state of the print head. As a result, according to this print head, it is possible to drive the print head under more appropriate drive conditions in accordance with the degree of print head deterioration.

In one aspect of the print head, the predetermined operation state may include a state where wiping processing of wiping a nozzle surface provided with a nozzle where the liquid is ejected from the first ejecting portion is executed. The first threshold and the second threshold may include a threshold corresponding to how many times the wiping processing is executed after the assembly of the ejecting module to the liquid ejecting apparatus.

The ejecting portion group of the print head is directly wiped during the wiping processing, and thus the degree of ejecting portion group deterioration may vary with and liquid ejection characteristics may be affected by how many times the wiping processing is performed. It is possible to grasp the state of the print head by storing the threshold information on the wiping processing in the memory. As a result, according to this print head, it is possible to drive the print head under more appropriate drive conditions in accordance with the degree of print head deterioration.

In one aspect of the print head, the predetermined operation state may include a state where cleaning processing is executed in the first ejecting portion group. The first threshold and the second threshold may include a threshold corresponding to how many times the cleaning processing is executed after the assembly of the ejecting module to the liquid ejecting apparatus.

A load other than the ejection operation is applied to the print head by the cleaning processing being performed. Accordingly, the degree of print head deterioration varies with the number of times of the cleaning processing. It is possible to grasp the state of the print head by storing the threshold information on the cleaning processing in the memory. As a result, according to this print head, it is possible to drive the print head under more appropriate drive conditions in accordance with the degree of print head deterioration.

In one aspect of the print head, the second threshold may be a threshold for determining whether or not recycling or reusing is possible.

In one aspect of the print head, the memory may have a third memory region rewritable when the predetermined operation state occurs in excess of a third threshold larger than the first threshold and smaller than the second threshold.

In one aspect of the print head, the third threshold may be a threshold for dividing a recyclable or reusable state.

One aspect of the liquid ejecting apparatus includes: a drive signal output circuit outputting a drive signal; and a print head assembled to the liquid ejecting apparatus ejecting liquid with respect to a medium, in which the print head assembled to the liquid ejecting apparatus ejecting the liquid with respect to the medium includes: a first ejecting portion ejecting the liquid by being supplied with a high voltage signal changing in voltage value; a second ejecting portion ejecting the liquid by being supplied with the high voltage signal; a first ejecting portion group having a plurality of ejecting portions including the first ejecting portion and the second ejecting portion; a first switch switching between whether or not to supply the high voltage signal to the first ejecting portion in accordance with a low voltage logic signal having a maximum voltage value lower than a maximum voltage value of the high voltage signal and changing in voltage value; a second switch switching between whether or not to supply the high voltage signal to the second ejecting portion in accordance with the low voltage logic signal; a switch group having a plurality of switches including the first switch and the second switch; a memory; a high voltage signal input terminal to which the high voltage signal is input; and a low voltage logic signal input terminal to which the low voltage logic signal is input, in which the print head has: a first mode in which the print head executes reading processing of reading information stored in the memory and does not execute ejection control processing of controlling whether or not to supply the high voltage signal to the first ejecting portion group by switching the switch group in accordance with an input signal input from the low voltage logic signal input terminal; and a second mode in which the print head does not execute the reading processing and executes the ejection control processing in accordance with the input signal.

According to this liquid ejecting apparatus, the reading control for the print head to read the information stored in the memory is executed in accordance with the input signal input to the print head. In other words, in a case where the print head is applied to the liquid ejecting apparatus, it is possible to grasp the state of the print head based on the information recorded in the memory and drive the print head under a drive condition in accordance with the state of the print head. Accordingly, it is possible to drive the print head under appropriate drive conditions even in a case where the print head is reused.

In addition, according to this liquid ejecting apparatus, the reading processing of the memory by the print head and the ejection control processing with respect to the ejecting portion group are executed in accordance with the signal input to the input terminal as the low voltage logic signal. Accordingly, it is not necessary to individually provide a terminal for propagating a signal for executing the reading processing and a terminal for propagating a signal for executing the ejection control processing. As a result, the number of terminals provided in the print head can be reduced. Accordingly, the size of the print head can be reduced along with the size of the liquid ejecting apparatus provided with the print head.

Further, a terminal to which a signal for the print head to execute the reading processing is input and a terminal to which a signal for executing the ejection control processing is input can be a common terminal, and thus a circuit can be shared in a case where the circuit or the like is provided for external noise impact reduction. Accordingly, the size of the print head can be reduced along with the size of the liquid ejecting apparatus provided with the print head.

In one aspect of the liquid ejecting apparatus, the low voltage logic signal may include a first low voltage logic signal, a second low voltage logic signal, and a third low voltage logic signal. The low voltage logic signal input terminal may include a first low voltage logic signal input terminal to which the first low voltage logic signal is input and including two states of an H-level state and an L-level state, a second low voltage logic signal input terminal to which the second low voltage logic signal is input and including two states of an H-level state and an L-level state, and a third low voltage logic signal input terminal to which the third low voltage logic signal is input and including two states of an H-level state and an L-level state. A signal for causing the second low voltage logic signal input terminal to reach the H-level state may be input, a signal for causing the third low voltage logic signal input terminal to reach the H-level state may be input, and a signal for causing the first low voltage logic signal input terminal to change between the H-level state and the L-level state may be input in the first mode. A signal for preventing the second low voltage logic signal input terminal and the third low voltage logic signal input terminal from simultaneously reaching the H-level state may be input in the second mode.

According to this liquid ejecting apparatus, the print head has the first low voltage logic signal input terminal having the two states of the H-level state and the L-level state, the second low voltage logic signal input terminal having the two states of the H-level state and the L-level state, and the third low voltage logic signal input terminal having the two states of the H-level state and the L-level state as the low voltage logic signal input terminal. Further, the print head switches between whether to execute the reading processing or to execute the ejection control processing depending on the combination between the state of the second low voltage logic signal input terminal and the state of the third low voltage logic signal input terminal. Accordingly, the print head does not have to be individually provided with a terminal to which a switching signal for switching between whether to execute the reading processing or to execute the ejection control processing is input. In other words, the number of terminals provided in the print head can be further reduced. Accordingly, it is possible to further reduce the size of the print head along with the size of the liquid ejecting apparatus provided with the print head.

In one aspect of the liquid ejecting apparatus, a signal for executing the reading processing may be input to the first low voltage logic signal input terminal in the first mode.

In one aspect of the liquid ejecting apparatus, the first low voltage logic signal for switching between whether or not to supply the high voltage signal to the first ejecting portion group by switching the switch group may be input in the second mode.

According to this liquid ejecting apparatus, a signal having a high frequency of switching between the H level and the L level and input to the print head in a case where the ejection control processing is executed by the print head and a signal switching between the H level and the L level and input to the print head in a case where the reading control is executed are propagated from the same terminal of the print head. Accordingly, the signal having a high frequency of switching between the H level and the L level and input in a case where the ejection control processing is executed by the print head and the signal switching between the H level and the L level and input in a case where the reading control is executed by the print head are not simultaneously input to the print head. Accordingly, the possibility of mutual interference between the signal having a high frequency of switching between the H level and the L level and input in a case where the ejection control processing is executed and the signal switching between the H level and the L level and input in a case where the reading control is executed is reduced. Accordingly, a stable signal is input to the print head and the operation of the print head can be stabilized as a result. Accordingly, the operation of the liquid ejecting apparatus provided with the print head can be stabilized.

In one aspect of the liquid ejecting apparatus, the second low voltage logic signal for defining an ejection timing when the liquid is ejected from the first ejecting portion group may be input in the second mode.

In one aspect of the liquid ejecting apparatus, the high voltage signal may include a first voltage waveform and a second voltage waveform in accordance with the amount of the liquid ejected from the first ejecting portion group. The third low voltage logic signal for defining a timing of switching between the first voltage waveform and the second voltage waveform may be input in the second mode.

In one aspect of the liquid ejecting apparatus, the reading processing may be executed after a power supply voltage is supplied and before the high voltage signal for ejecting the liquid from the first ejecting portion group is supplied to the first ejecting portion group.

According to this liquid ejecting apparatus, it is possible to perform the reading processing for the print head to read the information held in the memory before supplying the high voltage signal. As a result, the state of the print head can be grasped before the print head executes the ejection control processing. Accordingly, the possibility that a high voltage signal not suitable for the state of the print head is supplied to the print head is reduced. As a result, the print head that is reused can be driven under more appropriate drive conditions.

In one aspect of the liquid ejecting apparatus, the reading processing may be executed even after the high voltage signal is supplied to the print head.

According to this liquid ejecting apparatus, the reading processing for the print head to read the information held in the memory is performed even after the high voltage signal is supplied to the print head, and thus the print head can be driven under appropriate drive conditions in accordance with a change in state resulting from the ejection operation of the print head.

In one aspect of the liquid ejecting apparatus, the memory may include: a first memory region rewritable when a predetermined operation state occurs in excess of a first threshold; and a second memory region rewritable when where the predetermined operation state occurs in excess of a second threshold larger than the first threshold.

In one aspect of the liquid ejecting apparatus, the memory may be a non-volatile memory.

In one aspect of the liquid ejecting apparatus, the non-volatile memory may be a One Time PROM.

In one aspect of the liquid ejecting apparatus, the non-volatile memory may be an EPROM.

In one aspect of the liquid ejecting apparatus, the non-volatile memory may be covered so as not to be irradiated with an ultraviolet ray.

In one aspect of the liquid ejecting apparatus, a third ejecting portion ejecting the liquid by being supplied with the high voltage signal; a second ejecting portion group having a plurality of ejecting portions including the third ejecting portion; a first ejecting module including the first ejecting portion group; a second ejecting module including the second ejecting portion group; and a circuit substrate electrically coupled to the first ejecting module and the second ejecting module, in which the print head has: in which the memory may be disposed on the circuit substrate.

In one aspect of the liquid ejecting apparatus, an ejecting module including the first ejecting portion group; a circuit substrate electrically coupled to the ejecting module; and a housing where the circuit substrate and the ejecting module are assembled, in which the print head has: in which the memory may be disposed in the ejecting module.

In one aspect of the liquid ejecting apparatus, the predetermined operation state may include a state where the liquid is ejected from the first ejecting portion group. The first threshold and the second threshold may include a threshold corresponding to a cumulative printing surface count of the medium where the liquid is ejected by the first ejecting portion group after the assembly of the print head to the liquid ejecting apparatus.

Deterioration of the print head attributable to the number of times of liquid ejection by the print head is a factor that changes the ejection characteristics of the liquid ejecting apparatus. Particularly in the case of liquid ejection with respect to a medium that is transported, a slight contact may occur between the print head and the medium and then a water-repellent film formed by coating on the print head or the like may be consumed. According to this liquid ejecting apparatus, it is possible to provide notification on the state of the ejecting portion group, which is hardly confirmed visually, based on the recorded cumulative printing surface count information by recording the threshold information on the cumulative printing surface count in the memory. Accordingly, the print head can be driven in accordance with the state of the ejecting portion group. In other words, the print head can be driven under appropriate drive conditions in accordance with the state of the print head.

In one aspect of the liquid ejecting apparatus, the predetermined operation state may include a state where the print head is assembled in the liquid ejecting apparatus. The first threshold and the second threshold may include a threshold corresponding to an elapsed day count after the assembly of the print head to the liquid ejecting apparatus.

According to this liquid ejecting apparatus, it is possible to provide notification on the degree of deterioration of a print head component that may deteriorate with time. Accordingly, the print head can be driven under appropriate drive conditions in accordance with the degree of component deterioration.

In one aspect of the liquid ejecting apparatus, the predetermined operation state may include a state where an error occurs in the print head. The first threshold and the second threshold may include a threshold corresponding to how many times the error occurs in the print head after the assembly of the print head to the liquid ejecting apparatus.

According to this liquid ejecting apparatus, the threshold information on the print head error is stored in the memory, and thus it is possible to provide notification on the degree of print head stress caused by the error. Accordingly, the print head can be driven under appropriate drive conditions with the impact of past stress on the print head considered.

In one aspect of the liquid ejecting apparatus, the predetermined operation state may include a state where a transport error occurs in the medium transported to the print head. The first threshold and the second threshold may include a threshold corresponding to how many times the transport error occurs after the assembly of the print head to the liquid ejecting apparatus.

In one aspect of the liquid ejecting apparatus, the predetermined operation state may include a state where capping processing of attaching a cap to a nozzle where the liquid is ejected from the first ejecting portion is executed. The first threshold and the second threshold may include a threshold corresponding to how many times the capping processing is executed after the assembly of the print head to the liquid ejecting apparatus.

The cap is directly attached to the ejecting portion group of the print head during the capping processing, and thus the capping processing is likely to deteriorate the ejecting portion group. By recording the threshold information on the capping processing in the memory, it is possible to provide more detailed notification on the state of the print head. As a result, according to this liquid ejecting apparatus, it is possible to drive the print head under more appropriate drive conditions in accordance with the degree of print head deterioration.

In one aspect of the liquid ejecting apparatus, the predetermined operation state may include a state where wiping processing of wiping a nozzle surface provided with a nozzle where the liquid is ejected from the first ejecting portion is executed. The first threshold and the second threshold may include a threshold corresponding to how many times the wiping processing is executed after the assembly of the print head to the liquid ejecting apparatus.

The ejecting portion group of the print head is directly wiped during the wiping processing, and thus the degree of ejecting portion group deterioration may vary with and liquid ejection characteristics may be affected by how many times the wiping processing is performed. It is possible to grasp the state of the print head by storing the threshold information on the wiping processing in the memory. As a result, according to this liquid ejecting apparatus, it is possible to drive the print head under more appropriate drive conditions in accordance with the degree of print head deterioration.

In one aspect of the liquid ejecting apparatus, the predetermined operation state may include a state where cleaning processing is executed in the first ejecting portion group. The first threshold and the second threshold may include a threshold corresponding to how many times the cleaning processing is executed after the assembly of the print head to the liquid ejecting apparatus.

A load other than the ejection operation is applied to the print head by the cleaning processing being performed. Accordingly, the degree of print head deterioration varies with the number of times of the cleaning processing. It is possible to grasp the state of the print head by storing the threshold information on the cleaning processing in the memory. As a result, according to this liquid ejecting apparatus, it is possible to drive the print head under more appropriate drive conditions in accordance with the degree of print head deterioration.

In one aspect of the liquid ejecting apparatus, the predetermined operation state may include a state where the liquid is ejected from the first ejecting portion group. The first threshold and the second threshold may include a threshold corresponding to a cumulative printing surface count of the medium where the liquid is ejected by the ejecting portion after the assembly of the ejecting module to the liquid ejecting apparatus.

Deterioration of the print head attributable to the number of times of liquid ejection by the print head is a factor that changes the ejection characteristics of the liquid ejecting apparatus. Particularly in the case of liquid ejection with respect to a medium that is transported, a slight contact may occur between the print head and the medium and then a water-repellent film formed by coating on the print head or the like may be consumed. According to this liquid ejecting apparatus, it is possible to provide notification on the state of the ejecting portion group, which is hardly confirmed visually, based on the recorded cumulative printing surface count information by recording the threshold information on the cumulative printing surface count in the memory. Accordingly, the print head can be driven in accordance with the state of the ejecting portion group. In other words, the print head can be driven under appropriate drive conditions in accordance with the state of the print head.

In one aspect of the liquid ejecting apparatus, the predetermined operation state may include a state where the ejecting module is assembled in the liquid ejecting apparatus. The first threshold and the second threshold may include a threshold corresponding to an elapsed day count after the assembly of the ejecting module to the liquid ejecting apparatus.

According to this liquid ejecting apparatus, it is possible to provide notification on the degree of deterioration of a print head component that may deteriorate with time. Accordingly, the print head can be driven under appropriate drive conditions in accordance with the degree of component deterioration.

In one aspect of the liquid ejecting apparatus, the predetermined operation state may include a state where an error occurs in the ejecting module. The first threshold and the second threshold may include a threshold corresponding to how many times the error occurs in the ejecting module after the assembly of the ejecting module to the liquid ejecting apparatus.

According to this liquid ejecting apparatus, the threshold information on the print head error is stored in the memory, and thus it is possible to provide notification on the degree of print head stress caused by the error. Accordingly, the print head can be driven under appropriate drive conditions with the impact of past stress on the print head considered.

In one aspect of the liquid ejecting apparatus, the predetermined operation state may include a state where a transport error occurs in the medium transported to the print head. The first threshold and the second threshold may include a threshold corresponding to how many times the transport error occurs after the assembly of the ejecting module to the liquid ejecting apparatus.

In one aspect of the liquid ejecting apparatus, the predetermined operation state may include a state where capping processing of attaching a cap to a nozzle where the liquid is ejected from the first ejecting portion is executed. The first threshold and the second threshold may include a threshold corresponding to how many times the capping processing is executed after the assembly of the ejecting module to the liquid ejecting apparatus.

The cap is directly attached to the ejecting portion group of the print head during the capping processing, and thus the capping processing is likely to deteriorate the ejecting portion group. By recording the threshold information on the capping processing in the memory, it is possible to provide more detailed notification on the state of the print head. As a result, according to this liquid ejecting apparatus, it is possible to drive the print head under more appropriate drive conditions in accordance with the degree of print head deterioration.

In one aspect of the liquid ejecting apparatus, the predetermined operation state may include a state where wiping processing of wiping a nozzle surface provided with a nozzle where the liquid is ejected from the first ejecting portion is executed. The first threshold and the second threshold may include a threshold corresponding to how many times the wiping processing is executed after the assembly of the ejecting module to the liquid ejecting apparatus.

The ejecting portion group of the print head is directly wiped during the wiping processing, and thus the degree of ejecting portion group deterioration may vary with and liquid ejection characteristics may be affected by how many times the wiping processing is performed. It is possible to grasp the state of the print head by storing the threshold information on the wiping processing in the memory. As a result, according to this liquid ejecting apparatus, it is possible to drive the print head under more appropriate drive conditions in accordance with the degree of print head deterioration.

In one aspect of the liquid ejecting apparatus, the predetermined operation state may include a state where cleaning processing is executed in the first ejecting portion group. The first threshold and the second threshold may include a threshold corresponding to how many times the cleaning processing is executed after the assembly of the ejecting module to the liquid ejecting apparatus.

A load other than the ejection operation is applied to the print head by the cleaning processing being performed. Accordingly, the degree of print head deterioration varies with the number of times of the cleaning processing. It is possible to grasp the state of the print head by storing the threshold information on the cleaning processing in the memory. As a result, according to this liquid ejecting apparatus, it is possible to drive the print head under more appropriate drive conditions in accordance with the degree of print head deterioration.

In one aspect of the liquid ejecting apparatus, the first threshold may be a threshold for determining whether or not there is a use history.

In one aspect of the liquid ejecting apparatus, the second threshold may be a threshold for determining whether or not recycling or reusing is possible.

In one aspect of the liquid ejecting apparatus, the memory may have a third memory region rewritable when the predetermined operation state occurs in excess of a third threshold larger than the first threshold and smaller than the second threshold.

In one aspect of the liquid ejecting apparatus, the third threshold may be a threshold for dividing a recyclable or reusable state.

What is claimed is:

1. A print head assembled to a liquid ejecting apparatus ejecting liquid with respect to a medium, the print head comprising:

a first ejecting portion ejecting the liquid by being supplied with a high voltage signal changing in voltage value;

a second ejecting portion ejecting the liquid by being supplied with the high voltage signal;

a first ejecting portion group having a plurality of ejecting portions including the first ejecting portion and the second ejecting portion;

a first switch switching between whether or not to supply the high voltage signal to the first ejecting portion in accordance with a low voltage logic signal having a maximum voltage value lower than a maximum voltage value of the high voltage signal and changing in voltage value;

a second switch switching between whether or not to supply the high voltage signal to the second ejecting portion in accordance with the low voltage logic signal;

a switch group having a plurality of switches including the first switch and the second switch;

a memory;

a high voltage signal input terminal to which the high voltage signal is input; and a low voltage logic signal input terminal to which the low voltage logic signal is input, wherein the print head has:

a first mode in which the print head executes reading processing of reading information stored in the memory and does not execute ejection control processing of controlling whether or not to supply the high voltage signal to the first ejecting portion group by switching the switch group in accordance with an input signal input from the low voltage logic signal input terminal; and a second mode in which the print head does not execute the reading processing and executes the ejection control processing in accordance with the input signal.

2. The print head according to claim 1, wherein the low voltage logic signal includes a first low voltage logic signal, a second low voltage logic signal, and a third low voltage logic signal, the low voltage logic signal input terminal includes a first low voltage logic signal input terminal to which the first low voltage logic signal is input and including two states of an H-level state and an L-level state, a second low voltage logic signal input terminal to which the second low voltage logic signal is input and including two states of an H-level state and an L-level state, and a third low voltage logic signal input terminal to which the third low voltage logic signal is input and including two states of an H-level state and an L-level state, a signal for causing the second low voltage logic signal input terminal to reach the H-level state is input, a signal for causing the third low voltage logic signal input terminal to reach the H-level state is input, and a signal for causing the first low voltage logic signal input terminal to change between the H-level state and the L-level state is input in the first mode, and a signal for preventing the second low voltage logic signal input terminal and the third low voltage logic signal input terminal from simultaneously reaching the H-level state is input in the second mode.

3. The print head according to claim 2, wherein a signal for executing the reading processing is input to the first low voltage logic signal input terminal in the first mode.

4. The print head according to claim 2, wherein the first low voltage logic signal for switching between whether or not to supply the high voltage signal to the first ejecting portion group by switching the switch group is input in the second mode.

5. The print head according to claim 2, wherein the second low voltage logic signal for defining an ejection timing when the liquid is ejected from the first ejecting portion group is input in the second mode.

6. The print head according to claim 2, wherein the high voltage signal includes a first voltage waveform and a second voltage waveform in accordance with the amount of the liquid ejected from the first ejecting portion group, and the third low voltage logic signal for defining a timing of switching between the first voltage waveform and the second voltage waveform is input in the second mode.

7. The print head according to claim 1, wherein the reading processing is executed after a power supply voltage is supplied and before the high voltage signal for ejecting the liquid from the first ejecting portion group is supplied to the first ejecting portion group.

8. The print head according to claim 1, wherein the memory is a non-volatile memory.

9. The print head according to claim 8, wherein the non-volatile memory is a One Time PROM.

10. The print head according to claim 8, wherein the non-volatile memory is an EPROM.

11. A liquid ejecting apparatus comprising:

a drive signal output circuit outputting a drive signal; and a print head assembled to the liquid ejecting apparatus ejecting liquid with respect to a medium, wherein the print head assembled to the liquid ejecting apparatus ejecting the liquid with respect to the medium includes:

a first ejecting portion ejecting the liquid by being supplied with a high voltage signal changing in voltage value;

a second ejecting portion ejecting the liquid by being supplied with the high voltage signal;

a first ejecting portion group having a plurality of ejecting portions including the first ejecting portion and the second ejecting portion;

a first switch switching between whether or not to supply the high voltage signal to the first ejecting portion in accordance with a low voltage logic signal having a maximum voltage value lower than a maximum voltage value of the high voltage signal and changing in voltage value;

a second switch switching between whether or not to supply the high voltage signal to the second ejecting portion in accordance with the low voltage logic signal;

a switch group having a plurality of switches including the first switch and the second switch;

a memory;

a high voltage signal input terminal to which the high voltage signal is input; and a low voltage logic signal input terminal to which the low voltage logic signal is input, and the print head has:

a first mode in which the print head executes reading processing of reading information stored in the memory and does not execute ejection control processing of controlling whether or not to supply the high voltage signal to the first ejecting portion group by switching the switch group in accordance with an input signal input from the low voltage logic signal input terminal, and a second mode in which the print head does not execute the reading processing and executes the ejection control processing in accordance with the input signal.

12. The liquid ejecting apparatus according to claim 11, wherein the low voltage logic signal includes a first low voltage logic signal, a second low voltage logic signal, and a third low voltage logic signal, the low voltage logic signal input terminal includes a first low voltage logic signal input terminal to which the first low voltage logic signal is input and including two states of an H-level state and an L-level state, a second low voltage logic signal input terminal to which the second low voltage logic signal is input and including two states of an H-level state and an L-level state, and a third low voltage logic signal input terminal to which the third low voltage logic signal is input and including two states of an H-level state and an L-level state, a signal for causing the second low voltage logic signal input terminal to reach the H-level state is input, a signal for causing the third low voltage logic signal input terminal to reach the H-level state is input, and a signal for causing the first low voltage logic signal input terminal to change between the H-level state and the L-level state is input in the first mode, and a signal for preventing the second low voltage logic signal input terminal and the third low voltage logic signal input terminal from simultaneously reaching the H-level state is input in the second mode.

13. The liquid ejecting apparatus according to claim 12, wherein a signal for executing the reading processing is input to the first low voltage logic signal input terminal in the first mode.

14. The liquid ejecting apparatus according to claim 12, wherein the first low voltage logic signal for switching between whether or not to supply the high voltage signal to the first ejecting portion group by switching the switch group is input in the second mode.

15. The liquid ejecting apparatus according to claim 12, wherein the second low voltage logic signal for defining an ejection timing when the liquid is ejected from the first ejecting portion group is input in the second mode.

16. The liquid ejecting apparatus according to claim 12, wherein the high voltage signal includes a first voltage waveform and a second voltage waveform in accordance with the amount of the liquid ejected from the first ejecting portion group, and the third low voltage logic signal for defining a timing of switching between the first voltage waveform and the second voltage waveform is input in the second mode.

17. The liquid ejecting apparatus according to claim 11, wherein the reading processing is executed after a power supply voltage is supplied and before the high voltage signal for ejecting the liquid from the first ejecting portion group is supplied to the first ejecting portion group.

18. The liquid ejecting apparatus according to claim 11, wherein the memory is a non-volatile memory.

19. The liquid ejecting apparatus according to claim 18, wherein the non-volatile memory is a One Time PROM.

20. The liquid ejecting apparatus according to claim 18, wherein the non-volatile memory is an EPROM.

* * * * *